US009837045B2

(12) United States Patent
Furihata et al.

(10) Patent No.: US 9,837,045 B2
(45) Date of Patent: Dec. 5, 2017

(54) DEVICE AND METHOD FOR COLOR ADJUSTMENT AND GAMMA CORRECTION AND DISPLAY PANEL DRIVER USING THE SAME

(71) Applicant: Synaptics Japan GK, Tokyo (JP)

(72) Inventors: Hirobumi Furihata, Tokyo (JP); Takashi Nose, Tokyo (JP); Masao Orio, Tokyo (JP); Akio Sugiyama, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 115 days.

(21) Appl. No.: 14/810,244

(22) Filed: Jul. 27, 2015

(65) Prior Publication Data

US 2016/0035293 A1 Feb. 4, 2016

(30) Foreign Application Priority Data

Jul. 29, 2014 (JP) ..... 2014-153918

(51) Int. Cl.

| | |
|---|---|
| ***G09G 5/02*** | (2006.01) |
| ***G09G 3/36*** | (2006.01) |
| *G09G 3/20* | (2006.01) |

(52) U.S. Cl.

CPC ..... *G09G 5/02* (2013.01); *G09G 3/36* (2013.01); *G09G 3/2003* (2013.01); *G09G 2320/0276* (2013.01); *G09G 2320/0666* (2013.01)

(58) Field of Classification Search

CPC ..... G09G 5/02; G09G 3/36; G09G 3/2003; G09G 2320/0666; G09G 2320/0276

See application file for complete search history.

(56) References Cited

U.S. PATENT DOCUMENTS

2006/0139368 A1* 6/2006 Kinoshita ..... G09G 3/3208 345/590
2010/0002010 A1* 1/2010 Li ..... G09G 5/02 345/590
2014/0340434 A1* 11/2014 El-Ghoroury ..... G09G 3/3607 345/690

FOREIGN PATENT DOCUMENTS

| | | | |
|---|---|---|---|
| JP | 2002116750 | A | 4/2002 |
| JP | 2004096731 | A | 3/2004 |
| JP | 2008040305 | A | 2/2008 |
| JP | 2008067343 | A | 3/2008 |
| JP | 2010079119 | A | 4/2010 |
| WO | 2004070699 | A1 | 8/2004 |

* cited by examiner

*Primary Examiner* — Liliana Cerullo

(74) *Attorney, Agent, or Firm* — Patterson + Sheridan, LLP

(57) ABSTRACT

A display device includes a display panel; and a display panel driver driving the display panel. The display panel driver includes: a processing circuit configured to perform digital arithmetic processing on R, G and B grayscale values of input image data to calculate R, G and B grayscale values of output image data, respectively, and a control point data generation circuit configured to: generate first control point data indicating the shape of a desired gamma curve; calculate Re, G and B control point data indicating input-output curves of digital arithmetic processing performed on the R, G and B grayscale values of the input image data by correcting the first control point data in response to the input image data. The processing circuit is configured to calculate the R, G and B grayscale values of the output image data in response to the R, G and B control point data.

14 Claims, 29 Drawing Sheets

Fig. 12B

| | |
|---|---|
| CORRECTION AMOUNTS FOR WRITE POINT | $\triangle CP_R^W$: 0<br>$\triangle CP_G^W$: -4<br>$\triangle CP_B^W$: -8 |
| CORRECTION AMOUNTS FOR R VERTEX | $\triangle CP_R^R$: 0<br>$\triangle CP_G^R$: -10<br>$\triangle CP_B^R$: -12 |
| CORRECTION AMOUNTS FOR Y VERTEX | $\triangle CP_R^Y$: 0<br>$\triangle CP_G^Y$: 0<br>$\triangle CP_B^Y$: -12 |

$(D_{IN}^R, D_{IN}^G, D_{IN}^B) = (200, 130, 100)$

Fig. 15A

MEASURED VALUES OF PANEL CHARACTERISTICS

| | u' | v' |
|---|---|---|
| WP | 0.201 | 0.471 |
| R VERTEX | 0.444 | 0.526 |
| G VERTEX | 0.134 | 0.565 |
| B VERTEX | 0.192 | 0.149 |
| C VERTEX | 0.153 | 0.454 |
| M VERTEX | 0.298 | 0.302 |
| Y VERTEX | 0.201 | 0.557 |

Fig. 15B

MEASURED VALUES OF PANEL CHARACTERISTICS
(u'v'→xy TRANSFORMATION)

| | x | y |
|---|---|---|
| WP | 0.319 | 0.333 |
| R VERTEX | 0.640 | 0.337 |
| G VERTEX | 0.322 | 0.601 |
| B VERTEX | 0.161 | 0.055 |
| C VERTEX | 0.244 | 0.321 |
| M VERTEX | 0.300 | 0.135 |
| Y VERTEX | 0.422 | 0.519 |

Fig. 16

DESIRED VALUES FOR ADJUSTMENT

| | u' | v' |
|---|---|---|
| WP | 0.198 | 0.468 |
| R VERTEX | 0.451 | 0.523 |
| G VERTEX | 0.125 | 0.563 |
| B VERTEX | 0.175 | 0.158 |
| C VERTEX | 0.138 | 0.455 |
| M VERTEX | 0.305 | 0.330 |
| Y VERTEX | 0.204 | 0.553 |

Fig. 17A

PANEL CHARACTERISTICS FOR 50% SATURATION

| | u' | v' |
|---|---|---|
| WP | 0.201 | 0.471 |
| R (50% SATURATION) | 0.322 | 0.499 |
| G (50% SATURATION) | 0.168 | 0.518 |
| B (50% SATURATION) | 0.197 | 0.310 |
| C (50% SATURATION) | 0.177 | 0.463 |
| M (50% SATURATION) | 0.250 | 0.387 |
| Y (50% SATURATION) | 0.201 | 0.514 |

Fig. 17B

DESIRED VALUES FOR 50% SATURATION

| | u' | v' |
|---|---|---|
| WP | 0.198 | 0.468 |
| R (50% SATURATION) | 0.324 | 0.496 |
| G (50% SATURATION) | 0.161 | 0.515 |
| B (50% SATURATION) | 0.187 | 0.313 |
| C (50% SATURATION) | 0.168 | 0.462 |
| M (50% SATURATION) | 0.251 | 0.399 |
| Y (50% SATURATION) | 0.201 | 0.511 |

Fig. 18A

PANEL CHARACTERISTICS FOR 50% SATURATION
(u'v'→xy TRANSFORMATION)

| | x | y |
|---|---|---|
| WP | 0.319 | 0.333 |
| R (50% SATURATION) | 0.487 | 0.335 |
| G (50% SATURATION) | 0.320 | 0.440 |
| B (50% SATURATION) | 0.215 | 0.151 |
| C (50% SATURATION) | 0.282 | 0.327 |
| M (50% SATURATION) | 0.307 | 0.212 |
| Y (50% SATURATION) | 0.364 | 0.413 |

Fig. 18B

DESIRED VALUES FOR 50% SATURATION
(u'v'→xy TRANSFORMATION)

| | x | y |
|---|---|---|
| WP | 0.313 | 0.329 |
| R (50% SATURATION) | 0.485 | 0.330 |
| G (50% SATURATION) | 0.308 | 0.437 |
| B (50% SATURATION) | 0.207 | 0.154 |
| C (50% SATURATION) | 0.269 | 0.329 |
| M (50% SATURATION) | 0.318 | 0.224 |
| Y (50% SATURATION) | 0.359 | 0.406 |

Fig. 18C

PANEL CHARACTERISTICS FOR 50% SATURATION
(xy→XYZ TRANSFORMATION)

| | X | Y | Z |
|---|---|---|---|
| WP | 0.959748 | 1 | 1.044157 |
| R (50% SATURATION) | 1.45446 | 1 | 0.529705 |
| G (50% SATURATION) | 0.728166 | 1 | 0.544387 |
| B (50% SATURATION) | 1.4268 | 1 | 4.200627 |
| C (50% SATURATION) | 0.861692 | 1 | 1.199196 |
| M (50% SATURATION) | 1.451202 | 1 | 2.270583 |
| Y (50% SATURATION) | 0.879984 | 1 | 0.53998 |

Fig. 18D

DESIRED VALUES FOR 50% SATURATION
(xy→XYZ TRANSFORMATION)

| | X | Y | Z |
|---|---|---|---|
| WP | 0.950456 | 1 | 1.089058 |
| R (50% SATURATION) | 1.472146 | 1 | 0.562509 |
| G (50% SATURATION) | 0.70465 | 1 | 0.585725 |
| B (50% SATURATION) | 1.34116 | 1 | 4.134324 |
| C (50% SATURATION) | 0.818773 | 1 | 1.221968 |
| M (50% SATURATION) | 1.417746 | 1 | 2.045921 |
| Y (50% SATURATION) | 0.885178 | 1 | 0.580264 |

Fig. 19A

PANEL CHARACTERISTICS FOR 50% SATURATION
(RATIOS OF R, G AND B GRAYSCALE VALUES)

| | R | G | B |
|---|---|---|---|
| WP | 1.000 | 1.000 | 1.000 |
| R (50% SATURATION) | 3.151 | 0.473 | 0.473 |
| G (50% SATURATION) | 0.455 | 1.194 | 0.455 |
| B (50% SATURATION) | 0.760 | 0.760 | 4.398 |
| C (50% SATURATION) | 0.540 | 1.108 | 1.161 |
| M (50% SATURATION) | 2.054 | 0.599 | 2.335 |
| Y (50% SATURATION) | 1.019 | 1.043 | 0.457 |

Fig. 19B

DESIRED VALUES FOR 50% SATURATION
(RATIOS OF R, G AND B GRAYSCALE VALUES)

| | R | G | B |
|---|---|---|---|
| WP | 0.938 | 1.012 | 1.048 |
| R (50% SATURATION) | 3.196 | 0.457 | 0.508 |
| G (50% SATURATION) | 0.342 | 1.221 | 0.498 |
| B (50% SATURATION) | 0.485 | 0.841 | 4.323 |
| C (50% SATURATION) | 0.367 | 1.153 | 1.184 |
| M (50% SATURATION) | 2.070 | 0.616 | 2.093 |
| Y (50% SATURATION) | 1.013 | 1.041 | 0.500 |

Fig. 19C

PANEL CHARACTERISTICS FOR 50% SATURATION
(NORMALIZED TO 8 BITS)

| | R | G | B |
|---|---|---|---|
| WP | 255 | 255 | 255 |
| R (50% SATURATION) | 255 | 108 | 108 |
| G (50% SATURATION) | 164 | 255 | 164 |
| B (50% SATURATION) | 115 | 115 | 255 |
| C (50% SATURATION) | 180 | 250 | 255 |
| M (50% SATURATION) | 241 | 137 | 255 |
| Y (50% SATURATION) | 252 | 255 | 175 |

Fig. 19D

DESIRED VALUES FOR 50% SATURATION
(NORMALIZED TO 8 BITS)

| | R | G | B |
|---|---|---|---|
| WP | 242 | 251 | 255 |
| R (50% SATURATION) | 255 | 105 | 111 |
| G (50% SATURATION) | 143 | 255 | 170 |
| B (50% SATURATION) | 94 | 121 | 255 |
| C (50% SATURATION) | 150 | 252 | 255 |
| M (50% SATURATION) | 254 | 146 | 255 |
| Y (50% SATURATION) | 252 | 255 | 183 |

Fig. 20A

CORRECTION VALUES FOR 50% SATURATION

| | ΔR | ΔG | ΔB |
|---|---|---|---|
| WP | -13 | -4 | 0 |
| R (50% SATURATION) | 0 | -2 | 3 |
| G (50% SATURATION) | -21 | 0 | 5 |
| B (50% SATURATION) | -21 | 6 | 0 |
| C (50% SATURATION) | -30 | 2 | 0 |
| M (50% SATURATION) | 13 | 9 | 0 |
| Y (50% SATURATION) | 0 | 0 | 8 |

Fig. 20B

CORRECTION VALUES FOR RESPECTIVE VERTICES

| | ΔCP_R | ΔCP_G | ΔCP_B |
|---|---|---|---|
| WP | -13 | -4 | 0 |
| R VERTEX | 17 | 0 | 7 |
| G VERTEX | -26 | 2 | 8 |
| B VERTEX | -30 | 19 | 0 |
| C VERTEX | -38 | 5 | 0 |
| M VERTEX | 35 | 20 | 0 |
| Y VERTEX | 5 | 2 | 11 |

Fig. 24A

CORRECTION AMOUNTS FOR RESPECTIVE VERTICES

| | ΔCP_R | ΔCP_G | ΔCP_B |
|---|---|---|---|
| WP | -50 | -16 | 0 |
| R VERTEX | 69 | 0 | 28 |
| G VERTEX | -105 | 9 | 32 |
| B VERTEX | -121 | 75 | 0 |
| C VERTEX | -151 | 19 | 0 |
| M VERTEX | 141 | 79 | 0 |
| Y VERTEX | 20 | 7 | 44 |

Fig. 24B

PANEL BRIGHTNESS CHARACTERISTICS DESIRED VALUES

| INPUT GRAYSCALE VALUES | BRIGHTNESS (lux) | BRIGHTNESS (lux) |
|---|---|---|
| W0 | 0 | 0 |
| W64 | 22 | 19 |
| W127 | 93 | 86 |
| W128 | 94 | 88 |
| W192 | 220 | 214 |
| W255 | 400 | 400 |

Fig. 25A

| $CP_P^{R}, CP_P^{Y}$ | VALUE |
|---|---|
| $CP0_P^{R}, CP0_P^{Y}$ | 0 |
| $CP1_P^{R}, CP1_P^{Y}$ | 0 |
| $CP2_P^{R}, CP2_P^{Y}$ | 508 |
| $CP3_P^{R}, CP3_P^{Y}$ | 215 |
| $CP4_P^{R}, CP4_P^{Y}$ | 508 |
| $CP5_P^{R}, CP5_P^{Y}$ | 1020 |

Fig. 25B

| CP_sel | VALUE |
|---|---|
| CP0_sel | 0 |
| CP1_sel | -16 |
| CP2_sel | 491 |
| CP3_sel | 496 |
| CP4_sel | 486 |
| CP5_sel | 1020 |

Fig. 26

| CP | R | G | B |
|---|---|---|---|
| CP0_k | 0 +13 | 0 −1 | 0 +10 |
| CP1_k | −3 +13 | −3 −1 | −3 +10 |
| CP2_k | 505 +13 | 505 −1 | 505 +10 |
| CP3_k | 508 +13 | 508 −1 | 508 +10 |
| CP4_k | 504 +13 | 504 −1 | 504 +10 |
| CP5_k | 1020+13 | 1020−1 | 1020+10 |

k="R", "G"or"B"

DEVICE AND METHOD FOR COLOR ADJUSTMENT AND GAMMA CORRECTION AND DISPLAY PANEL DRIVER USING THE SAME

CROSS REFERENCE

This application claims priority to Japanese Patent Application No. 2014-153918, filed on Jul. 29, 2014, the disclosure which is incorporated herein by reference.

TECHNICAL FIELD

The present invention relates to a display device, display panel driver, image processing device, and method of driving a display panel, and more particularly to digital arithmetic processing of image data for color adjustment.

BACKGROUND ART

Image data are often subject to digital arithmetic processing to display an image with a desired image quality. One known digital arithmetic processing technology is color adjustment. Image data often include data indicating the grayscale values of respective subpixels (such as red subpixels, green subpixels and blue subpixels) of respective pixels and the colors of the respective pixels in an actual display image can be adjusted by adjusting the grayscale values of the respective subpixels through a color adjustment technology.

One example of a color adjustment technology is color gamut adjustment. A display panel (such as a liquid crystal display panel) may be insufficient in the color reproducibility and this may make it impossible to represent all the colors in a desired color gamut (for example, the color gamut defined in the sRGB standard or the NTSC (National Television System Committee) standard). In such a case, a color adjustment technology helps representing the colors in a color gamut as similar as possible to the desired color gamut.

Although various technologies have been proposed for color adjustment, the inventors find room for improvement in conventional color adjustment technologies with respect to the circuit size reduction, while achieving an appropriate color adjustment. The situation may be severe, especially when color adjustment and different image processing (such as gamma correction) are performed in serial.

Discussed below is an example in which gamma correction is performed on image data obtained by color adjustment, as illustrated in FIG. 1. In order to effectively perform color adjustment, it is desired that the bit width of the output image data obtained by the color adjustment is larger than that of the input image data. This aims to avoid gradation collapse in the color adjustment. In one example, when input image data of color adjustment represent the grayscale value of each of the red, green and blue colors with eight bits, image data which represent the grayscale value of each of the red, green and blue colors with 10 bits may be generated as the output of the color adjustment.

When gamma correction is further performed on the image data obtained as the output of the color adjustment, it is further desired that the bit width of the image data obtained as the output of the gamma correction is further increased. When image data which represent the grayscale value of each of the red, green and blue colors with 10 bits are generated as the output of the color adjustment, for example, image data which represent the grayscale value of each of the red, green and blue colors with 12 bits may be generated as the output of the gamma correction. The increase in the bit widths of the input and output image data of the gamma correction, however, undesirably increases the circuit size of a circuit used for the color adjustment.

SUMMARY OF INVENTION

In an aspect of the present invention, a display device includes: a display panel and a display panel driver driving the display panel. The display panel driver includes: a processing circuit configured to perform digital arithmetic processing on R, G and B grayscale values of input image data to calculate R, G and B grayscale values of output image data, respectively; a driver circuit configured to drive the display panel in response to the output image data; and a control point data generation circuit. The control point data generation circuit is configured to: generate first control point data indicating a shape of a gamma curve of a desired gamma value; calculate R control point data indicating an input-output curve of digital arithmetic processing performed on the R grayscale value of the input image data by correcting the first control point data in response to a position of a corresponding point corresponding to the input image data in a color space; calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space. The processing circuit is configured to: calculate the R grayscale value of the output image data in response to the R control point data, calculate the G grayscale value of the output image data in response to the G control point data, and calculate the B grayscale value of the output image data in response to the B control point data.

In another aspect of the present invention, a display panel driver for driving a display panel includes: a processing circuit configured to perform digital arithmetic processing on R, G and B grayscale values of input image data to calculate R, G and B grayscale values of output image data, respectively; a driver circuit configured to drive the display panel in response to the output image data; and a control point data generation circuit. The control point data generation circuit is configured to: generate first control point data indicating a shape of a gamma curve of a desired gamma value; calculate R control point data indicating an input-output curve of digital arithmetic processing performed on the R grayscale value of the input image data by correcting the first control point data in response to a position of a corresponding point corresponding to the input image data in a color space; calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space. The processing section is configured to: calculate the R grayscale value of the output image data in response to the R control point data, calculate the G grayscale value of the output image data in response to the G control point data, and calculate the B grayscale value of the output image data in response to the B control point data.

In still another aspect of the present invention, an image processing device includes: a processing circuit configured to perform digital arithmetic processing on R, G and B grayscale values of input image data to calculate R, G and B grayscale values of output image data, respectively; a control point data generation circuit. The control point data generation circuit is configured to: generate first control point data indicating a shape of a gamma curve of a desired gamma value; calculate R control point data indicating an input-output curve of digital arithmetic processing performed on the R grayscale value of the input image data by correcting the first control point data in response to a position of a corresponding point corresponding to the input image data in a color space; calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space. The processing section is configured to: calculate the R grayscale value of the output image data in response to the R control point data, calculate the G grayscale value of the output image data in response to the G control point data, and calculate the B grayscale value of the output image data in response to the B control point data.

In still another aspect of the present invention, a method of driving a display panel includes: calculating R, G and B grayscale values of output image data by performing digital arithmetic processing on R, G and B grayscale values of input image data, respectively; and driving the display panel in response to the output image data. The step of calculating the R, G and B grayscale values of the output image data includes: generating first control point data indicating a shape of a gamma curve of a desired gamma value; calculating R control point data indicating an input-output curve of digital arithmetic processing performed on the R grayscale value of the input image data by correcting the first control point data in response to a position of a corresponding point corresponding to the input image data in a color space; calculating G control point data indicating an input-output curve of digital arithmetic processing performed on the G grayscale value of the input image data by correcting the first control point data in response to the position of the corresponding point in the color space; calculating B control point data indicating an input-output curve of digital arithmetic processing performed on the B grayscale value of the input image data by correcting the first control point data in response to the position of the corresponding point in the color space; calculating the R grayscale value of the output image data in response to the R control point data; calculating the G grayscale value of the output image data in response to the G control point data; and calculating the B grayscale value of the output image data in response to the B control point data.

The present invention effectively provides a device and method for achieving digital image processing including color adjustment and gamma correction with a reduced circuit size and a display panel driver and display device using the same.

BRIEF DESCRIPTION OF THE DRAWINGS

The above and other advantages and features of the present invention will be more apparent from the following description taken in conjunction with the accompanied drawings, in which:

FIG. 12B is a table illustrating settings used in one example of calculation of correction amounts ΔCP_R, ΔCP_G and ΔCP_B;

FIG. 15A is a table illustrating an example of the measurement result of panel characteristics;

FIG. 15B is a table illustrating the result of transformation from chromaticity coordinates (u', v') to (x, y) with respect to the measured values of the chromaticity coordinates of the white point (WP) and the R, G, B, C, M and Y vertices illustrated in FIG. 15A;

FIG. 16 is a table illustrating an example of settings of desired values of adjustment;

FIG. 17A is a table illustrating an example of 50%-saturation panel characteristics;

FIG. 17B is a table illustrating an example of 50%-saturation desired values;

FIG. 18A is a table illustrating the result of transformation from chromaticity coordinates (u', v') to (x, y) with respect to the chromaticity coordinates of the white point (WP) and the 50%-saturation panel characteristics values of the respective elementary colors and complementary colors illustrated in FIG. 17A;

FIG. 18B is a table illustrating the result of transformation from chromaticity coordinates (u', v') to (x, y) with respect to desired values of the chromaticity coordinates of the white point and the 50%-saturation desired values of the respective elementary colors and complementary colors illustrated in FIG. 17B;

FIG. 18C is a table illustrating the result of transformation from chromaticity coordinates (x, y) to (X, Y, Z) with respect to the chromaticity coordinates of the white point and the 50%-saturation panel characteristics values of the respective elementary colors and complementary colors illustrated in FIG. 18A;

FIG. 18D is a table illustrating the result of transformation from chromaticity coordinates (x, y) to (X, Y, Z) with respect to desired values of the chromaticity coordinates of the white point and the 50%-saturation desired values of the respective elementary colors and complementary colors illustrated in FIG. 18B;

FIG. 19A is a table illustrating an example of the ratio among R, G and B grayscale values of 50%-saturation panel characteristics values of the respective elementary colors and complementary colors;

FIG. 19B is a table illustrating an example of the ratio among R, G and B grayscale values of 50%-saturation desired values of the respective elementary colors and complementary colors;

FIG. 19C is a table illustrating an example of R, G and B grayscale values of 50%-saturation panel characteristics values of the respective elementary colors and complementary colors;

FIG. 19D is a table illustrating an example of R, G and B grayscale values of 50%-saturation desired values of the respective elementary colors and complementary colors;

FIG. 20A is a table illustrating correction amounts of R, G and B grayscale values obtained for 50% saturation;

FIG. 20B is a table illustrating an example of correction amounts ΔCP_R, ΔCP_G and ΔCP_B obtained for the respective elementary color and complementary colors;

FIG. 24A is a table illustrating an example of settings of correction amounts for the white point and the vertices corresponding to the respective elementary colors and complementary colors in the second embodiment;

FIG. 24B is a table illustrating an example of the relation among the grayscale values of input image data $D_{IN}$, the intrinsic panel characteristics of a liquid crystal display panel (panel brightness characteristics) and desired values of brightness adjustment;

FIG. 25A is a table illustrating an example of the values of control point data CP0_P to CP5_P in digital arithmetic processing in the second embodiment;

FIG. 25B is a table illustrating an example of the values of control point data CP0_sel to CP5_sel in digital arithmetic processing in the second embodiment; and FIG. 26 is a table illustrating an example of the finally-obtained values of control point data CP0_R to CP5_R, CP0_G to CP5_G and CP0_B to CP5_B.

DESCRIPTION OF EMBODIMENTS

Figure 1:
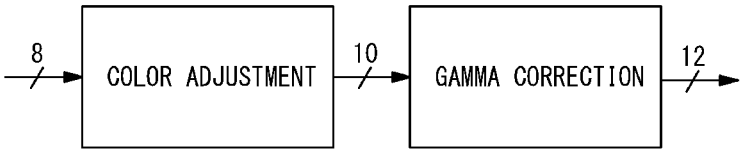
FIG. 1 is an exemplary configuration of an image processing circuit performing color adjustment and gamma correction in serial.

Embodiments of the present invention provide a device and method for digital image processing including color adjustment and gamma correction with a reduced circuit size and a display panel driver and display device using the same. Other aspects of the present invention would be understood by a person skilled in the art from the following disclosure.

The invention will be now described herein with reference to illustrative embodiments. Those skilled in the art would recognize that many alternative embodiments can be accomplished using the teachings of the present invention and that the invention is not limited to the embodiments illustrated for explanatory purposed. It should be noted that the same or similar components may be denoted by the same or corresponding reference numerals.

Figure 2:
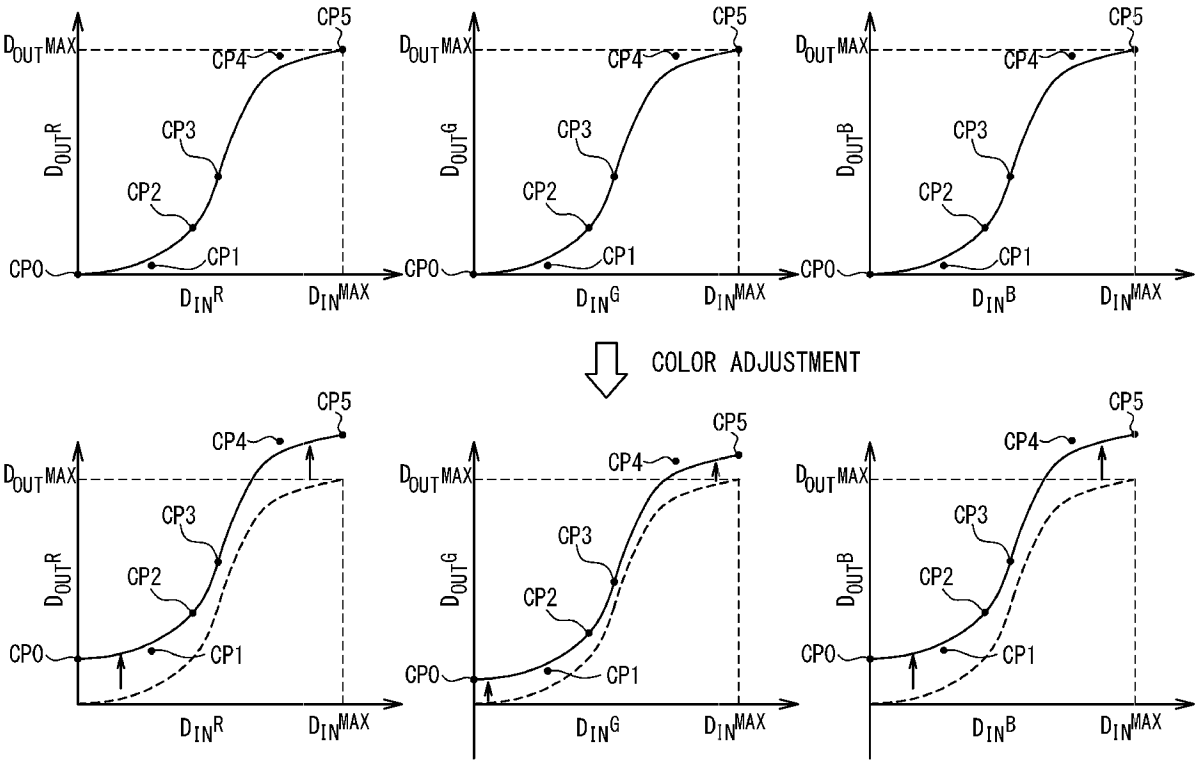
FIG. 2 is a conceptual diagram illustrating gamma correction and color adjustment performed on input image data in one embodiment of the present invention.
Figure 3A:
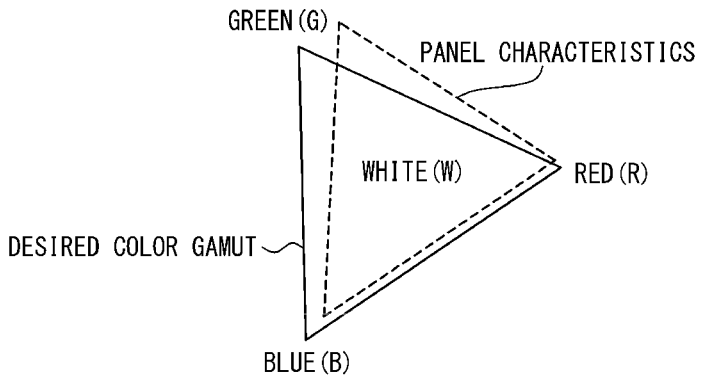
FIG. 3A illustrates an example of a desired color gamut and intrinsic color gamut of a liquid crystal display panel for which color adjustment is to be performed.
Figure 3B:
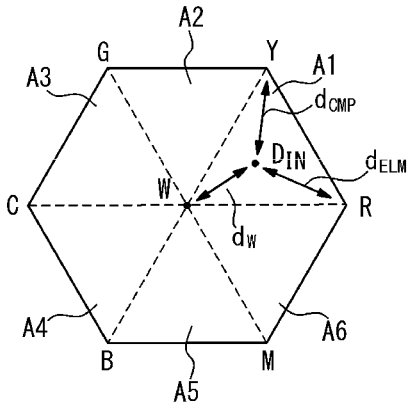
FIG. 3B illustrates an example of the positions of the white point, the vertices corresponding to three elementary colors and the vertices corresponding to the complementary colors of the three elementary colors.

FIGS. 2, 3A and 3B schematically illustrate color adjustment processing performed in one embodiment of the present invention. In the present embodiment, as illustrated in FIG. 2, gamma correction and color adjustment are performed on input image data $D_{IN}$ through digital arithmetic processing to generate gamma-corrected and color-adjusted output image data $D_{OUT}$.

In the present embodiment, output image data $D_{OUT}$ are calculated by performing arithmetic processing on input image data $D_{IN}$ in accordance with given arithmetic expressions. In detail, the R grayscale value $D_{OUT}^{R}$ of output image data $D_{OUT}$ is calculated by using an arithmetic expression in which the R grayscale value $D_{IN}^{R}$ of input image data $D_{IN}$ is defined as a variable. Correspondingly, the G grayscale value $D_{OUT}^{G}$ of output image data $D_{OUT}$ is calculated by using an arithmetic expression in which the G grayscale value $D_{IN}^{G}$ of input image data $D_{IN}$ is defined as a variable, and the B grayscale value $D_{OUT}^{B}$ of output image data $D_{OUT}$ is calculated by using an arithmetic expression in which the B grayscale value $D_{IN}^{B}$ of input image data $D_{IN}$ is defined as a variable.

The upper row of FIG. 2 illustrates curves indicating the input-output relations of the digital arithmetic processing achieved by the arithmetic expressions (that is, the relation between the values of input image data $D_{IN}$ and the values of output image data $D_{OUT}$). In the following, a curve indicating an input-output relation may be referred to as "input-output curve". An input-output curve is specified for each of the R, G and B grayscale values.

In the present embodiment, the shapes of the input-output curves are specified by the positions of control points (CPs) and the coefficients defined in the arithmetic expressions used for calculating the output image data $D_{OUT}$ are determined depending on the positions of the control points to allow the input-output curves to be shaped as desired. More specifically, the shape of each input-output curve is specified with the positions of six control points CP0 to CP5 in the present embodiment. The positions of the ends of the input-output curve are specified with the control points CP0 and CP5, respectively, and the shape of the intermediate portion of the input-output curve is specified with the control points CP1 to CP4. The control points CP2 and CP3 specify the two positions that the input-output curve passes through near the midpoint of the input-output curve. The control point CP1 indicates the degree of curvature in the portion between the control points CP0 and CP2 and the control point CP4 indicates the degree of curvature in the portion between the control points CP3 and CP5. It should be noted that, in the example illustrated in FIG. 2, the control points CP1 and CP4 are not defined at positions that the input-output curve passes through. The control points CP0 to CP5 are each defined as a point in a coordinate system in which the first coordinate axis corresponds to the grayscale values (which may be any of the R, G and B grayscale values) of input image data $D_{IN}$ and the second coordinate axis corresponds to the grayscale values of output image data $D_{OUT}$. It should be noted however that the number and/or definition of the control points may be variously modified.

Additionally, as illustrated in the lower row of FIG. 2, gamma correction and color adjustment are concurrently achieved by controlling the shapes of the input-output curves of the respective colors in the present invention. More specifically, the shapes of the input-output curves, that is, the positions of the control points CP0 to CP5 are first determined to make the input-output curves approximate to the gamma curves of desired gamma values. Furthermore, color adjustment is achieved by correcting (adjusting) the shapes of the input-output curves, that is, the positions of the control points CP0 to CP5 individually for the respective colors.

The color adjustment is performed so that a desired color gamut is achieved in a targeted display panel (in the present embodiment, a liquid crystal display panel). FIG. 3A illustrates a desired color gamut and the intrinsic color gamut of a display panel for which color adjustment is to be performed. Even when the desired color gamut and the intrinsic color gamut of a display panel is different, it is possible to make the color gamut of an actually displayed image approximate to a desired color gamut through color adjustment in a pseudo manner.

Schematically, such color adjustment can be achieved as described below. First, appropriate correction amounts of control points CP0 to CP5 are calculated for the white point, the vertices corresponding to the respective elementary colors and the vertices corresponding to the complementary colors. FIG. 3B illustrates an example of the positions of the white point (W), the vertices corresponding to the three elementary colors and the vertices corresponding to the complementary colors of the three elementary colors in the color space. It should be noted that, in the present embodiment, the three elementary colors are defined as R (red), G (green) and B (blue) and the complementary colors of the three elementary colors are defined as C (cyan), M (magenta) and Y (yellow). The vertex of a certain elementary color means the point at which the saturation of the elementary color is maximum (the point at which the saturation is 100%) in the color space. Correspondingly, the vertex of a certain complementary color means the point at which the saturation of the complementary color is maximum (the point at which the saturation is 100%) in the color space. In the following, the vertices corresponding to the elementary color R, G and B are referred to as R, G and B vertices, respectively, and the vertices corresponding to the complementary color C, M and Y are referred to as C, M and Y vertices, respectively.

It should be noted that appropriate correction amounts of control points CP0 to CP5 suitable for the write point, the vertices corresponding to the respective elementary colors and the respective complementary colors are parameters to be determined on the characteristics of the display panel. It is possible to calculate approximate correction amounts for the write point, the vertices corresponding to the respective elementary colors and the complementary color, respectively, from measured values of the characteristics of the display panel, and the calculated correction amounts are stored in a proper storage means (such as a register). Details will be described later.

The correction amounts of control points CP0 to CP5 for each pixel are determined the position of the point corresponding to the input image data $D_{IN}$ in the color space. In the following, the point corresponding to the input image data $D_{IN}$ in the color space may be referred to as "corresponding point", hereinafter.

More specifically, in the present embodiment, six areas A1 to A6 are defined in the color space with the write point, the vertices corresponding to the three elementary colors and the vertices corresponding to the three complementary colors as follows:

Area A1: the triangular area defined by the R vertex, the Y vertex and the white point Area A2: the triangular area defined by the Y vertex, the G vertex and the white point Area A3: the triangular area defined by the G vertex, the C vertex and the white point Area A4: the triangular area defined by the C vertex, the B vertex and the white point Area A5: the triangular area defined by the B vertex, the M vertex and the white point Area A6: the triangular area defined by the M vertex, the R vertex and the white point It should be noted that the areas A1 to A6 are each defined with the write point, a vertex corresponding to one elementary color and a vertex corresponding to one complementary color.

In the color adjustment of the present embodiment, for input image data $D_{IN}$ corresponding to a certain pixel, it is determined which of the six areas A1 to A6 the corresponding point of the input image data $D_{IN}$ belongs to in the color space. Furthermore, the following three "distances" are calculated for the area which the corresponding point of the input image data $D_{IN}$ is determined as belonging to (which may be referred to as "belonging area", hereinafter):

(1) Distance $d_{ELM}$ between the vertex corresponding to the elementary color by which the belonging area is defined and the corresponding point of the input image data $D_{IN}$;

(2) Distance $d_{CMP}$ between the vertex corresponding to the complementary color by which the belonging area is defined and the corresponding point of the input image data $D_{IN}$; and (3) Distance $d_W$ between the white point and the corresponding point of the input image data $D_{IN}$.

In the present embodiment, the correction amounts of control points CP0 to CP5 are calculated for input image data $D_{IN}$ corresponding to each pixel on the basis of: the correction amounts determined for the elementary color which defines the belonging area; the correction amounts determined for the complementary color which defines the belonging area; the correction amounts determined for the white point; and the three calculated distances $d_{ELM}$, $d_{CMP}$ and $d_W$. The color adjustment is achieved by performing digital arithmetic processing on the input image data $D_{IN}$ in accordance with the input-output curves with the shapes determined by the control points CP0 to CP5 corrected with the calculated correction amounts. It should be noted that any parameters defined to indicate the degree of separation of two points in the color space may be used as the "distance". Specific examples of the "distance" will be described later.

The above-described method allows performing digital arithmetic processing including gamma correction and color adjustment with a reduced circuit size, because the gamma correction and color adjustment are concurrently performed. Described in the following are specific configurations and operations of a display device, a display panel driver and an image processing circuit for performing the above-described color adjustment.

First Embodiment

Figure 4:
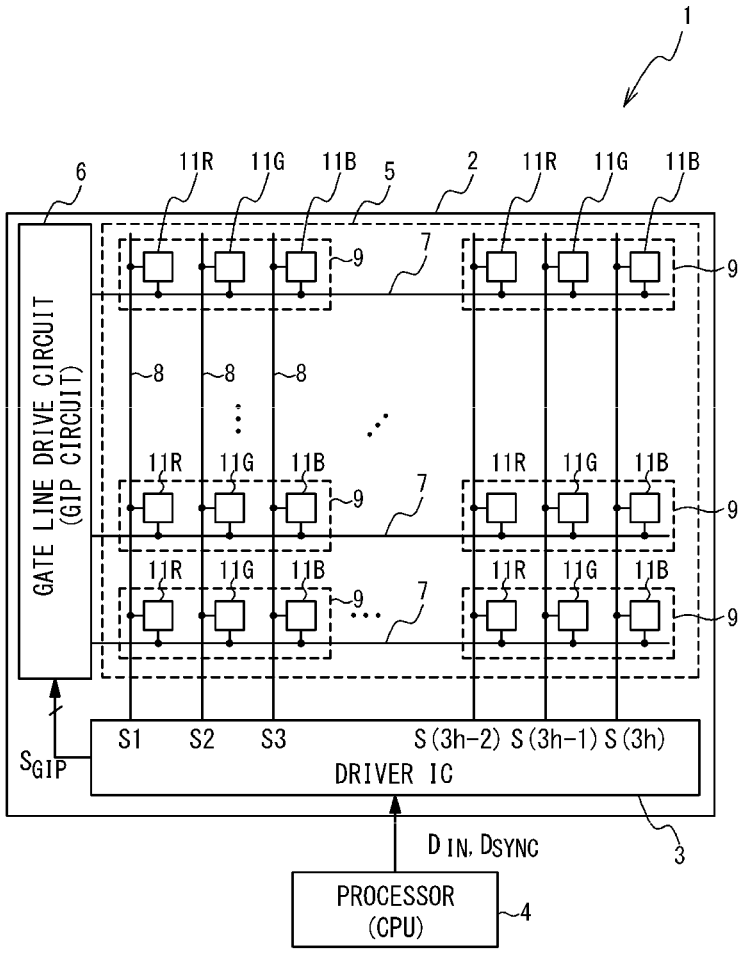
FIG. 4 is a block diagram illustrating an exemplary configuration of a display device in a first embodiment of the present invention.

FIG. 4 is a block diagram illustrating an exemplary configuration of a display device in a first embodiment of the present invention. The display device of the present embodiment is configured as a liquid crystal display device 1 which includes a liquid crystal display panel 2 and a driver IC (integrated circuit) 3.

The liquid crystal display panel 2 includes a display region 5 and a gate line drive circuit 6 (also referred to as GIP (gate-in-panel) circuit). Arranged in the display region 5 are a plurality of gate lines (also referred to as scan lines or address lines), a plurality of data lines 8 (also referred to as signal lines or source lines) and a plurality of pixels 9. In the present embodiment, the number of the gate lines 7 is v and the number of the data lines 8 is 3 h, where v and h are each an integer equal to or more than two. The pixels 9 are arranged in v rows and h columns in the display region 5, where v and h are integers equal to or more than two.

In the present embodiment, each pixel 9 includes three subpixels: an R subpixel 11R, a G subpixel 11G and a B subpixel 11B. The R subpixel 11R is a subpixel corresponding to the red color (that is, displaying the red color), the G subpixel 11G is a subpixel corresponding to the green color (that is, displaying the green color), and the B subpixel 11B is a subpixel corresponding to the blue color (that is, displaying the blue color). The R, G and B subpixels 11R, 11G and 11B may be collectively referred to as subpixels 11, if not distinguished from one another. In the present embodiment, the subpixels 11 are arrayed in v rows and 3 h columns in the liquid crystal display panel 2. Each subpixel 11 is connected to a corresponding gate line 7 and a corresponding data line 8. In driving the respective subpixels 11 of the liquid crystal display panel 2, the gate lines 7 are sequentially selected and desired drive voltages are written into the subpixels 11 connected to the selected gate line 7 through the data lines 8. This allows setting the respective subpixels 11 to desired grayscale levels and displaying a desired image in the display region 5 of the liquid crystal display panel 2.

Figure 5:
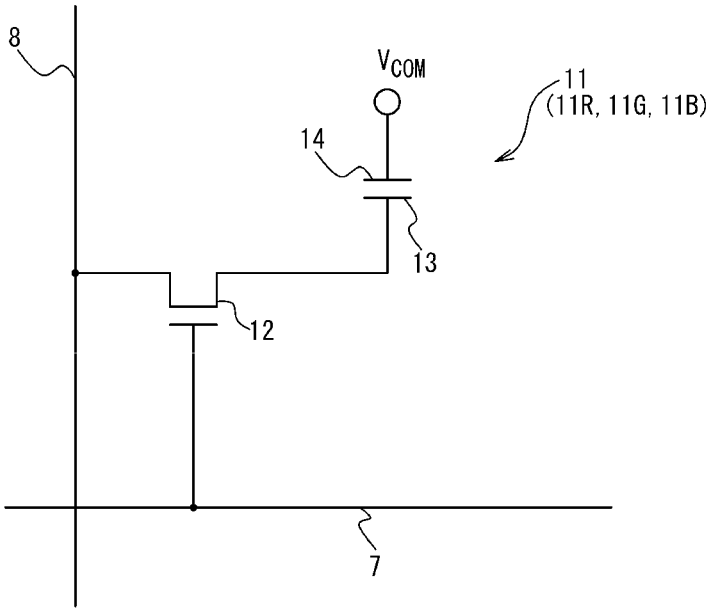
FIG. 5 is a circuit diagram conceptually illustrating the configuration of each subpixel.

FIG. 5 is a circuit diagram conceptually illustrating the configuration of each subpixel 11. Each subpixel 11 includes a TFT (thin film transistor) 12 and a pixel electrode 13. The TFT 12 has a gate connected to a gate line 7, a source connected to a data line 8 and a drain connected to the pixel electrode 13. The pixel electrode 13 is disposed opposed to the counter electrode (also referred to as common electrode) 14 of the liquid crystal display panel 2 and Liquid crystal is filled between the pixel electrode 13 and the counter electrode 14. It should be noted that, although the counter electrode 14 is illustrated as being prepared for each subpixel 11 in FIG. 5, a person skilled in the art would appreciate that one counter electrode is shared by a plurality of subpixels 11 (in a typical configuration, one common counter electrode 14 is disposed in the liquid crystal display panel 2).

Referring back to FIG. 4, the driver IC 3 drives the data lines 8 and also generates gate line control signals $S_{GIp}$ which control the gate line drive circuit 6. The data lines 8 are driven in response to input image data $D_{IN}$ and synchronization data $D_{SYNC}$, which are received from the processor 4. The input image data $D_{IN}$ are data corresponding to an image to be displayed in the display region 5 of the liquid crystal display panel 2. More specifically, the input image data $D_{IN}$ are data specifying the grayscale level of each subpixel 11 of each pixel 9. As described above, the input image data $D_{IN}$ include an R grayscale value $D_{IN}^R$, a G grayscale value $D_{IN}^G$ and a B grayscale value $D_{IN}^B$. The grayscale level of the R subpixel 11R is specified by the R grayscale value $D_{IN}^R$, the grayscale level of the G subpixel 11G is specified by the G grayscale value $D_{IN}^G$, and the grayscale level of the B subpixel 11B is specified by the B grayscale value $D_{IN}^B$. In the present embodiment, the R, G and B grayscale values $D_{IN}^R$, $D_{IN}^G$ and $D_{IN}^B$ are all 8-bit data. In other words, the input image data $D_{IN}$ are data indicating the grayscale levels of the respective subpixels of each pixel 9 of the liquid crystal display panel 2 with 24 bits. The synchronization data $D_{SYNC}$, which are used to control the operation timing of the driver IC 3, control the generation timing of timing control signals generated in the driver IC 3, including the vertical sync signal $V_{SYNC}$, the horizontal sync signal $H_{SYNC}$ and so on. The gate line control signals $S_{GIP}$ are generated in response to the synchronization data $D_{SYNC}$. The driver IC 3 is mounted on the liquid crystal display panel 2 with a surface mounting technology such as a COG (chip-on-glass) technology.

Figure 6:
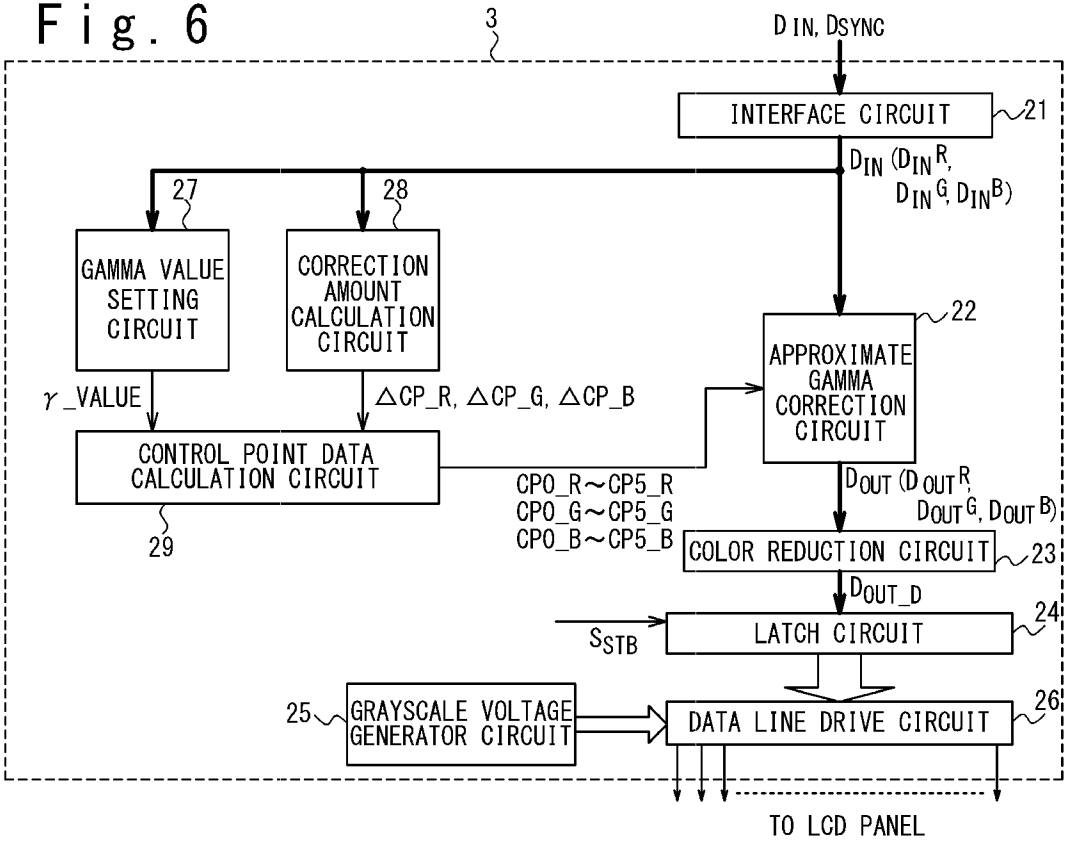
FIG. 6 is a block diagram illustrating an example of the configuration of a driver IC in the first embodiment of the present invention.

FIG. 6 is a block diagram illustrating an exemplary configuration of the driver IC 3. The driver IC 3 includes an interface circuit 21, an approximate gamma correction circuit 22, a color reduction circuit 23, a latch circuit 24, a grayscale voltage generator circuit 25, a data line drive circuit 26, a gamma value setting circuit 27, a correction amount calculation circuit 28 and a control point data calculation circuit 29.

The interface circuit 21 receives the input image data $D_{IN}$ from the processor 4 and forwards the received input image data $D_{IN}$ to the approximate gamma correction circuit 22.

The approximate gamma correction circuit 22 performs the above-described digital arithmetic processing for color adjustment and gamma correction. The approximate gamma correction circuit 22 performs the digital arithmetic processing on the input image data $D_{IN}$ to generate output image data $D_{OUT}$. The output image data $D_{OUT}$, which specify the grayscale level of each subpixel 11 of each pixel 9 similarly to the input image data $D_{IN}$, include an R grayscale value $D_{OUT}^R$, a G grayscale value $D_{OUT}^G$ and a B grayscale value $D_{OUT}^B$.

Figure 7:
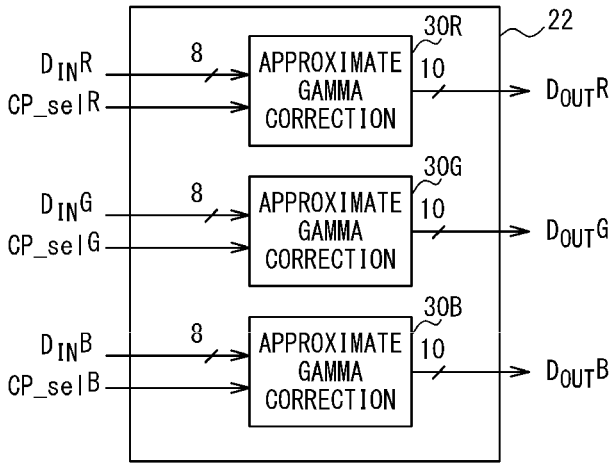
FIG. 7 is a block diagram illustrating an example of the configuration of an approximate gamma correction circuit.

FIG. 7 is a block diagram illustrating an exemplary configuration of the approximate gamma correction circuit 22. The approximate gamma correction circuit 22 includes approximate gamma correction circuits 30R, 30G and 30B, which are prepared to process the R grayscale value $D_{IN}^R$, the G grayscale value $D_{IN}^G$ and the B grayscale value $D_{IN}^B$ of the input image data $D_{IN}$, respectively. The approximate gamma correction circuit 30R performs correction processing on the R grayscale value $D_{IN}^R$ of the input image data $D_{IN}$ in accordance with an arithmetic expression to generate the R grayscale value $D_{OUT}^R$ of the output image data $D_{OUT}$.

Figure 8:
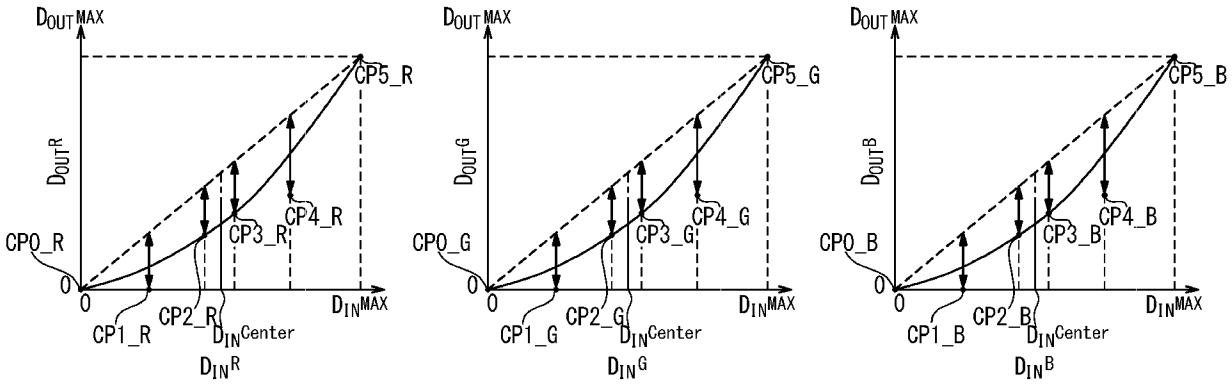
FIG. 8 is a graph illustrating the relation between control point data and the shape of an input-output curve of arithmetic processing performed on the R, G and B grayscale values $D_{IN}^{R}$, $D_{IN}^{G}$ and $D_{IN}^{B}$ of input image data $D_{IN}$.

As illustrated in FIG. 7, the approximate gamma correction circuit 30R is supplied with control point data CP0_R to CP5_R. As illustrated in FIG. 8, the control point data CP0_R to CP5_R specify the shape of the input-output curve of the arithmetic processing performed on the R grayscale value $D_{IN}^R$ of the input image data $D_{IN}$, and indicate the positions of the control points CP0 to CP5 that specify the shape of the input-output curve. The coefficients of the arithmetic expression used by the approximate gamma correction circuit 30R for the arithmetic processing are determined from the control point data CP0_R to CP5_R and this allows performing digital arithmetic processing on the R grayscale value $D_{IN}^R$ in accordance with the input-output curve with the desired shape. In the following, the control point data CP0_R to CP5_R may be collectively referred to as correction point data set CP_R.

Correspondingly, the approximate gamma correction circuits 30G and 30B perform correction processing on the G grayscale value $D_{IN}^G$ and B grayscale value $D_{IN}^B$ of the input image data $D_{IN}$ in accordance with arithmetic expressions to generate the G grayscale value $D_{OUT}^G$ and B grayscale value $D_{OUT}^B$ of the output image data $D_{OUT}$. As illustrated in FIG. 7, the approximate gamma correction circuit 30G is supplied with control point data CP0_G to CP5_G, and the approximate gamma correction circuit 30B is supplied with control point data CP0_B to CP5_B. As illustrated in FIG. 8, the control point data CP0_G to CP5_G specify the shape of the input-output curve of the arithmetic processing performed on the G grayscale value $D_{IN}^G$ of the input image data $D_{IN}$, and indicate the positions of the control points CP0 to CP5 that specify the shape of the input-output curve. Correspondingly, the control point data CP0_B to CP5_B specify the shape of the input-output curve of the arithmetic processing performed on the B grayscale value $D_{IN}^B$ of the input image data $D_{IN}$, and indicate the positions of the control points CP0 to CP5 that specify the shape of the input-output curve. The coefficients of the arithmetic expression used by the approximate gamma correction circuit 30G for the arithmetic processing are determined from the control point data CP0_G to CP5_G and this allows performing digital arithmetic processing on the G grayscale value $D_{IN}^G$ in accordance with the input-output curve with the desired shape. Correspondingly, the coefficients of the arithmetic expression used by the approximate gamma correction circuit 30B for the arithmetic processing are determined from the control point data CP0_B to CP5_B and this allows performing digital arithmetic processing on the B grayscale value $D_{IN}^B$ in accordance with the input-output curve with the desired shape. In the following, the control point data CP0_G to CP5_G may be collectively referred to as correction point data set CP_G, and the control point data CP0_B to CP5_B may be collectively referred to as correction point data set CP_B.

The number of bits of the R grayscale value $D_{OUT}^R$, G grayscale value $D_{OUT}^G$ and B grayscale value $D_{OUT}^B$ of the output image data $D_{OUT}$ is larger than that of the R grayscale value $D_{IN}^R$, G grayscale value $D_{IN}^G$ and B grayscale value $D_{IN}^B$ of the input image data $D_{IN}$. This effectively avoids loss of grayscale level information of each pixel in the digital arithmetic processing for the color adjustment and gamma correction. In the present embodiment, the R grayscale value $D_{IN}^R$, G grayscale value $D_{IN}^G$ and B grayscale value $D_{IN}^B$ of the input image data $D_{IN}$ are each 8-bit data and the R grayscale value $D_{OUT}^R$, G grayscale value $D_{OUT}^G$ and B grayscale value $D_{OUT}^B$ of the output image data $D_{OUT}$ are each 10-bit data.

The color reduction circuit 23, the latch circuit 24, the grayscale voltage generator circuit 25 and the data line drive circuit 26 function as drive circuitry that drives the data lines 8 of the display region 5 of the liquid crystal display panel 2 in response to the output image data $D_{OUT}$ received from the approximate gamma correction circuit 22. More specifically, the color reduction circuit 23 performs color reduction on the output image data $D_{OUT}$ generated by the approximate gamma correction circuit 22 to generate color-reduced image data $D_{OUT_D}$. The color-reduced image data $D_{OUT_D}$ are generated to represent the grayscale level of each subpixel 11 of each pixel 9 with eight bits. The latch circuit 24 latches the color-reduced image data $D_{OUT_D}$ from the color reduction circuit 23 in response to a latch signal $S_{STB}$ received from a timing control circuit (not illustrated) and forwards the latched color-reduced image data $D_{OUT_D}$ to the data line drive circuit 26. The grayscale voltage generator circuit 25 feeds a set of grayscale voltages to the data line drive circuit 26. In the present embodiment, in which the color-reduced image data $D_{OUT_D}$ represent the grayscale level of each subpixel 11 of each pixel 9 with eight bits, the number of grayscale voltages fed from the grayscale voltage generator circuit 25 is 256 ($=2^8$). The data line drive circuit 26 drives the data lines 8 of the display region 5 of the liquid crystal display panel 2 in response to the color-reduced image data $D_{OUT_D}$ received from the latch circuit 24. In detail, the data line drive circuit 26 selects desired grayscale voltages from among the grayscale voltages received from the grayscale voltage generator circuit 25 in response to the color-reduced image data $D_{OUT_D}$ and drives the corresponding data lines 8 of the liquid crystal display panel 2 to the selected grayscale voltages.

The gamma value setting circuit 27, the correction amount calculation circuit 28 and the control point data calculation circuit 29 operate as control point data generation circuitry that calculates the control point data CP0_R to CP5_R, CP0_G to CP5_G and CP0_B to CP5_B and feeds the control point data CP0_R to CP5_R, CP0_G to CP5_G and CP0_B to CP5_B to the approximate gamma correction circuit 22. More specifically, the gamma value setting circuit 27 determines the gamma value γ_VALUE of the gamma correction to be performed in the approximate gamma correction circuit 22 and sends the determined gamma value γ_VALUE to the control point data calculation circuit 29. In the present embodiment, the gamma value γ_VALUE is determined on the basis of the APL (average picture level) of each frame image (the image displayed in the display region 5 of the liquid crystal display panel 2 in each frame period). The APL of each frame image is calculated from the input image data $D_{IN}$. In the present embodiment, the gamma value γ_VALUE is commonly used for processing of R grayscale value $D_{IN}^R$, G grayscale value $D_{IN}^G$ and B grayscale value $D_{IN}^B$ of the input image data $D_{IN}$.

It should be noted that the gamma value γ_VALUE may be determined on the basis of parameters other than the APL of the each frame image. It should be also noted that it is not necessary to determine the gamma value γ_VALUE in each frame period; the gamma value γ_VALUE may be fixed to a predetermined value. In this case, the gamma value γ_VALUE may be preset to a register prepared in the gamma value setting circuit 27. When the gamma value γ_VALUE is preset to a register, it is preferable that the register, which holds the gamma value γ_VALUE, is rewritable from the outside of the driver IC 3.

The correction amount calculation circuit 28 calculates correction amounts ΔCP_R of the control point data CP0_R to CP5_R, correction amounts ΔCP_G of the control point data CP0_G to CP5_G, and correction amounts ΔCP_B of the control point data CP0_B to CP5_B. In detail, the correction amount calculation circuit 28 selects the belonging area which the point corresponding to the input image data $D_{IN}$ (the corresponding point) belongs to in the color space, from among the above-described areas A1 to A6 (refer to FIG. 3B) and calculates the three distances $d_{ELM}$, $d_{CMP}$ and $d_W$, where: $d_{ELM}$ is the distance between the vertex corresponding to the elementary color that defines the belonging area and the corresponding point of the input image data $D_{IN}$; $d_{CMP}$ is the distance between the vertex corresponding to the complementary color that defines the belonging area and the corresponding point of the input image data $D_{IN}$; and $d_W$ is the distance between the white point and the corresponding point of the input image data $D_{IN}$. The correction amount calculation circuit 28 calculates the correction amounts ΔCP_R, ΔCP_G and ΔCP_B in response to the distances $d_{ELM}$, $d_{CMP}$ and $d_W$. The configuration and operation of the correction amount calculation circuit 28 will be described later in detail.

The control point data calculation circuit 29 calculates the control point data CP0_R to CP5_R, CP0_G to CP5_G and CP0_B to CP5_B, which are fed to the approximate gamma correction circuit 22, on the basis of the gamma value γ_VALUE received from the gamma value setting circuit 27 and the correction amounts ΔCP_R, ΔCP_G and ΔCP_B received from the correction amount calculation circuit 28. As described later, the control point data calculation circuit 29 calculates the control point data CP0_R to CP5_R, CP0_G to CP5_G and CP0_B to CP5_B by calculating the control point data that specify the shape of the gamma curve in accordance with the gamma value γ_VALUE and modifying the control point data on the basis of the correction amounts ΔCP_R, ΔCP_G and ΔCP_B received from the correction amount calculation circuit 28.

Figure 9:
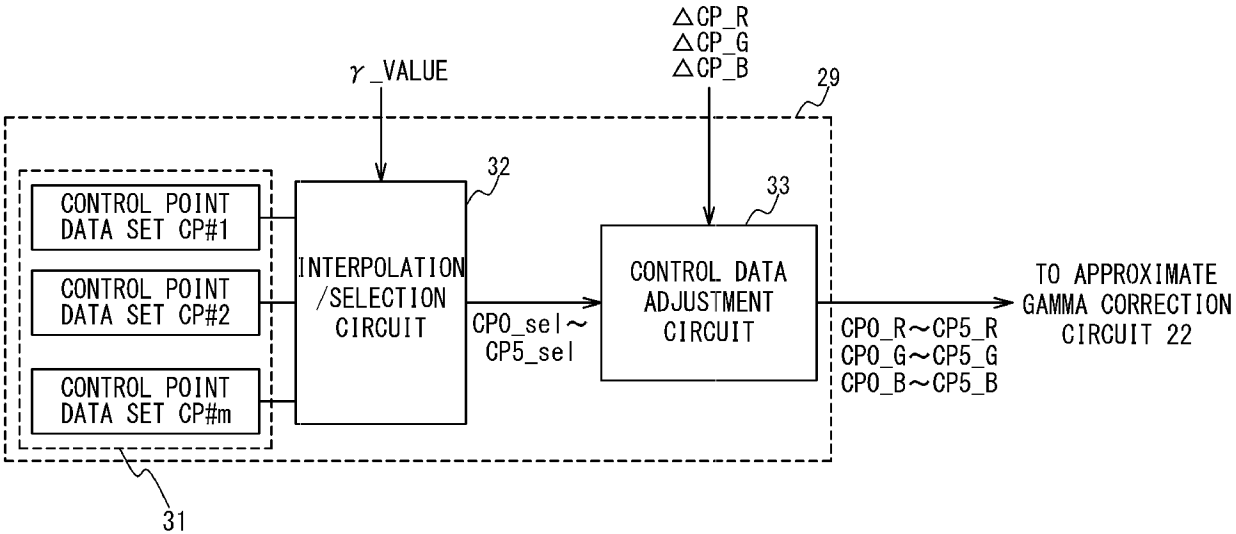
FIG. 9 is a block diagram illustrating an example of the configuration of a control point data calculation circuit in the first embodiment.

Next, a description is given in detail of the configurations of the control point data calculation circuit 29 and the correction amount calculation circuit 28. FIG. 9 is a block diagram illustrating a preferred example of the configuration of the control point data calculation circuit 29. In the example illustrated in FIG. 9, the control point data calculation circuit 29 includes a control point data set storage register 31, an interpolation/selection circuit 32 and a control point data adjustment circuit 33.

The control point data set storage register 31 stores therein a plurality of control point data sets CP#1 to CP#m. The control point data sets CP#1 to CP#m are used as initial data used for determining the above-described control point data set CP_R, CP_G and CP_B. The control point data sets CP#1 to CP#m respectively correspond to different gamma values γ, and each control point data set CP#j (j is an integer from one to m) includes control point data CP0#*j* to CP5#*j*.

The interpolation/selection circuit 32 determines a control point data set CP_sel corresponding to the gamma value γ_VALUE received from the gamma value setting circuit 27. The control point data set CP_sel includes control point data CP0_sel to CP5_sel. In one embodiment, the interpolation/selection circuit 32 may determine the control point data set CP_sel by selecting the control point data set CP_sel from among the control point data sets CP#1 to CP#m in response to the gamma value γ_VALUE. Alternatively, the interpolation/selection circuit 32 may determine the control point data set CP_sel by selecting two of the control point data sets CP#1 to CP#m in response to the gamma value γ_VALUE and performing an interpolation on the selected two control point data sets. Details of the determination of the control point data set CP_sel will be described later. The control point data set CP_sel determined by the interpolation/selection circuit 32 is transmitted to the control point data adjustment circuit 33.

The control point data adjustment circuit 33 calculates the control point data CP0_R to CP5_R, CP0_G to CP5_G and CP0_B to CP5_B, which are to be fed to the approximate gamma correction circuit 22, by modifying the control point data CP0_sel to CP5_sel in response to the correction amounts ΔCP_R, ΔCP_G and ΔCP_B received from the correction amount calculation circuit 28. As described above, the approximate gamma correction unit 30R of the approximate gamma correction circuit 22 performs arithmetic processing on the R grayscale value $D_{IN}^R$ of the input image data $D_{IN}$ in accordance with the input-output curve specified by the control point data CP0_R to CP5_R. Correspondingly, the approximate gamma correction circuit 30G performs arithmetic processing on the G grayscale value $D_{IN}^G$ of the input image data $D_{IN}$ in accordance with the input-output curve specified by the control point data CP0_G to CP5_G and the approximate gamma correction circuit 30B performs arithmetic processing on the B grayscale value $D_{IN}^B$ of the input image data $D_{IN}$ in accordance with the input-output curve specified by the control point data CP0_B to CP5_B.

Figure 10:
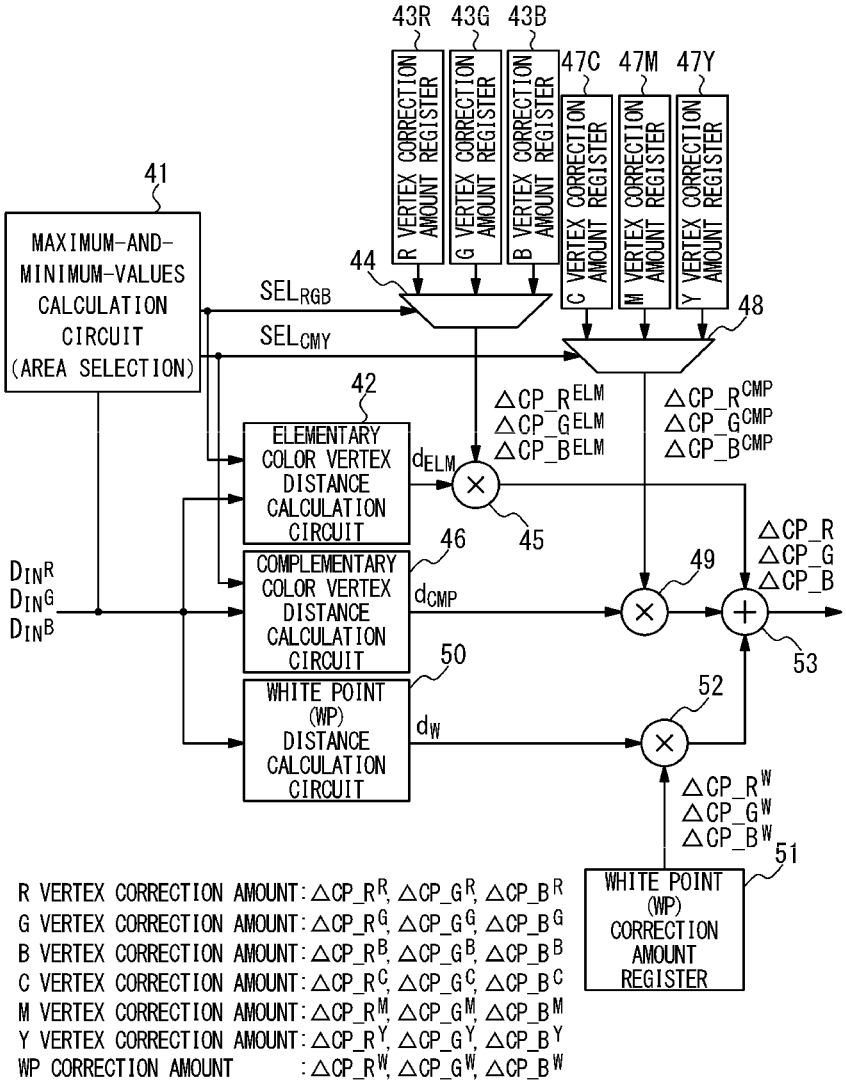
FIG. 10 is a block diagram illustrating an example of a correction amount calculation circuit in the first embodiment.

FIG. 10 is a block diagram illustrating a preferred example of the configuration of the correction amount calculation circuit 28. The correction amount calculation circuit 28 includes: a maximum-and-minimum values calculation circuit 41, an elementary color vertex distance calculation circuit 42, an R vertex correction amount register 43R, a G vertex correction amount register 43G, a B vertex correction amount register 43B, a selector 44, a multiplier 45, a complementary color vertex distance calculation circuit 46, a C vertex correction amount register 47C, an M vertex correction amount register 47M, a Y vertex correction amount register 47Y, a selector 48, a multiplier 49, a white point distance calculation circuit 50, a white point correction amount register 51, a multiplier 52 and an adder 53.

The maximum-and-minimum values calculation circuit 41 finds which of the R, G and B grayscale values $D_{IN}^R$, $D_{IN}^G$ and $D_{IN}^B$ of the input image data $D_{IN}$ are maximum and minimum for each pixel. This operation is equivalent to determining which of the areas A1 to A6 illustrated in FIG. 3B the corresponding point of the input image data $D_{IN}$ belongs to in the color space. This is because the belonging area of the corresponding point of the input image data $D_{IN}$ can be determined as the area defined with the white point, the vertex of the elementary color corresponding to the largest one of the R, G and B grayscale values $D_{IN}^R$, $D_{IN}^G$ and $D_{IN}^B$ and the vertex of the complementary color of the elementary color corresponding to the smallest one of the R, G and B grayscale values $D_{IN}^R$, $D_{IN}^G$ and $D_{IN}^B$. When the R grayscale value $D_{IN}^R$ is the largest and the B grayscale value $D_{IN}^B$ is the smallest, for example, the belonging area of the corresponding point of the input image data $D_{IN}$ can be determined as the area A1 (that is, the area defined with the R vertex, the Y vertex and the while point); it should be noted here that Y (yellow) is the complementary color of B (blue). The maximum-and-minimum values calculation circuit 41 generates a selection signal $SEL_{RGB}$ selecting one of R, G and B on the basis of which of the R, G and B grayscale values $D_{IN}^R$, $D_{IN}^G$ and $D_{IN}^B$ is maximum and further generates a selection signal $SEL_{CMY}$ selecting one of C, M and Y on the basis of which of the R, G and B grayscale values $D_{IN}^R$, $D_{IN}^G$ and $D_{IN}^B$ is minimum. The selection signal $SEL_{RGB}$ is generated to select the elementary color corresponding to the largest one of the R, G and B grayscale values $D_{IN}^R$, $D_{IN}^G$ and $D_{IN}^B$ and the selection signal $SEL_{CMY}$ is generated to select the complementary color of the elementary color corresponding to the smallest one of the R, G and B grayscale values $D_{IN}^R$, $D_{IN}^G$ and $D_{IN}^B$.

The elementary color selected by the maximum-and-minimum values calculation circuit 41 may be referred to as "selected elementary color" and the vertex corresponding to the selected elementary color may be referred to as "selected elementary color vertex". Correspondingly, the complementary color selected by the maximum-and-minimum values calculation circuit 41 may be referred to as "selected complementary color" and the vertex corresponding to the selected complementary color may be referred to as "selected complementary color vertex".

The elementary color vertex distance calculation circuit 42 calculates the distance $d_{ELM}$ between the selected elementary color vertex (the vertex corresponding to the selected elementary color selected by the selection signal $SEL_{RGB}$) and the corresponding point of the input image data $D_{IN}$. Any parameters determined to indicate the degree of separation between the vertex corresponding to the elementary color selected by the selection signal $SEL_{RGB}$ and the corresponding point of the input image data $D_{IN}$ in the color space may be used as the distance $d_{ELM}$. A specific example of the definition of the distance $d_{ELM}$ will be described later.

The R vertex correction amount register 43R stores therein R vertex correction amounts $\Delta CP_R^R$, $\Delta CP_G^R$ and $\Delta CP_B^R$. The R vertex correction amounts $\Delta CP_R^R$, $\Delta CP_G^R$ and $\Delta CP_B^R$ are values that are appropriate as the correction amounts ΔCP_R, ΔCP_G and ΔCP_B for the R vertex, that is, values to be set as the correction amounts ΔCP_R, ΔCP_G and ΔCP_B when the corresponding point of the input image data $D_{IN}$ coincides with the R vertex in the color space. As described later, the R vertex correction amounts $\Delta CP_R^R$, $\Delta CP_G^R$ and $\Delta CP_B^R$ can be calculated from measurement results of the characteristics of the liquid crystal display panel 2, and the R vertex correction amounts $\Delta CP_R^R$, $\Delta CP_G^R$ and $\Delta CP_B^R$ may be set in the R vertex correction amount register 43R in advance (for example, when the driver IC 3 is booted).

Correspondingly, the G vertex correction amount register 43G stores therein G vertex correction amounts $\Delta CP_R^G$, $\Delta CP_G^G$ and $\Delta CP_B^G$. The G vertex correction amounts $\Delta CP_R^G$, $\Delta CP_G^G$ and $\Delta CP_B^G$ are values that are appropriate as the correction amounts ΔCP_R, ΔCP_G and ΔCP_B for the G vertex, that is, values to be set as the correction amounts ΔCP_R, ΔCP_G and ΔCP_B when the corresponding point of the input image data $D_{IN}$ coincides with the G vertex in the color space. The G vertex correction amounts $\Delta CP_R^G$, $\Delta CP_G^G$ and $\Delta CP_B^G$ may be set in the G vertex correction amount register 43G in advance (for example, when the driver IC 3 is booted).

Also, the B vertex correction amount register 43B stores therein B vertex correction amounts $\Delta CP_R^B$, $\Delta CP_G^B$ and $\Delta CP_B^B$. The B vertex correction amounts $\Delta CP_R^B$, $\Delta CP_G^B$ and $\Delta CP_B^B$ are values that are appropriate as the correction amounts ΔCP_R, ΔCP_G and ΔCP_B for the B vertex, that is, values to be set as the correction amounts ΔCP_R, ΔCP_G and ΔCP_B when the corresponding point of the input image data $D_{IN}$ coincides with the B vertex in the color space. The B vertex correction amounts $\Delta CP_R^B$, $\Delta CP_G^B$ and $\Delta CP_B^B$ may be set in the B vertex correction amount register 43B in advance (for example, when the driver IC 3 is booted).

The selector 44 selects correction amounts corresponding to the selected elementary color selected by the selection signal $SEL_{RGB}$ from among the correction amounts stored in the R, G and B vertex correction amount registers 43R, 43G and 43B and outputs the selected correction amounts. Hereinafter, the correction amounts output from the selector 44 are referred to as selected elementary color correction amounts $\Delta CP_R^{ELM}$, $\Delta CP_G^{ELM}$ and $\Delta CP_B^{ELM}$. It should be noted that $\Delta CP_R^{ELM}$ is the correction amount used in the calculation of the control point data CP0_R to CP5_R and determined as one of $\Delta CP_R^R$, $\Delta CP_R^G$ and $\Delta CP_R^B$. Correspondingly, $\Delta CP_G^{ELM}$ is the correction amount used in the calculation of the control point data CP0_G to CP5_G and determined as one of $\Delta CP_G^R$, $\Delta CP_G^G$ and $\Delta CP_G^B$. Similarly, $\Delta CP_B^{ELM}$ is the correction amount used in the calculation of the control point data CP0_B to CP5_B and determined as one of $\Delta CP_B^R$, $\Delta CP_B^G$ and $\Delta CP_B^B$.

The multiplier 45 calculates elementary-color-distance dependent correction amounts $\Delta CP_R^{ELM\text{-}d}$, $\Delta CP_G^{ELM\text{-}d}$ and $\Delta CP_B^{ELM\text{-}d}$ from the distance $d_{ELM}$ and the selected elementary color correction amounts $\Delta CP_R^{ELM}$, $\Delta CP_G^{ELM}$ and $\Delta CP_B^{ELM}$, respectively, which are output from the selector 44. The elementary-color-distance dependent correction amount $\Delta CP_R^{ELM\text{-}d}$ is calculated from $\Delta CP_R^{ELM}$ and the distance $d_{ELM}$ so that the elementary-color-distance dependent correction amount $\Delta CP_^{ELM\text{-}d}$ is closer to $\Delta CP_R^{ELM}$ as the point corresponding to the input image data $D_{IN}$ is closer to the elementary color vertex with which the belonging area of the input image data $D_{IN}$ is defined. Correspondingly, the elementary-color-distance dependent correction amount $\Delta CP_G^{ELM\text{-}d}$ is calculated from $\Delta CP_G^{ELM}$ and the distance $d_{ELM}$ so that the elementary-color-distance dependent correction amount $\Delta CP_G^{ELM\text{-}d}$ is closer to $\Delta CP_G^{ELM}$ as the point corresponding to the input image data $D_{IN}$ is closer to the elementary color vertex with which the belonging area of the input image data $D_{IN}$ is defined. The elementary-color-distance dependent correction amount $\Delta CP_B^{ELM\text{-}d}$ is calculated from $\Delta CP_B^{ELM}$ and the distance $d_{ELM}$ so that the elementary-color-distance dependent correction amount $\Delta CP_G^{ELM\text{-}d}$ is closer to $\Delta CP_G^{ELM}$ as the point corresponding to the input image data $D_{IN}$ is closer to the elementary vertex with which the belonging area of the input image data $D_{IN}$ is defined.

In the present embodiment, in which the distance $d_{ELM}$ is defined so that the distance $d_{ELM}$ is increased as the corresponding point of the input image data $D_{IN}$ is closer to the vertex corresponding to the elementary color with which the belonging area of the corresponding point of the input image data $D_{IN}$ is defined, the multiplier 45 calculates the elementary-color-distance dependent correction amount $\Delta CP_R^{ELM\text{-}d}$ so that the elementary-color-distance dependent correction amount $\Delta CP_R^{ELM\text{-}d}$ is proportional to the product of the selected elementary color correction amount $\Delta CP_R^{ELM}$ and the distance $d_{ELM}$. Correspondingly, the multiplier 45 calculates the elementary-color-distance dependent correction amount $\Delta CP_G^{ELM\text{-}d}$ so that the elementary-color-distance dependent correction amount $\Delta CP_G^{ELM\text{-}d}$ is proportional to the product of the selected elementary color correction amount $\Delta CP_G^{ELM}$ and the distance $d_{ELM}$, and calculates the elementary-color-distance dependent correction amount $\Delta CP_B^{ELM\text{-}d}$ so that the elementary-color-distance dependent correction amount $\Delta CP_B^{ELM\text{-}d}$ is proportional to the product of the selected elementary color correction amount $\Delta CP_B^{ELM}$ and the distance $d_{ELM}$.

The complementary color vertex distance calculation circuit 46 calculates the distance $d_{CMP}$ between the vertex corresponding to the complementary color selected by the selection signal $SEL_{CMY}$ and the corresponding point of the input image data $D_{IN}$ in the color space. Any parameters determined to indicate the degree of separation between the vertex corresponding to the complementary color selected by the selection signal $SEL_{CMY}$ and the corresponding point of the input image data $D_{IN}$ in the color space may be used as the distance $d_{CMP}$. A specific example of the definition of the distance $d_{CMP}$ will be described later.

The C vertex correction amount register 47C stores therein C vertex correction amounts $\Delta CP_R^C$, $\Delta CP_G^C$ and $\Delta CP_B^C$. The C vertex correction amounts $\Delta CP_R^C$, $\Delta CP_G^C$ and $\Delta CP_B^C$ are values that are appropriate as the correction amounts ΔCP_R, ΔCP_G and ΔCP_B for the C vertex, that is, values to be set as the correction amounts ΔCP_R, ΔCP_G and ΔCP_B when the corresponding point of the input image data $D_{IN}$ coincides with the C vertex in the color space. As described later, the C vertex correction amounts $\Delta CP_R^C$, $\Delta CP_G^C$ and $\Delta CP_B^C$ can be calculated from measurement results of the characteristics of the liquid crystal display panel 2, and the C vertex correction amounts $\Delta CP_R^C$, $\Delta CP_G^C$ and $\Delta CP_B^C$ may be set in the C vertex correction amount register 47C in advance (for example, when the driver IC 3 is booted).

Correspondingly, the M vertex correction amount register 47M stores therein M vertex correction amounts $\Delta CP_R^M$, $\Delta CP_G^M$ and $\Delta CP_B^M$. The M vertex correction amounts $\Delta CP_R^M$, $\Delta CP_G^M$ and $\Delta CP_B^M$ are values that are appropriate as the correction amounts ΔCP_R, ΔCP_G and ΔCP_B for the M vertex, that is, values to be set as the correction amounts ΔCP_R, ΔCP_G and ΔCP_B when the corresponding point of the input image data $D_{IN}$ coincides with the M vertex in the color space. The M vertex correction amounts $\Delta CP_R^M$, $\Delta CP_G^M$ and $\Delta CP_B^M$ may be set in the M vertex correction amount register 47M in advance (for example, when the driver IC 3 is booted).

Also, the Y vertex correction amount register 47Y stores therein Y vertex correction amounts $\Delta CP_R^Y$, $\Delta CP_G^Y$ and $\Delta CP_B^Y$. The Y vertex correction amounts $\Delta CP_R^Y$, $\Delta CP_G^Y$ and $\Delta CP_B^Y$ are values that are appropriate as the correction amounts ΔCP_R, ΔCP_G and ΔCP_B for the Y vertex, that is, values to be set as the correction amounts ΔCP_R, ΔCP_G and ΔCP_B when the corresponding point of the input image data $D_{IN}$ coincides with the Y vertex in the color space. The Y vertex correction amounts $\Delta CP_R^Y$, $\Delta CP_G^Y$ and $\Delta CP_B^Y$ may be set in the Y vertex correction amount register 47Y in advance (for example, when the driver IC 3 is booted).

It should be noted that the calculation of the R vertex correction amounts $\Delta CP_R^R$, $\Delta CP_G^R$, $\Delta CP_B^R$, G vertex correction amounts $\Delta CP_R^G$, $\Delta CP_G^G$, $\Delta CP_B^G$, B vertex correction amounts $\Delta CP_R^B$, $\Delta CP_G^B$, $\Delta CP_B^B$, C vertex correction amounts $\Delta CP_R^C$, $\Delta CP_G^C$, $\Delta CP_B^C$, M vertex correction amounts $\Delta CP_R^M$, $\Delta CP_G^M$, $\Delta CP_B^M$, Y vertex correction amounts $\Delta CP_R^Y$, $\Delta CP_G^Y$, $\Delta CP_B^Y$, which are respectively stored in the R vertex correction amount register 43R, G vertex correction amount register 43G, B vertex correction amount register 43B, C vertex correction amount register 47C, M vertex correction amount register 47M, Y vertex correction amount register 47Y and white point correction amount register 5, will be described later in detail.

The selector 48 selects correction amounts corresponding to the selected complementary color selected by the selection signal $SEL_{CMY}$ from among the correction amounts stored in the C, M and Y vertex correction amount registers 47C, 47M and 47Y and outputs the selected correction amounts. Hereinafter, the correction amounts output from the selector 48 are referred to as selected elementary color correction amounts $\Delta CP_R^{CMP}$, $\Delta CP_G^{CMP}$ and $\Delta CP_B^{CMP}$. It should be noted that $\Delta CP_R^{CMP}$ is the correction amount used in the calculation of the control point data CP0_R to CP5_R. Correspondingly, $\Delta CP_G^{CMP}$ is the correction amount used in the calculation of the control point data CP0_G to CP5_G and $\Delta CP_B^{CMP}$ is the correction amount used in the calculation of the control point data CP0_B to CP5_B.

The multiplier 49 calculates complementary-color-distance dependent correction amounts $\Delta CP_R^{CMP-d}$, $\Delta CP_G^{CMP-d}$ and $\Delta CP_B^{CMP-d}$ from the distance $d_{CMP}$ and the selected complementary color correction amounts $\Delta CP_R^{CMP}$, $\Delta CP_G^{CMP}$ and $\Delta CP_B^{CMP}$, respectively, which are output from the selector 47. The complementary-color-distance dependent correction amount $\Delta CP_R^{CMP-d}$ is calculated from $\Delta CP_R^{CMP}$ and the distance $d_{CMP}$ so that the complementary-color-distance dependent correction amount $\Delta CP_R^{CMP-d}$ is closer to $\Delta CP_R^{CMP}$ as the point corresponding to the input image data $D_{IN}$ is closer to the complementary color vertex with which the belonging area of the input image data $D_{IN}$ is defined. Correspondingly, the complementary-color-distance dependent correction amount $\Delta CP_G^{CMP-d}$ is calculated from $\Delta CP_G^{CMP}$ and the distance $d_{CMP}$ so that the complementary-color-distance dependent correction amount $\Delta CP_G^{CMP-d}$ is closer to $\Delta CP_G^{CMP}$ as the point corresponding to the input image data $D_{IN}$ is closer to the complementary color vertex with which the belonging area of the input image data $D_{IN}$ is defined, and the complementary-color-distance dependent correction amount $\Delta CP_B^{CMP-d}$ is calculated from $\Delta CP_B^{CMP}$ and the distance $d_{CMP}$ so that the complementary-color-distance dependent correction amount $\Delta CP_B^{CMP-d}$ is closer to $\Delta CP_B^{CMP}$ as the point corresponding to the input image data $D_{IN}$ is closer to the complementary color vertex with which the belonging area of the input image data $D_{IN}$ is defined.

In the present embodiment, in which the distance $d_{CMP}$ is defined so that the distance $d_{CMP}$ is increased as the corresponding point of the input image data $D_{IN}$ is closer to the vertex corresponding to the elementary color with which the belonging area of the corresponding point of the input image data $D_{IN}$ is defined, the multiplier 49 calculates the complementary-color-distance dependent correction amount $\Delta CP_R^{CMP-d}$ so that the complementary-color-distance dependent correction amount $\Delta CP_R^{CMP-d}$ is proportional to the product of the selected complementary color correction amount $\Delta CP_R^{CMP}$ and the distance $d_{CMP}$. Correspondingly, the multiplier 49 calculates the complementary-color-distance dependent correction amount $\Delta CP_G^{CMP-d}$ so that the complementary-color-distance dependent correction amount $\Delta CP_G^{CMP-d}$ is proportional to the product of the selected complementary color correction amount $\Delta CP_G^{CMP}$ and the distance $d_{CMP}$ and calculates the complementary-color-distance dependent correction amount $\Delta CP_B^{CMP-d}$ so that the complementary-color-distance dependent correction amount $\Delta CP_B^{CMP-d}$ is proportional to the product of the selected complementary color correction amount $\Delta CP_B^{CMP}$ and the distance $d_{CMP}$.

The white point distance calculation circuit 50 calculates the distance $d_W$ between the white point and the corresponding point of the input image data $D_{IN}$ in the color space. Any parameters determined to indicate the degree of separation between the white point and the corresponding point of the input image data $D_{IN}$ in the color space may be used as the distance $d_W$. A specific example of the definition of the distance $d_W$ will be described later.

The white point correction amount register 51 stores therein white point correction amounts $\Delta CP_R^W$, $\Delta CP_G^W$ and $\Delta CP_B^W$. The white point correction amounts $\Delta CP_R^W$, $\Delta CP_G^W$ and $\Delta CP_B^W$ are values that are appropriate as the correction amounts ΔCP_R, ΔCP_G and ΔCP_B for the white point, that is, values to be set as the correction amounts ΔCP_R, ΔCP_G and ΔCP_B when the corresponding point of the input image data $D_{IN}$ coincides with the white point in the color space. As described later, the white point correction amounts $\Delta CP_R^W$, $\Delta CP_G^W$ and $\Delta CP_B^W$ can be calculated from measurement results of the characteristics of the liquid crystal display panel 2, and the white point correction amounts $\Delta CP_R^W$, $\Delta CP_G^W$ and $\Delta CP_B^W$ may be set in the white point correction amount register 51 in advance (for example, when the driver IC 3 is booted).

The multiplier 52 calculates white-point-distance dependent correction amounts $\Delta CP_R^{W-d}$, $\Delta CP_G^{W-d}$ and $\Delta CP_B^{W-d}$ from the distance $d_W$ and the white point correction amounts $\Delta CP_R^W$, $\Delta CP_G^W$ and $\Delta CP_B^W$, respectively, which are output from the white point correction amount register 51. The white-point-distance dependent correction amount $\Delta CP_R^{W-d}$ is calculated from $\Delta CP_R^W$ and the distance $d_W$ so that the white-point-distance dependent correction amount $\Delta CP_R^{W-d}$ is closer to $\Delta CP_R^W$ as the point corresponding to the input image data $D_{IN}$ is closer to the white point. Correspondingly, the white-point-distance dependent correction amount $\Delta CP_G^{W-d}$ is calculated from $\Delta CP_G^W$ and the distance $d_W$ so that the white-point-distance dependent correction amount $\Delta CP_G^{W-d}$ is closer to $\Delta CP_G^W$ as the point corresponding to the input image data $D_{IN}$ is closer to the white point, and the white-point-distance dependent correction amount $\Delta CP_B^{W-d}$ is calculated from $\Delta CP_B^W$ and the distance $d_W$ so that the white-point-distance dependent correction amount $\Delta CP_B^{W-d}$ is closer to $\Delta CP_B^W$ as the point corresponding to the input image data $D_{IN}$ is closer to the white point.

The adder 53 calculates the correction amounts ΔCP_R, ΔCP_G and ΔCP_B from the elementary-color-distance dependent correction amounts $\Delta CP_R^{ELM-d}$, $\Delta CP_G^{ELM-d}$ and $\Delta CP_B^{ELM-d}$ that are output from the multiplier 45, the complementary-color-distance dependent correction amounts $\Delta CP_R^{CMP-d}$, $\Delta CP_G^{CMP-d}$ and $\Delta CP_B^{CMP-d}$ that are output from the multiplier 49 and the white-point-distance dependent correction amounts $\Delta CP_R^{W-d}$, $\Delta CP_G^{W-d}$ and $\Delta CP_B^{W-d}$ that are output from the multiplier 52. In detail, the adder 53 calculates the correction amount ΔCP_R as the sum of $\Delta CP_R^{ELM-d}$, $\Delta CP_R^{CMP-d}$ and $\Delta CP_R^{W-d}$. Correspondingly, the adder 53 calculates the correction amount ΔCP_G as the sum of $\Delta CP_G^{ELM-d}$, $\Delta CP_G^{CMP-d}$ and $\Delta CP_G^{W-d}$ and calculates the correction amount ΔCP_B as the sum of $\Delta CP_B^{ELM-d}$, $\Delta CP_B^{CMP-d}$ and $\Delta CP_B^{W-d}$.

It should be noted that, the calculation of the R vertex correction amounts $\Delta CP_R^R$, $\Delta CP_G^R$, $\Delta CP_B^R$, G vertex correction amounts $\Delta CP_R^G$, $\Delta CP_G^G$, $\Delta CP_B^G$, B vertex correction amounts $\Delta CP_R^B$, $\Delta CP_G^B$, $\Delta CP_B^B$, C vertex correction amounts $\Delta CP_R^C$, $\Delta CP_G^C$, $\Delta CP_B^C$, M vertex correction amounts $\Delta CP_R^M$, $\Delta CP_G^M$, $\Delta CP_B^M$ and Y vertex correction amounts $\Delta CP_R^Y$, $\Delta CP_G^Y$, $\Delta CP_B^Y$, which are respectively stored in the R vertex correction amount register 43R, G vertex correction amount register 43G, B vertex correction amount register 43B, C vertex correction amount register 47C, M vertex correction amount register 47M and Y vertex correction amount register 47Y, will be described later in detail.

Figure 11A:
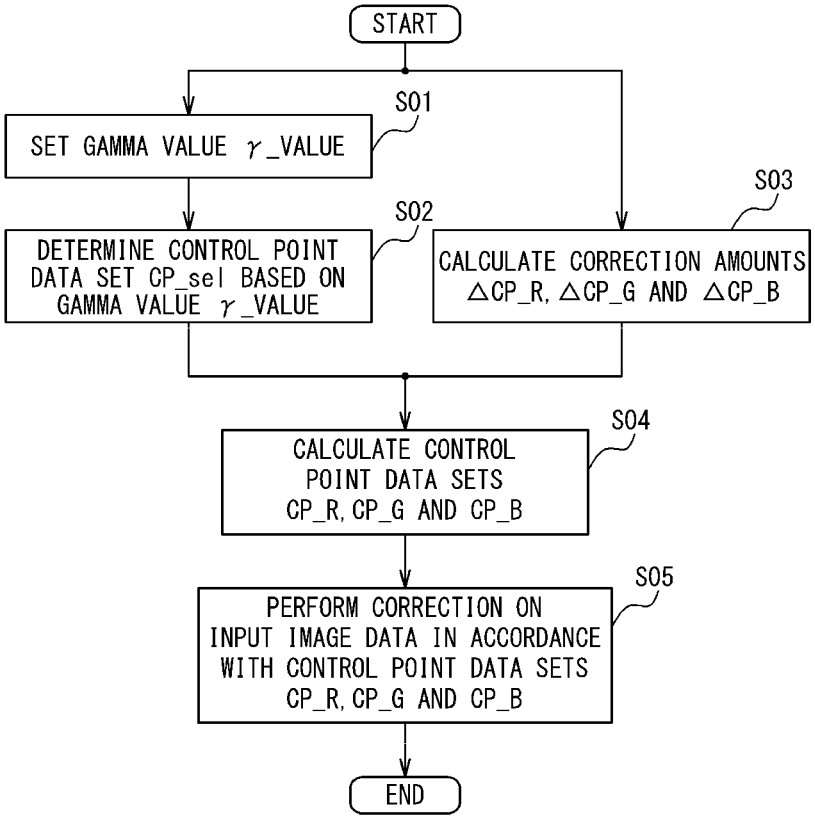
FIG. 11A is a flowchart illustrating digital arithmetic processing performed on input image data $D_{IN}$ in the first embodiment.

Next, a description is given of digital arithmetic processing performed for the color adjustment and gamma correction in the first embodiment. FIG. 11A is a flowchart illustrating the digital arithmetic processing performed in the first embodiment.

Step S01:

The gamma value γ_VALUE is determined by the gamma value setting circuit 27. In the present embodiment, the gamma value γ_VALUE is determined for each frame period on the basis of the APL (average picture level) of the frame image displayed in each frame period. The APL of each frame image is calculated from the input image data $D_{IN}$.

In one embodiment, the gamma value γ_VALUE may be calculated in accordance with the following expression (1), for example:

$$\gamma_VALUE=\gamma_STD+(APL)\cdot\eta, \tag{1}$$

where γ_STD is a reference gamma value, (APL) is the APL of the frame image, and η is a predetermined positive proportionality constant.

It should be noted that a common gamma value γ_VALUE is determined for the R, G and B grayscale values $D_{IN}^R$, $D_{IN}^G$ and $D_{IN}^B$ of the input image data $D_{IN}$, in the present embodiment. The gamma value γ_VALUE may be determined on the basis of other parameters in addition to or instead of the APL of each frame image.

Step S02:

A control point data set CP_sel (which includes control point data CP0_sel to CP5_sel) is further selected or calculated in response to the gamma value γ_VALUE thus determined. The control point data set CP_sel is initial data used to calculate the control point data set CP_R, CP_G and CP_B finally fed to the approximate gamma correction circuit 22. The control point data set CP_sel is selected for each frame image.

In one embodiment, the control point data set CP_sel is selected from the control point data sets CP#1 to CP#m stored in the control point data set storage register 31 of the control point data calculation circuit 29. As described above, the control point data sets CP#1 to CP#m correspond to different gamma values γ, and each control point data set CP#j includes control point data CP0#*j* to CP5#*j*.

The control point data CP0#*j* to CP5#*j* of the control point data set CP#j corresponding to a given gamma value γ are determined as follows:

(1) For $\gamma < 1$, $$\begin{aligned} CP0\#j &= 0 \\ CP1\#j &= \frac{4\cdot\mathrm{Gamma}[K/4]-\mathrm{Gamma}[K]}{2} \\ CP2\#j &= \mathrm{Gamma}[K-1] \\ CP3\#j &= \mathrm{Gamma}[K] \\ CP4\#j &= 2\cdot\mathrm{Gamma}[(D_{IN}^{MAX}+K-1)/2]-D_{OUT}^{MAX} \\ CP5\#j &= D_{OUT}^{MAX} \end{aligned} \tag{2a}$$

(2) For $\gamma \geq 1$, $$\begin{aligned} CP0\#j &= 0 \\ CP1\#j &= 2\cdot\mathrm{Gamma}[K/2]-\mathrm{Gamma}[K] \\ CP2\#j &= \mathrm{Gamma}[K-1] \\ CP3\#j &= \mathrm{Gamma}[K] \\ CP4\#j &= 2\cdot\mathrm{Gamma}[(D_{IN}^{MAX}+K-1)/2]D_{OUT}^{MAX} \\ CP5\#j &= D_{OUT}^{MAX} \end{aligned} \tag{2b}$$

In expressions (2a) and (2b), $D_{IN}^{MAX}$ is the allowed maximum value of the R, G and B grayscale values $D_{IN}^R$, $D_{IN}^{G}$ and $D_{IN}^{B}$ of the input image data $D_{IN}$, depending on the number of bits of the R, G and B grayscale values $D_{IN}^{R}$, $D_{IN}^{G}$ and $D_{IN}^{B}$.

$D_{OUT}^{MAX}$ is the allowed maximum value of the R, G and B grayscale values $D_{OUT}^{R}$, $D_{OUT}^{G}$ and $D_{OUT}^{B}$ of the output image data $D_{OUT}$, depending on the number of bits of the R, G and B grayscale values $D_{OUT}^{R}$, $D_{OUT}^{G}$ and $D_{OUT}^{B}$. K is a constant given by the following expression (3):

$$K=(D_{IN}^{MAX}+1)/2. \tag{3}$$

Gamma [x] is a function representing the strict expression of the gamma correction and defined by the following expression (4):

$$\text{Gamma}[x]=D_{OUT}^{MAX}\cdot(x/D_{IN}^{MAX})^{\gamma} \tag{4}$$

In the present embodiment, the control point data sets CP#1 to CP#m are determined so that the gamma value γ is increased as the index j is increased for the control point data set CP#j, which is allowed to be arbitrarily selected from the control point data sets CP#1 to CP#m. In other words, it holds:

$$\gamma_1<\gamma_2<\ldots<\gamma_{m-1}<\gamma_m, \tag{5}$$

where $\gamma_j$ is the gamma value determined for the control point data set CP#j.

In one embodiment, the control point data set CP_sel is selected from among the control point data sets CP#1 to CP#m in response to the gamma value γ_VALUE. A control point data set CP#j with a larger value of j is selected as the gamma value γ_VALUE is increased.

Figure 11B:
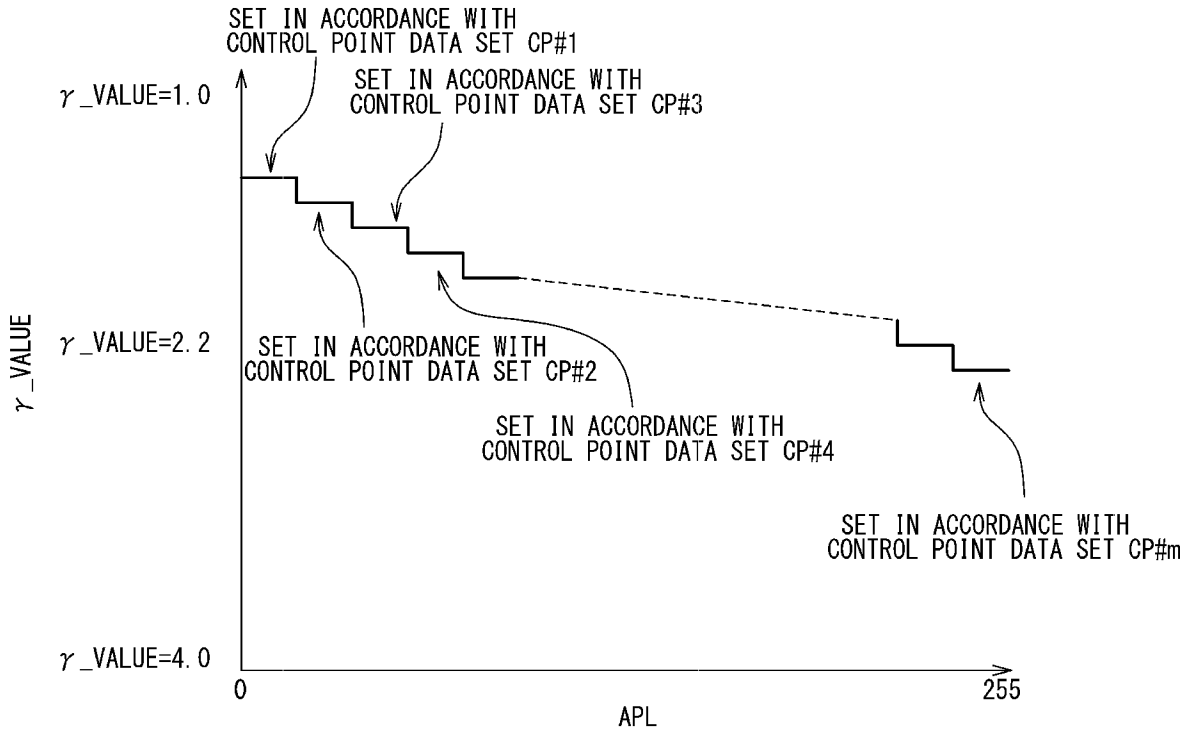
FIG. 11B is a graph illustrating the relation among an APL, a gamma value γ_VALUE and control point data set CP_sel in one embodiment.

FIG. 11B is a graph illustrating the relation among the APL, γ_VALUE and the control point data set CP_sel in the case when the control point data set CP_sel is thus determined. As the APL is increased, the gamma value γ_VALUE is increased and a control point data set CP#j with a larger value of j is selected.

In an alternative embodiment, the control point data set CP_sel may be calculated as follows: $2^{P-(Q-1)}$ control point data sets CP#1 to CP#m (where $m=2^{P-(Q-1)}$) are stored in the control point data set storage register 31, where P is the number of bits used to indicate the APL of each frame image and Q is a predetermined integer equal to or more than two and less than P. The control point data sets CP#1 to CP#m stored in the control point data set storage register 31 may be fed to from the processor 4 to the driver IC 3 is initial settings.

Two control point data sets CP#q and CP#(q+1) are further selected from the control point data sets CP#1 to CP#m stored in the control point data set storage register 31 in response to the gamma value γ_VALUE, where q is an integer from one to m−1. The control point data sets CP#q and CP#(q+1) are selected to satisfy the following expression (6):

$$\gamma_q<\gamma_\text{VALUE}<\gamma_{q+1}. \tag{6}$$

The control point data CP0_sel to CP5_sel of the control point data set CP_sel are calculated by interpolation of the control point data CP0#$q$ to CP5#$q$ of the selected control point data set CP#q and the control point data CP0#($q$+1) to CP5#($q$+1) of the selected control point data set CP#($q$+1), respectively.

More specifically, the control point data CP0_sel to CP5_sel of the control point data set CP_sel are calculated from the control point data of the selected two control point data CP#q and CP#(q+1) in accordance with the following expression (7):

$$\text{CP}\alpha_{sel}=\text{CP}\alpha\#q+\{(\text{CP}\alpha\#(q+1)-\text{CP}\alpha\#q)/2^{Q}\}\times APL[Q-1:0], \tag{7}$$

where α is an integer from zero to five and APL[Q−1:0] is the value of the lower Q bits of the APL.

Figure 11C:
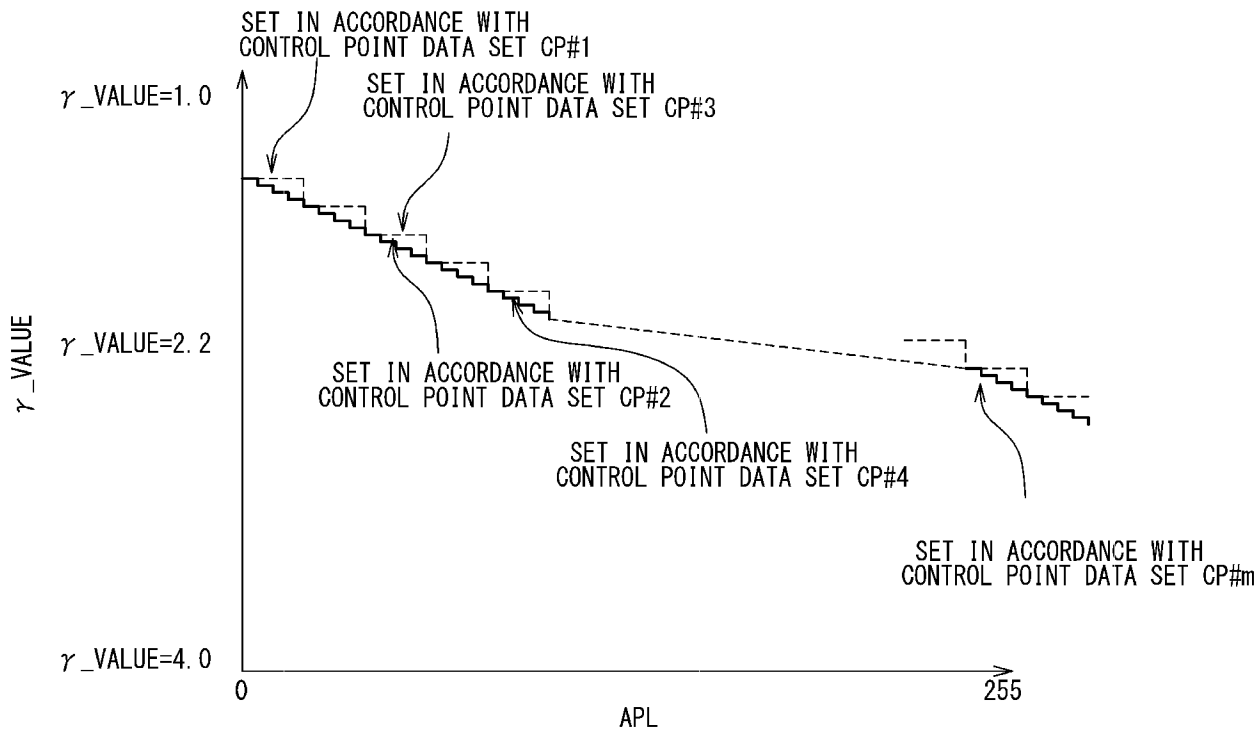
FIG. 11C is a graph illustrating the relation among an APL, a gamma value γ_VALUE and control point data set CP_sel in another embodiment.

FIG. 11C is a graph illustrating the relation among the APL, γ_VALUE and the control point data set CP_sel in the case when the control point data set CP_sel is thus determined. As the APL is increased, the gamma value γ_VALUE is increased and control point data sets CP#q and CP#(q+1) with a larger value of q are selected. The control point data set CP_sel is determined so that the control point data set CP_sel corresponds to a gamma value between the gamma values $\gamma_q$ and $\gamma_{q+1}$, which correspond to the control point data sets CP#q and CP#(q+1).

Figure 11D:
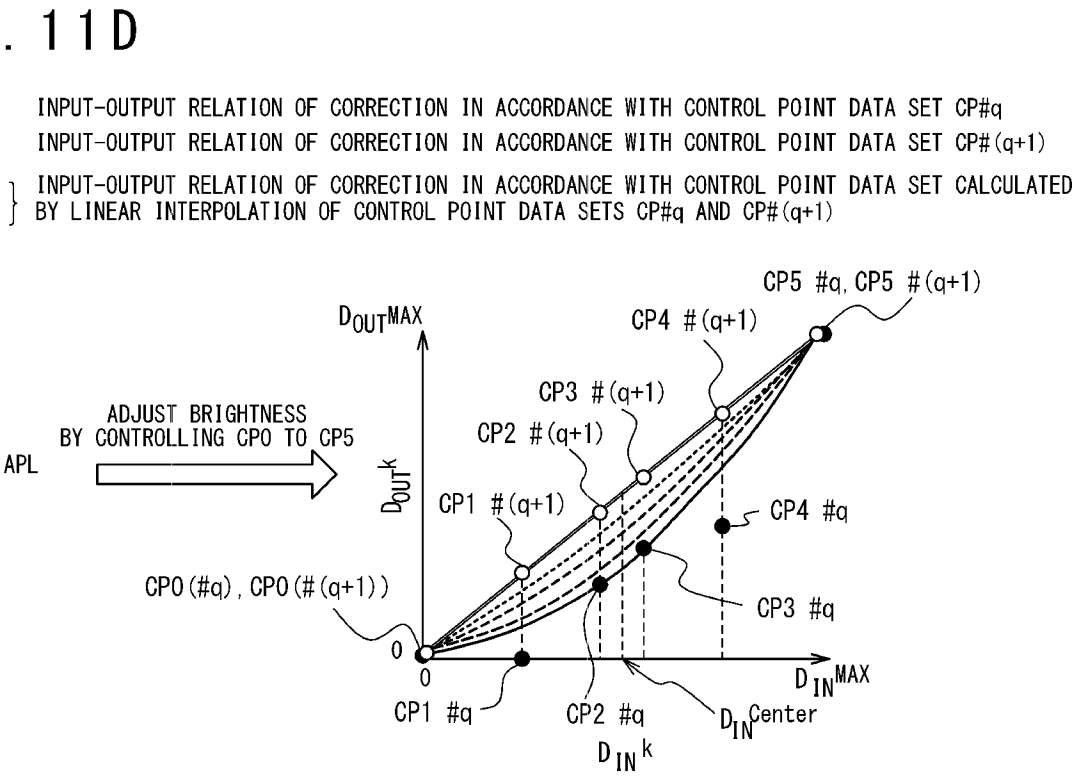
FIG. 11D is a graph conceptually illustrating the shapes of gamma curves corresponding to control point data set CP#q and CP#(q+1) and the shape of a gamma curve corresponding to control point data set CP_sel.

FIG. 11D is a graph illustrating the shapes of the gamma curves respectively corresponding to the control point data sets CP#q and CP#(q+1) and the shape of the gamma curve corresponding to the control point data set CP_sel. Since the control point data CPα of the control point data set CP_sel is calculated through interpolation of the control point data CPα#q and CPα#(q+1) of the control point data sets CP#q and CP#(q+1) (α is an integer from zero to five), the gamma curve corresponding to the control point data set CP_sel has such a shape that the gamma curve corresponding to the control point data set CP_sel is located between the gamma curves corresponding to the control point data sets CP#q and CP#(q+1). The calculation of the control point data CP0_sel to CP5_sel of the control point data set CP_sel through the interpolation of the control point data CP0 to CP5 of the selected two control point data sets CP#q and CP#(q+1) effectively allows finely adjusting the gamma value used for the gamma correction with a reduced number of the control point data sets CP#1 to CP#m stored in the control point data set storage register 31.

Figure 12A:
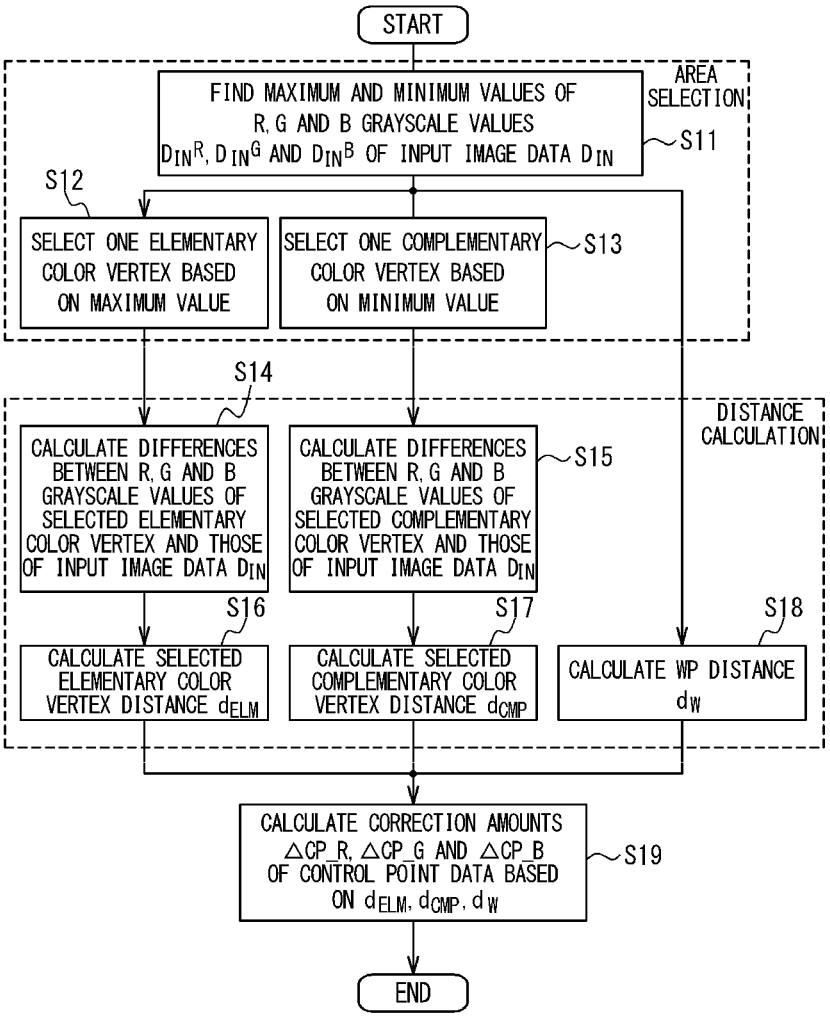
FIG. 12A is a flowchart illustrating an exemplary calculation procedure of correction amounts ΔCP_R, ΔCP_G and ΔCP_B in one embodiment of the present invention.

Step S03:

The correction amounts ΔCP_R, ΔCP_G and ΔCP_B are further calculated by the correction amount calculation circuit 28. The correction amounts ΔCP_R, ΔCP_G and ΔCP_B are determined depending on the position of the corresponding point of the input image data $D_{IN}$ in the color space. It should be noted that the correction amounts ΔCP_R, ΔCP_G and ΔCP_B are calculated for each pixel 9 on the basis of the input image data $D_{IN}$. The correction amounts ΔCP_R, ΔCP_G and ΔCP_B for a certain pixel 9 are calculated on the basis of the R, G and B grayscale values $D_{IN}^{R}$, $D_{IN}^{G}$ and $D_{IN}^{B}$ of the input image data $D_{IN}$ associated with the pixel 9. FIG. 12A is a flowchart illustrating the calculation procedure of the correction amounts ΔCP_R, ΔCP_G and ΔCP_B.

First, it is determined by the maximum-and-minimum values calculation circuit 41 which of the areas A1 to A6 (see FIG. 3B) the corresponding point of the input image data $D_{IN}$ belongs to in the color space (at steps S11 to S13).

More specifically, it is determined by the maximum-and-minimum values calculation circuit 41 which of the R, G and B grayscale values $D_{IN}^{R}$, $D_{IN}^{G}$ and $D_{IN}^{B}$ of the input image data $D_{IN}$ are maximum and minimum (at step S11). The belonging area of the corresponding point of the input image data $D_{IN}$ is determined as an area defined with the vertex corresponding to the elementary color associated with the largest one of the R, G and B grayscale values $D_{IN}^{R}$, $D_{IN}^{G}$ and $D_{IN}^{B}$, the vertex corresponding to the complementary color of the elementary color associated with the smallest one, and the white point. When the R grayscale value $D_{IN}^{R}$ is the largest and the B grayscale value $D_{IN}^{B}$ is the smallest, for example, the belonging area of the corresponding point of the input image data $D_{IN}$ can be determined as the area A1 (that is, the area defined with the R vertex, the Y vertex and the white point).

The selection signal $SEL_{RGB}$ is generated to select one of R, G and B on the basis of which of the R, G and B grayscale values $D_{IN}^R$, $D_{IN}^G$ and $D_{IN}^B$ is the largest (at step S12), and the selection signal $SEL_{CMY}$ is generated to select one of C, M and Y on the basis of which of the R, G and B grayscale values $D_{IN}^R$, $D_{IN}^G$ and $D_{IN}^B$ is the smallest (at step S13). Here, the selection signal $SEL_{RGB}$ is generated to select the elementary color associated with the largest one of the R, G and B grayscale values $D_{IN}^R$, $D_{IN}^G$ and $D_{IN}^B$, and the selection signal $SEL_{CMY}$ is generated to select the complementary color of the elementary color associated with the smallest one of the R, G and B grayscale values $D_{IN}^R$, $D_{IN}^G$ and $D_{IN}^B$. In the following, the vertex corresponding to the elementary color selected at step S12 is referred to as "selected elementary color vertex" and the vertex corresponding to the complementary color selected at step S13 is referred to as "selected complementary color vertex".

Furthermore, the following three "distances" are calculated for the belonging area of the corresponding point of the input image data $D_{IN}$ (at steps S14 to S18):

(1) the distance $d_{ELM}$ between the selected elementary color vertex (that is, the vertex corresponding to the elementary color which defines the belonging area) and the corresponding point of the input image data $D_{IN}$, (2) the distance $d_{CMP}$ between the selected complementary color vertex (that is, the vertex corresponding to the complementary color which defines the belonging area) and the corresponding point of the input image data $D_{IN}$, and (3) the distance $d_W$ between the white point and the corresponding point of the input image data $D_{IN}$. The distance $d_{ELM}$ is calculated by the elementary color vertex distance calculation circuit 42, and the distance $d_{CMP}$ is calculated by the complementary color vertex distance calculation circuit 46. The distance $d_W$ is calculated by the white point distance calculation circuit 50. The above-described distances $d_{ELM}$, $d_{CMP}$ and $d_W$ are calculated as follows:

The difference between the R grayscale value of the selected elementary color vertex and the R grayscale value $D_{IN}^R$ of the input image data $D_{IN}$, the difference between the G grayscale value of the selected elementary color vertex and the G grayscale value $D_{IN}^G$ of the input image data $D_{IN}$ and the difference between the B grayscale value of the selected elementary color vertex and the B grayscale value $D_{IN}^B$ of the input image data $D_{IN}$ are calculated (at step S14). In the present embodiment, the differences between the R, G and B grayscale values of the selected elementary color vertex and the R, G and B grayscale value $D_{IN}^R$, $D_{IN}^G$ and $D_{IN}^B$ of the input image data are calculated in accordance with the following expressions (8a) to (8c):

$$RGB\text{dist_}R = RGB_R\text{top} - D_{IN}^R, \tag{8a}$$

$$RGB\text{dist_}G = RGB_G\text{top} - D_{IN}^G, \text{ and} \tag{8b}$$

$$RGB\text{dist_}B = RGB_B\text{top} - D_{IN}^B, \tag{8c}$$

where RGB_Rtop, RGB_Gtop and RGB_Btop are the R, G and B grayscale values of the selected elementary color vertex, respectively. RGBdist_R is the difference between the R grayscale value of the selected elementary color vertex and the R grayscale value $D_{IN}^R$ of the input image data $D_{IN}$. Correspondingly, RGBdist_G is the difference between the G grayscale value of the selected elementary color vertex and the G grayscale value $D_{IN}^G$ of the input image data $D_{IN}$ and RGBdist_B is the difference between the B grayscale value of the selected elementary color vertex and the grayscale value $D_{IN}^B$ of the input image data $D_{IN}$.

Correspondingly, the difference between the R grayscale value of the selected complementary color vertex and the R grayscale value $D_{IN}^R$ of the input image data $D_{IN}$, the difference between the G grayscale value of the selected complementary color vertex and the G grayscale value $D_{IN}^G$ of the input image data $D_{IN}$ and the difference between the B grayscale value of the selected complementary color vertex and the B grayscale value $D_{IN}^B$ of the input image data $D_{IN}$ are calculated (at step S15). In the present embodiment, the differences between the R, G and B grayscale values of the selected complementary color vertex and the R, G and B grayscale value $D_{IN}^R$, $D_{IN}^G$ and $D_{IN}^B$ of the input image data are calculated in accordance with the following expressions (9a) to (9c):

$$CMY\text{dist_}R = CMY_R\text{top} - D_{IN}^R, \tag{9a}$$

$$CMY\text{dist_}G = CMY_G\text{top} - D_{IN}^G, \text{ and} \tag{9b}$$

$$CMY\text{dist_}B = CMY_B\text{top} - D_{IN}^B, \tag{9c}$$

where CMY_Rtop, CMY_Gtop and CMY_Btop are the R, G and B grayscale values of the selected complementary color vertex, respectively. CMPdist_R is the difference between the R grayscale value of the selected complementary color vertex and the R grayscale value $D_{IN}^R$ of the input image data $D_{IN}$. Correspondingly, CMYdist_G is the difference between the G grayscale value of the selected complementary color vertex and the G grayscale value $D_{IN}^G$ of the input image data $D_{IN}$ and CMYdist_B is the difference between the B grayscale value of the selected complementary color vertex and the B grayscale value $D_{IN}^B$ of the input image data $D_{IN}$.

The distance $d_{ELM}$ between the selected elementary color vertex and the corresponding point of the input image data $D_{IN}$ is calculated on the basis of the difference between the maximum and minimum values of the differences RGBdist_R, RGBdist_G and RGBdist_B (at step S16). More specifically, the distance $d_{ELM}$ between the selected elementary color vertex and the corresponding point of the input image data $D_{IN}$ is calculated in accordance with the following expression (10):

$$d_{ELM} = D_{IN}^{MAX} - (\max(RGB\text{dist}) - \min(RGB\text{dist})), \tag{10}$$

where $D_{IN}^{MAX}$ is the allowed maximum value of the R, G and B grayscale values $D_{IN}^R$, $D_{IN}^G$ and $D_{IN}^B$ of the input image data $D_{IN}$ and determined on the number of bits of the R, G and B grayscale values $D_{IN}^R$, $D_{IN}^G$ and $D_{IN}^B$ of the input image data $D_{IN}$. When the R, G and B grayscale values $D_{IN}^R$, $D_{IN}^G$ and $D_{IN}^B$ of the input image data $D_{IN}$ are each 8-bit data, for example, $D_{IN}^{MAX}$ is 255 ($=2^8-1$). max(RGBdist) is the maximum value of the differences RGBdist_R, RGBdist_G and RGBdist_B and min(RGBdist) is the minimum value of the differences RGBdist_R, RGBdist_G and RGBdist_B.

Similarly, the distance $d_{CMP}$ between the selected complementary color vertex and the corresponding point of the input image data $D_{IN}$ is calculated on the basis of the difference between the maximum and minimum values of the differences CMYdist_R, CMYdist_G and CMYdist_B (at step S17). More specifically, the distance $d_{CMP}$ between the selected complementary color vertex and the corresponding point of the input image data $D_{IN}$ is calculated in accordance with the following expression (11):

$$d_{CMP} = D_{IN}^{MAX} - (\max(CMY\text{dist}) - \min(CMY\text{dist})), \tag{11}$$

where max(CMYdist) is the maximum value of the differences CMYdist_R, CMYdist_G and CMYdist_B and min (CMYdist) is the minimum value of the differences CMYdist_R, CMYdist_G and CMYdist_B.

Furthermore, the distance $d_W$ between the white point and the input image data $D_{IN}$ is calculated as the minimum value of the R, G and B grayscale values $D_{IN}^R$, $D_{IN}^G$ and $D_{IN}^B$ of the input image data $D_{IN}$ (at step S18).

In other words, it holds:

$$d_W=\min(D_{IN}^R,D_{IN}^G,D_{IN}^B) \tag{12}$$

It should be noted here that, in the present invention, the distances $d_{ELM}$, $d_{CMP}$ and $d_W$ are defined so that the sum of the $d_{ELM}$, $d_{CMP}$ and $d_W$ is equal to the maximum value of the R, G and B grayscale values $D_{IN}^R$, $D_{IN}^G$ and $D_{IN}^B$ of the input image data $D_{IN}$.

Furthermore, the correction amounts ΔCP_R, ΔCP_G and ΔCP_B of the control point data are calculated on the basis of the distances $d_{ELM}$, $d_{CMP}$ and $d_W$ thus calculated (at step S19). The calculation of the correction amounts ΔCP_R, ΔCP_G and ΔCP_B at step S19 is achieved as follows:

The selected elementary color correction amounts $\Delta CP_R^{ELM}$, $\Delta CP_G^{ELM}$ and $\Delta CP_B^{ELM}$ (the correction amounts associated with the selected elementary color) are output from the selector 44 in response to the selection signal $SEL_{RGB}$, and the elementary-color-distance dependent correction amounts $\Delta CP_R^{ELM-d}$, $\Delta CP_G^{ELM-d}$ and $\Delta CP_B^{ELM-d}$ are calculated from the distance $d_{ELM}$ and the selected elementary color correction amounts $\Delta CP_R^{ELM}$, $\Delta CP_G^{ELM}$ and $\Delta CP_B^{ELM}$. The elementary-color-distance dependent correction amount $\Delta CP_R^{ELM-d}$ is calculated from $\Delta CP_R^{ELM}$ and the distance $d_{ELM}$ so that the elementary-color-distance dependent correction amount $\Delta CP_R^{ELM-d}$ is closer to the value of $\Delta CP_R^{ELM}$ as the corresponding point of the input image data $D_{IN}$ is closer to the vertex corresponding to the elementary color with which the belonging area of the corresponding point is defined. Correspondingly, the elementary-color-distance dependent correction amount $\Delta CP_G^{ELM-d}$ is calculated from $\Delta CP_G^{ELM}$ and the distance $d_{ELM}$ so that the elementary-color-distance dependent correction amount $\Delta CP_G^{ELM-d}$ is closer to the value of $\Delta CP_G^{ELM}$ as the corresponding point of the input image data $D_{IN}$ is closer to the vertex corresponding to the elementary color with which the belonging area of the corresponding point is defined, and the elementary-color-distance dependent correction amount $\Delta CP_B^{ELM-d}$ is calculated from $\Delta CP_B^{ELM}$ and the distance $d_{ELM}$ so that the elementary-color-distance dependent correction amount $\Delta CP_B^{ELM-d}$ is closer to the value of $\Delta CP_B^{ELM}$ as the corresponding point of the input image data $D_{IN}$ is closer to the vertex corresponding to the elementary color with which the belonging area of the corresponding point is defined.

In the present embodiment, the elementary-color-distance dependent correction amounts $\Delta CP_R^{ELM-d}$, $\Delta CP_G^{ELM-d}$ and $\Delta CP_B^{ELM-d}$ are calculated by the multiplier 45 as the products of the selected elementary color correction amounts $\Delta CP_R^{ELM}$, $\Delta CP_G^{ELM}$ and $\Delta CP_B^{ELM}$, respectively, and the value obtained by normalizing the distance $d_{ELM}$ with the allowed maximum value $D_{IN}^{MAX}$. Namely, it holds:

$$\Delta CP_R^{ELM-d}=\Delta CP_R^{ELM}\times d_{ELM}/D_{IN}^{MAX}, \tag{13a}$$

$$\Delta CP_G^{ELM-d}=\Delta CP_G^{ELM}\times d_{ELM}/D_{IN}^{MAX}, \text{ and} \tag{13b}$$

$$\Delta CP_B^{ELM-d}=\Delta CP_B^{ELM}\times d_{ELM}/D_{IN}^{MAX}. \tag{13c}$$

Furthermore, the selected complementary color correction amounts $\Delta CP_R^{CMP}$, $\Delta CP_G^{CMP}$ and $\Delta CP_B^{CMP}$ (the correction amounts associated with the selected complementary color) are output from the selector 48 in response to the selection signal $SEL_{CMY}$, and the complementary-color-distance dependent correction amounts $\Delta CP_R^{CMP-d}$, $\Delta CP_G^{CMP-d}$ and $\Delta CP_B^{CMP-d}$ are calculated from the distance $d_{CMP}$ and the selected elementary color correction amounts $\Delta CP_R^{CMP}$, $\Delta CP_G^{CMP}$ and $\Delta CP_B^{CMP}$. The complementary-color-distance dependent correction amount $\Delta CP_R^{CMP-d}$ is calculated from $\Delta CP_R^{CMP}$ and the distance $d_{CMP}$ so that the complementary-color-distance dependent correction amount $\Delta CP_R^{CMP-d}$ is closer to the value of $\Delta CP_R^{CMP}$ as the corresponding point of the input image data $D_{IN}$ is closer to the vertex corresponding to the complementary color with which the belonging area of the corresponding point is defined. Correspondingly, the complementary-color-distance dependent correction amount $\Delta CP_G^{CMP-d}$ is calculated from $\Delta CF_G^{CMP}$ and the distance $d_{CMP}$ so that the complementary-color-distance dependent correction amount $\Delta CP_G^{CMP-d}$ is closer to the value of $\Delta CP_G^{CMP}$ as the corresponding point of the input image data $D_{IN}$ is closer to the vertex corresponding to the complementary color with which the belonging area of the corresponding point is defined, and the complementary-color-distance dependent correction amount $\Delta CP_B^{CMP-d}$ is calculated from $\Delta CP_B^{CMP}$ and the distance $d_{CMP}$ so that the complementary-color-distance dependent correction amount $\Delta CP_B^{CMP-d}$ closer to the value of $\Delta CP_B^{CMP}$ as the corresponding point of the input image data $D_{IN}$ is closer to the vertex corresponding to the complementary color with which the belonging area of the corresponding point is defined.

In the present embodiment, the complementary-color-distance dependent correction amounts $\Delta CP_R^{CMP-d}$, $\Delta CP_G^{CMP-d}$ and $\Delta CP_B^{CMP-d}$ are calculated by the multiplier 49 as the products of the selected complementary color correction amounts $\Delta CP_R^{CMP}$, $\Delta CP_G^{CMP}$ and $\Delta CP_B^{CMP}$, respectively, and the value obtained by normalizing the distance $d_{CMP}$ with the allowed maximum value $D_{IN}^{MAX}$. Namely, it holds:

$$\Delta CP_R^{CMP-d}=\Delta CP_R^{CMP}\times d_{CMP}/D_{IN}^{MAX} \tag{14a}$$

$$\Delta CP_G^{CMP-d}=\Delta CP_G^{CMP}\times d_{CMP}/D_{IN}^{MAX}, \text{ and} \tag{14b}$$

$$\Delta CP_B^{CMP-d}=\Delta CP_B^{CMP}\times d_{CMP}/D_{IN}^{MAX}. \tag{14c}$$

Furthermore, the white-point-distance dependent correction amounts $\Delta CP_R^{W-d}$, $\Delta CP_G^{W-d}$ and $\Delta CP_B^{W-d}$ are calculated from the distance $d_W$ and the white point correction amounts $\Delta CP_R^{W}$, $\Delta CP_G^{W}$ and $\Delta CP_B^{W}$. The white-point-distance dependent correction amount $\Delta CP_R^{W-d}$ is calculated from $\Delta CP_R^{W}$ and the distance $d_W$ so that the white-point-distance dependent correction amount $\Delta CP_R^{W-d}$ is closer to the value of $\Delta CP_R^{W}$ as the corresponding point of the input image data $D_{IN}$ is closer to the white point. Correspondingly, the white-point-distance dependent correction amount $\Delta CP_G^{W-d}$ is calculated from $\Delta CP_G^{W}$ and the distance $d_W$ so that the white-point-distance dependent correction amount $\Delta CP_G^{W-d}$ is closer to the value of $\Delta CP_G^{W}$ as the corresponding point of the input image data $D_{IN}$ is closer to the white point, and the white-point-distance dependent correction amount $\Delta CP_B^{W-d}$ is calculated from $\Delta CP_B^{W}$ and the distance $d_W$ so that the white-point-distance dependent correction amount $\Delta CP_B^{W-d}$ is closer to the value of $\Delta CP_B^{W}$ as the corresponding point of the input image data $D_{IN}$ is closer to the white point.

In the present embodiment, the white-point-distance dependent correction amounts $\Delta CP_R^{W-d}$, $\Delta CP_G^{W-d}$ and $\Delta CP_B^{W-d}$ are calculated by the multiplier 49 as the products of the white point correction amounts $\Delta CP_R^{W}$, $\Delta CP_G^{W}$ and $\Delta CP_B^{W}$, respectively, and the value obtained by normalizing the distance $d_W$ with the allowed maximum value $D_{IN}^{MAX}$. Namely, it holds:

$$\Delta CP_R^{W-d}=\Delta CP_R^{W}\times d_W/D_{IN}^{MAX}, \quad (15a)$$

$$\Delta CP_G^{W-d}=\Delta CP_G^{W}\times d_W/D_{IN}^{MAX}, \text{ and} \quad (15b)$$

$$\Delta CP_B^{W-d}=\Delta CP_B^{W}\times d_W/D_{IN}^{MAX}. \quad (15c)$$

The correction amount ΔCP_R is calculated on the basis of the elementary-color-distance dependent correction amount $\Delta CP_R^{ELM-d}$, the complementary-color-distance dependent correction amount $\Delta CP_R^{CMP-d}$ and the white-point-distance dependent correction amount $\Delta CP_R^{W-d}$. In the present embodiment, the correction amount ΔCP_R is calculated by the adder 53 as the sum of the elementary-color-distance dependent correction amount $\Delta CP_R^{ELM-d}$, the complementary-color-distance dependent correction amount $\Delta CP_R^{CMP-d}$ and the white-point-distance dependent correction amount $\Delta CP_R^{W-d}$.
Namely, it holds:

$$\Delta CP_R=\Delta CP_R^{ELM-d}+\Delta CP_R^{CMP-d}+\Delta CP_R^{W-d}. \quad (16a)$$

Correspondingly, the correction amount ΔCP_G is calculated on the basis of the elementary-color-distance dependent correction amount $\Delta CP_G^{ELM-d}$ the complementary-color-distance dependent correction amount $\Delta CP_G^{CMP-d}$ and the white-point-distance dependent correction amount $\Delta CP_G^{W-d}$, and the correction amount ΔCP_B is calculated on the basis of the elementary-color-distance dependent correction amount $\Delta CP_B^{ELM-d}$, the complementary-color-distance dependent correction amount $\Delta CP_B^{CMP-d}$ and the white-point-distance dependent correction amount $\Delta CP_B^{W-d}$. In the present embodiment, the correction amount ΔCP_G is calculated by the adder 53 as the sum of the elementary-color-distance dependent correction amount $\Delta CP_G^{ELM-d}$, the complementary-color-distance dependent correction amount $\Delta CP_G^{CMP-d}$ and the white-point-distance dependent correction amount $\Delta CP_G^{W-d}$, and the correction amount ΔCP_B is calculated as the sum of the elementary-color-distance dependent correction amount $\Delta CP_B^{ELM-d}$, the complementary-color-distance dependent correction amount $\Delta CP_B^{CMP-d}$ and the white-point-distance dependent correction amount $\Delta CP_B^{W-d}$.
Namely, it holds:

$$\Delta CP_G=\Delta CP_G^{ELM-d}+\Delta CP_G^{CMP-d}+\Delta CP_G^{W-d}, \text{ and} \quad (16b)$$

$$\Delta CP_B=\Delta CP_B^{ELM-d}+\Delta CP_B^{CMP-d}+\Delta CP_B^{W-d}, \quad (16b)$$

The correction amounts ΔCP_R, ΔCP_G and ΔCP_B thus calculated are transmitted to the control point data adjustment circuit 33 of the control point data calculation circuit 29.

In the following, a description is given of one specific example of the calculation of the correction amounts ΔCP_R, ΔCP_G and ΔCP_B. FIG. 12B illustrates the initial settings used in this example. Discussed below is the case when the R vertex correction amounts $\Delta CP_R^{R}$, $\Delta CP_G^{R}$ and $\Delta CP_B^{R}$, the Y vertex correction amounts $\Delta CP_R^{Y}$, $\Delta CP_G^{Y}$ and $\Delta CP_B^{Y}$ and the white point correction amounts $\Delta CP_R^{W}$, $\Delta CP_G^{W}$ and $\Delta CP_B^{W}$ are set as illustrated in FIG. 12B. As described above, the R vertex correction amounts $\Delta CP_R^{R}$, $\Delta CP_G^{R}$ and $\Delta CP_B^{R}$ are set to the R vertex correction amount register 43R, and the Y vertex correction amounts $\Delta CP_R^{Y}$, $\Delta CP_G^{Y}$ and $\Delta CP_B^{Y}$ are set to the Y vertex correction amount register 47Y. The white point correction amounts $\Delta CP_R^{W}$, $\Delta CP_G^{W}$ and $\Delta CP_B^{W}$ are set to the white point correction amount register 51.

Additionally, it is assumed in this example that the R, G and B grayscale values $D_{IN}^{R}$, $D_{IN}^{G}$ and $D_{IN}^{B}$ of the input image data $D_{IN}$ are each 8-bit data and therefore the allowed maximum value $D_{IN}^{MAX}$ is 255.

In the case when the R, G and B grayscale values $D_{IN}^{R}$, $D_{IN}^{G}$ and $D_{IN}^{B}$ of the input image data $D_{IN}$ are 200, 130 and 100, respectively, the correction amounts ΔCP_R, ΔCP_G and ΔCP_B are calculated as described below.

Among the R, G and B grayscale values $D_{IN}^{R}$, $D_{IN}^{G}$ and $D_{IN}^{B}$ of the input image data $D_{IN}$, the largest one is the R grayscale values $D_{IN}^{R}$, and the smallest one is the B grayscale value $D_{IN}^{B}$. Area of the corresponding point of the input image data $D_{IN}$ in the color space is the area A1, which is defined by the white point, the R vertex and the Y vertex (see FIG. 3B). The selected elementary color vertex is the R vertex, and the selected complementary color vertex is the Y vertex.

The differences between the R, G and B grayscale values of the selected elementary color vertex (that is, the R vertex) and the R, G and B grayscale values $D_{IN}^{R}$, $D_{IN}^{G}$ and $D_{IN}^{B}$ of the input image data $D_{IN}$ are calculated in accordance with expressions (8a) to (8c) as follows:

$$RGB\text{dist}_R=255-200=55,$$

$$RGB\text{dist}_G=0-130=-130, \text{ and}$$

$$RGB\text{dist}_B=0-100=-100.$$

The differences between the R, G and B grayscale values of the selected complementary color vertex (that is, the Y vertex) and the R, G and B grayscale values $D_{IN}^{R}$, $D_{IN}^{G}$ and $D_{IN}^{B}$ of the input image data $D_{IN}$ are calculated in accordance with expressions (9a) to (9c) as follows:

$$CMY\text{dist}_R=255-200=55,$$

$$CMY\text{dist}_G=255-130=125, \text{ and}$$

$$CMY\text{dist}_B=0-100=-100.$$

The distance $d_{ELM}$ between the selected elementary color vertex and the corresponding point of the input image data $D_{IN}$ is calculated in accordance with expression (10) as follows:

$$d_{ELM}=255-\{55-(-130)\}=70.$$

The distance $d_{CMP}$ between the selected complementary color vertex and the corresponding point of the input image data $D_{IN}$ is calculated in accordance with expression (11) as follows:

$$d_{CMP}=255-\{55-(-100)\}=100.$$

The distance $d_W$ between the white point and the corresponding point of the input image data $D_{IN}$ is calculated in accordance with expression (12) as follows:

$$d_W=100.$$

The white-point-distance dependent correction amounts $\Delta CP_R^{W-d}$, $\Delta CP_G^{W-d}$ and $\Delta CP_B^{W-d}$ are calculated in accordance with expressions (15a) to (15c) as follows:

$$\Delta CP_R^{W-d} = \Delta CP_R^{W} \times d_W / D_{IN}^{MAX}, = 0 \times 100/255 = 0,$$

$$\Delta CP_G^{W-d} = \Delta CP_G^{W} \times d_W / D_{IN}^{MAX}, = -4 \times 100/255 = -1.5, \text{ and}$$

$$\Delta CP_B^{W-d} = \Delta CP_B^{W} \times d_W / D_{IN}^{MAX}, = -8 \times 100/255 = -3.$$

It should be noted that $\Delta CP_R^{W-d}$, $\Delta CP_G^{W-d}$ and $\Delta CP_B^{W-d}$ are each calculated as a 10-bit value and rounded to a value at increments of 0.25.

Also, the elementary-color-distance dependent correction amounts $\Delta CP_R^{ELM-d}$, $\Delta CP_G^{ELM-d}$ and $\Delta CP_B^{ELM-d}$ are calculated in accordance with expressions (13a) to (13c) as follows:

$$\Delta CP_R^{ELM-d} = \Delta CP_R^{R} \times d_{ELM} / D_{IN}^{MAX}, \text{ and } = 0 \times 70/255 = 0,$$

$$\Delta CP_G^{ELM-d} = \Delta CP_G^{R} \times d_{ELM} / D_{IN}^{MAX}, = -10 \times 70/255 = -2.75, \text{ and}$$

$$\Delta CP_B^{ELM-d} = \Delta CP_B^{R} \times d_{ELM} / D_{IN}^{MAX}, = -12 \times 70/255 = -3.25.$$

It should be noted that $\Delta CP_R^{ELM-d}$, $\Delta CP_G^{ELM-d}$ and $\Delta CP_B^{ELM-d}$ are each calculated as a 10-bit value and rounded to a value at increments of 0.25.

Furthermore, the complementary-color-distance dependent correction amounts $\Delta CP_R^{CMP-d}$, $\Delta CP_G^{CMP-d}$ and $\Delta CP_B^{CMP-d}$ are calculated in accordance with expressions (14a) to (14c) as follows:

$$\Delta CP_R^{CMP-d} = \Delta CP_R^{CMP} \times d_{CMP} / D_{IN}^{MAX}, = 0 \times 100/255 = 0,$$

$$\Delta CP_G^{CMP-d} = \Delta CP_G^{CMP} \times d_{CMP} / D_{IN}^{MAX}, = 0 \times 100/255 = 0, \text{ and}$$

$$\Delta CP_B^{CMP-d} = \Delta CP_B^{CMP} \times d_{CMP} / D_{IN}^{MAX}, = -12 \times 100/255 = -4.75.$$

It should be noted that $\Delta CP_R^{CMP-d}$, $\Delta CP_G^{CMP-d}$ and $\Delta CP_B^{CMP-d}$ are each calculated as a 10-bit value and rounded to a value at increments of 0.25.

The correction amounts ΔCP_R, ΔCP_G and ΔCP_B are calculated in accordance with expressions (16a) to (16c) as follows:

$$\Delta CP_R = \Delta CP_R^{ELM-d} + \Delta CP_R^{CMP-d} + \Delta CP_R^{W-d}, = 0,$$

$$\Delta CP_G = \Delta CP_G^{ELM-d} + \Delta CP_G^{CMP-d} + \Delta CP_G^{W-d}, = -4.25, \text{ and}$$

$$\Delta CP_B = \Delta CP_B^{ELM-d} + \Delta CP_B^{CMP-d} + \Delta CP_B^{W-d}, = -11.$$

Step S04:

Referring back to FIG. 11A, the control point data sets CP_R, CP_G and CP_B to be transmitted to the approximate gamma correction circuit 22 are calculated by the control point data adjustment circuit 33 on the basis of the control point data of the control point data set CP_sel determined by the interpolation/selection circuit 32 and the correction amounts ΔCP_R, ΔCP_G and ΔCP_B calculated by the correction amount calculation circuit 28. It should be noted that the correction amounts ΔCP_R, ΔCP_G and ΔCP_B are calculated for each pixel 9 and therefore the correction point data sets CP_R, CP_G and CP_B are also calculated for each pixel 9.

More specifically, the control point data CP0_R to CP5_R of the control point data set CP_R are calculated by adding the correction amount ΔCP_R to the control point data CP0_sel to CP5_sel of the control point data set CP_sel, respectively. Namely, $$CP0_R = CP0_sel + \Delta CP_R,$$
$$CP1_R = CP1_sel + \Delta CP_R,$$
$$CP2_R = CP2_sel + \Delta CP_R,$$
$$CP3_R = CP3_sel + \Delta CP_R,$$
$$CP4_R = CP4_sel + \Delta CP_R, \text{ and}$$
$$CP5_R = CP5_sel + \Delta CP_R, \quad (17)$$

Correspondingly, the control point data CP0_G to CP5_G of the control point data set CP_G are calculated by adding the correction amount ΔCP_G to the control point data CP0_sel to CP5_sel of the control point data set CP_sel, respectively. Namely, $$CP0_G = CP0_sel + \Delta CP_G,$$
$$CP1_G = CP1_sel + \Delta CP_G,$$
$$CP2_G = CP2_sel + \Delta CP_G,$$
$$CP3_G = CP3_sel + \Delta CP_G,$$
$$CP4_G = CP4_sel + \Delta CP_G, \text{ and}$$
$$CP5_G = CP5_sel + \Delta CP_G, \quad (18)$$

Furthermore, the control point data CP0_B to CP5_B of the control point data set CP_B are calculated by adding the correction amount ΔCP_B to the control point data CP0_sel to CP5_sel of the control point data set CP_sel, respectively. Namely, $$CP0_R = CP0_sel + \Delta CP_B,$$
$$CP1_R = CP1_sel + \Delta CP_B,$$
$$CP2_R = CP2_sel + \Delta CP_B,$$
$$CP3_R = CP3_sel + \Delta CP_B,$$
$$CP4_R = CP4_sel + \Delta CP_B, \text{ and}$$
$$CP5_R = CP5_sel + \Delta CP_B, \quad (19)$$

The control point data sets CP_R, CP_G and CP_B thus calculated are transferred to the approximate gamma correction circuit 22.

Step S05:

Digital arithmetic processing is performed on the R, G and B grayscale values $D_{IN}^{R}$, $D_{IN}^{G}$ and $D_{IN}^{B}$ of the input image data $D_{IN}$ of each pixel 9 on the basis of the control point data sets CP_R, CP_G and CP_B to generate the R, G and B grayscale values $D_{OUT}^R$, $D_{OUT}^G$ and $D_{OUT}^B$ of the output image data $D_{OUT}$ associated with each pixel 9. This arithmetic processing is performed by the approximate gamma correction circuits 30R, 30G and 30B of the approximate gamma correction circuit 22.

More specifically, in the digital arithmetic processing in the approximate gamma correction circuit 22 of the present embodiment, the R, G and B grayscale values $D_{OUT}^R$, $D_{OUT}^G$ and $D_{OUT}^B$ of the output image data $D_{OUT}$ are calculated from the R, G and B grayscale values $D_{IN}^B$, $D_{IN}^G$ and $D_{IN}^B$ of the input image data $D_{IN}$ in accordance with the following expressions:

(1) For the case when $D_{IN}^k < D_{IN}^{Center}$ and CP1>CP0, $$D_{OUT}^k = \frac{2(\text{CP1_k} - \text{CP0_k}) \cdot PD_{INS}^k}{K^2} + \frac{(\text{CP3_k} - \text{CP0_k})D_{INS}^k}{K} + \text{CP0_k} \tag{20a}$$

(2) for the case when $D_{IN}^k < D_{in}^{Center}$ and CP1≤CP0, $$D_{OUT}^k = \frac{2(\text{CP1_k} - \text{CP0_k}) \cdot ND_{INS}^k}{K^2} + \frac{(\text{CP3_k} - \text{CP0_k})D_{INS}^k}{K} + \text{CP0_k} \tag{20b}$$

and (3) for the case when $D_{IN}^k > D_{IN}^{Center}$, $$D_{OUT}^k = \frac{2(\text{CP4_k} - \text{CP2_k}) \cdot ND_{INS}^k}{K^2} + \frac{(\text{CP5_k} - \text{CP2_k})D_{INS}^k}{K} + \text{CP2_k} \tag{20c}$$

It should be noted that the index k is any of "R", "G" and "B".

In the above, the intermediate data value $D_{IN}^{Center}$ is defined by the following expression (20d)

$$D_{IN}^{Center} = D_{IN}^{MAX}/2 \tag{20d}$$

where $D_{IN}^{MAX}$ is the allowed maximum value of the R, G and B grayscale values $D_{IN}^R$, $D_{IN}^G$ and $D_{IN}^B$ of the input image data $D_{IN}$. K is the parameter defined by the above-described expression (3); K is given as follows:

$$K = (D_{IN}^{MAX} + 1)/2.$$

Furthermore, $D_{INS}^k$, $PD_{INS}^k$ and $ND_{INS}^k$ in expressions (20a) to (20c) are values defined as follows:

(a) $D_{INS}^k$ $D_{INS}^k$ is a value determined depending on the grayscale value $D_{IN}^k$ (the R, G and B grayscale values $D_{IN}^R$, $D_{IN}^G$ and $D_{IN}^B$) of the input image data $D_{IN}$ and given by the following expression:

$$D_{INS}^k D_{IN}^k \text{ (for } D_{IN}^k < D_{IN}^{Center})$$

$$D_{INS}^k = D_{IN}^k + 1 - K \text{ (for } D_{IN}^k > D_{IN}^{Center}) \tag{21}$$

(b) $PD_{INS}^k$ $PD_{INS}^k$ is defined by expression (22a) with a parameter $R^k$ defined by expression (22b) as follows:

$$PD_{INS}^k = (K - R^k) \cdot R^k \tag{22a}$$

$$R^k = K^{1/2} \cdot (D_{INS}^k)^{1/2} \tag{22b}$$

As understood from expressions (22a) and (22b), the parameter $R^k$ is a value proportional to a square root of the grayscale value $D_{IN}^k$ and therefore $PD_{INS}^k$ is a value calculated by an expression including a term proportional to a square root of the grayscale value $D_{IN}^k$ and a term proportional to the grayscale value $D_{IN}^k$ to the power of one.

(C) $ND_{INS}^k$ $ND_{INS}$ is given by the following expression (23):

$$ND_{INS}^k = (K - D_{INS}^k) \cdot D_{INS}^k \tag{23}$$

As understood from expressions (21) and (23), $ND_{INS}^k$ is a value calculated by an expression including a term proportional to a square of the grayscale value $D_{IN}^k$ of the input image data $D_{IN}$.

Figure 13:
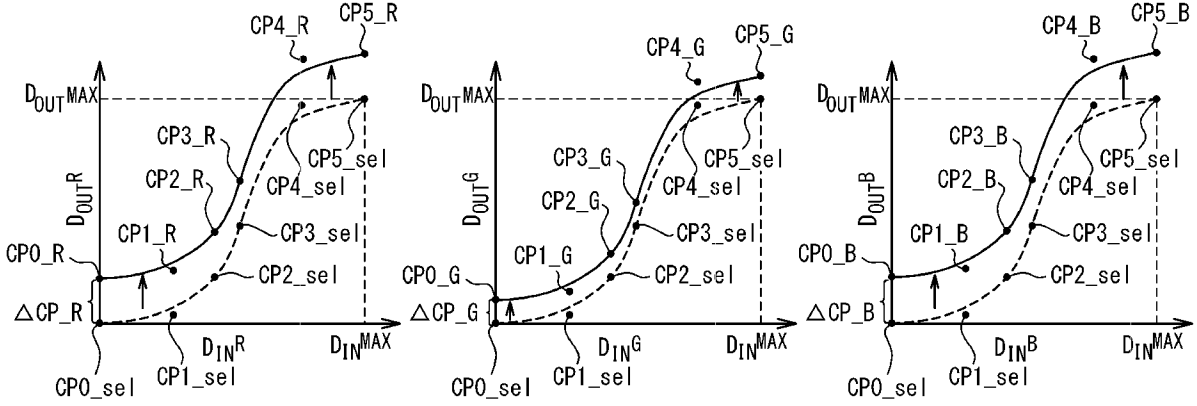
FIG. 13 is a graph illustrating the relation between R, G and B grayscale values of input image data $D_{IN}$ and those of output image data $D_{OUT}$.

FIG. 13 is a graph illustrating the relations between the R, G and B grayscale values $D_{IN}^R$, $D_{IN}^G$ and $D_{IN}^B$ of the input image data $D_{IN}$ and the R, G and B grayscale values $D_{OUT}^R$, $D_{OUT}^G$ and $D_{OUT}^B$ of the output image data $D_{OUT}$ in the case when the R, G and B grayscale values $D_{OUT}^R$, $D_{OUT}^G$ and $D_{OUT}^B$ of the output image data $D_{OUT}$ are calculated in accordance with the above-described arithmetic processing.

The control point data CP0_sel to CP5_sel are determined to make the input-output curve approximate to the gamma curve of the gamma value γ_VALUE. The control point data CP0_R to CP5_R used for the calculation of the R grayscale value $D_{OUT}^R$ of the output image data $D_{OUT}$ are calculated by adding the correction amount ΔCP_R to the control point data CP0_sel to CP5_sel thus determined for color adjustment. The R grayscale value $D_{OUT}^R$ of the output image data $D_{OUT}$ is calculated from the R grayscale value $D_{IN}^R$ of the input image data $D_{IN}$ in accordance with the input-output curve with the shape specified by the control point data CP0_R to CP5_R.

Correspondingly, the control point data CP0_G to CP5_G used for the calculation of the G grayscale value $D_{OUT}^G$ of the output image data $D_{OUT}$ are calculated by adding the correction amount ΔCP_G to the control point data CP0_sel to CP5_sel for color adjustment. The G grayscale value $D_{OUT}^G$ of the output image data $D_{OUT}$ is calculated from the G grayscale value $D_{IN}^G$ of the input image data $D_{IN}$ in accordance with the input-output curve with the shape specified by the control point data CP0_G to CP5_G. Furthermore, the control point data CP0_B to CP5_B used for the calculation of the B grayscale value $D_{OUT}^B$ of the output image data $D_{OUT}$ are calculated by adding the correction amount ΔCP_B to the control point data CP0_sel to CP5_sel for color adjustment. The B grayscale value $D_{OUT}^B$ of the output image data $D_{OUT}$ is calculated from the B grayscale value $D_{IN}^B$ of the input image data $D_{IN}$ in accordance with the input-output curve with the shape specified by the control point data CP0_B to CP5_B.

The output image data $D_{OUT}$, which are calculated by the approximate gamma correction circuit 22 in accordance with the expressions described above, are transmitted to the color reduction circuit 23. In the color reduction circuit 23, color reduction is performed on the output image data $D_{OUT}$ to generate the color-reduced image data $D_{OUT_D}$. The color-reduced image data $D_{OUT_D}$ are transmitted to the data line drive circuit 26 via the latch circuit 24 and the data lines 8 of the liquid crystal display panel 2 are driven in response to the color-reduced image data $D_{OUT_D}$.

The above-described digital arithmetic processing of the present embodiment allows concurrently performing gamma correction and color adjustment with a reduced circuit size.

(Calculation of Correction Amounts for Respective Elementary Color Vertices, Complementary Color Vertices and White Point)

In the following, a description is given of an exemplary calculation method of the R vertex correction amounts $\Delta CP_R^R$, $\Delta CP_G^R$, $\Delta CP_B^R$, the G vertex correction amounts $\Delta CP_R^G$, $\Delta CP_G^G$, $\Delta CP_B^G$, the B vertex correction amounts $\Delta CP_R^B$, $\Delta CP_G^B$, $\Delta CP_B^B$, the C vertex correction amounts $\Delta CP_R^C$, $\Delta CP_G^C$, $\Delta CP_B^C$, the M vertex correction amounts $\Delta CP_R^M$, $\Delta CP_G^M$, $\Delta CP_B^M$, the Y vertex correction amounts $\Delta CP_R^Y$, $\Delta CP_G^Y$, $\Delta CP_B^Y$ and the white point correction amounts $\Delta CP_R^W$, $\Delta CP_G^W$, $\Delta CP_B^W$. It should be noted that these correction amounts are respectively set in the R vertex correction amount register 43R, the G vertex correction amount register 43G, the B vertex correction amount register 43B, the C vertex correction amount register 47C, the M vertex correction amount register 47M, the Y vertex correction amount register 47Y and the white point correction amount register 51.

The R vertex correction amounts $\Delta CP_R^R$, $\Delta CP_G^R$, $\Delta CP_B^R$ are values to be set as the correction amounts ΔCP_R, ΔCP_G, ΔCP_B in the case when the corresponding point of the input image data $D_{IN}$ coincides with the R vertex in the color space. As understood from the above-described operation, in the case when the corresponding point of the input image data $D_{IN}$ coincides with the R vertex in the color space, the control point data CP0_R to CP5_R, which are finally used for the digital arithmetic processing of the input image data $D_{IN}$, are calculated by adding the correction amount $\Delta CP_R^R$ to the control point data CP0_sel to CP5_sel, which are determined on the basis of the gamma value γ_VALUE. Correspondingly, the control point data CP0_G to CP5_G are calculated by adding the correction amount $\Delta CP_G^R$ to the control point data CP0_sel to CP5_sel, and the control point data CP0_B to CP5_B are calculated by adding the correction amount $\Delta CP_B^R$ to the control point data CP0_sel to CP5_sel.

Correspondingly, the G vertex correction amounts $\Delta CP_R^G$, $\Delta CP_G^G$, $\Delta CP_B^G$ are values to be set as the correction amounts ΔCP_R, ΔCP_G, ΔCP_B in the case when the corresponding point of the input image data $D_{IN}$ coincides with the G vertex in the color space, and the B vertex correction amounts $\Delta CP_R^B$, $\Delta CP_G^B$, $\Delta CP_B^B$ are values to be set as the correction amounts ΔCP_R, ΔCP_G, ΔCP_B in the case when the corresponding point of the input image data $D_{IN}$ coincides with the B vertex in the color space. Furthermore, the C vertex correction amounts $\Delta CP_R^C$, $\Delta CP_G^C$, $\Delta CP_B^C$ are values to be set as the correction amounts ΔCP_R, ΔCP_G, ΔCP_B in the case when the corresponding point of the input image data $D_{IN}$ coincides with the C vertex in the color space, and the M vertex correction amounts $\Delta CP_R^M$, $\Delta CP_G^M$, $\Delta CP_B^M$ are values to be set as the correction amounts ΔCP_R, ΔCP_G, ΔCP_B in the case when the corresponding point of the input image data $D_{IN}$ coincides with the M vertex in the color space. Finally, the Y vertex correction amounts $\Delta CP_R^Y$, $\Delta CP_G^Y$, $\Delta CP_B^Y$ are values to be set as the correction amounts ΔCP_R, ΔCP_G, ΔCP_B in the case when the corresponding point of the input image data $D_{IN}$ coincides with the Y vertex in the color space, and the white point correction amounts $\Delta CP_R^W$, $\Delta CP_G^W$, $\Delta CP_B^W$ are values to be set as the correction amounts ΔCP_R, ΔCP_G, ΔCP_B in the case when the corresponding point of the input image data $D_{IN}$ coincides with the white point in the color space.

The R vertex correction amounts $\Delta CP_R^R$, $\Delta CP_G^B$, $\Delta CP_B^R$, the G vertex correction amounts $\Delta CP_R^G$, $\Delta CP_G^G$, $\Delta CP_B^G$, the B vertex correction amounts $\Delta CP_R^B$, $\Delta CP_G^B$, $\Delta CP_B^B$, the C vertex correction amounts $\Delta CP_R^C$, $\Delta CP_G^C$, $\Delta CP_B^C$, the M vertex correction amounts $\Delta CP_R^M$, $\Delta CP_G^M$, $\Delta CP_B^M$, the Y vertex correction amounts $\Delta CP_R^Y$, $\Delta CP_G^Y$, $\Delta CP_B^Y$ and the white point correction amounts $\Delta CP_R^W$, $\Delta CP_G^W$, $\Delta CP_B^W$ are determined on the basis of the display characteristics of the liquid crystal display panel 2 (the panel characteristics) so that a desired color gamut is achieved by the color adjustment.

Figure 14:
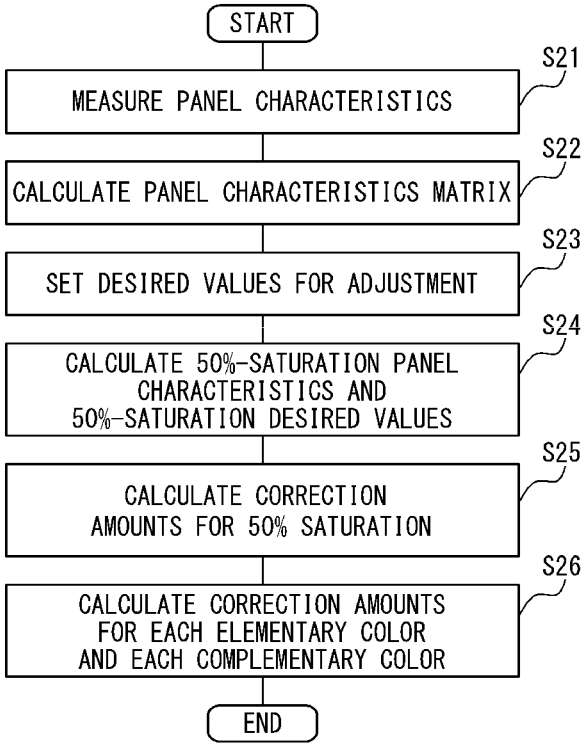
FIG. 14 is a flowchart illustrating an exemplary calculation procedure of correction amounts for the white point and the vertices corresponding to the respective elementary colors and complementary colors.

FIG. 14 is a flowchart illustrating an exemplary procedure of the calculation of the correction amounts for the vertices corresponding to the respective elementary colors and complementary colors and the white point.

Step S21:

The panel characteristics of the liquid crystal display panel 2 are measured. More specifically, the chromaticity coordinates of the white point, the R, G, B, C, M and Y vertices are measured with respect to the liquid crystal display panel 2. The chromaticity coordinates of the white point can be obtained by performing a color measurement with respect to an image corresponding to input image data $D_{IN}$ in which the R, G and B grayscale values are set to the allowed maximum value (in the present embodiment, 255) for all the pixels.

The chromaticity coordinates of the R vertex can be obtained by performing a color measurement with respect to an image corresponding to input image data $D_{IN}$ in which the R grayscale value is set to the allowed maximum value (255 in the present embodiment) for all the pixels and the G and B grayscale values are set to zero for all the pixels. Correspondingly, the chromaticity coordinates of the G vertex can be obtained by performing a color measurement with respect to an image corresponding to input image data $D_{IN}$ in which the G grayscale value is set to the allowed maximum value for all the pixels and the B and R grayscale values are set to zero for all the pixels, and the chromaticity coordinates of the B vertex can be obtained by performing a color measurement with respect to an image corresponding to input image data $D_{IN}$ in which the B grayscale value is set to the allowed maximum value for all the pixels and the R and G grayscale values are set to zero for all the pixels.

Furthermore, the chromaticity coordinates of the C vertex can be obtained by performing a color measurement with respect to an image corresponding to input image data $D_{IN}$ in which the G and B grayscale values are set to the allowed maximum value for all the pixels and the R grayscale value is set to zero for all the pixels. Correspondingly, the chromaticity coordinates of the M vertex can be obtained by performing a color measurement with respect to an image corresponding to input image data $D_{IN}$ in which the B and R grayscale values are set to the allowed maximum value for all the pixels and the G grayscale value is set to zero for all the pixels, and the chromaticity coordinates of the Y vertex can be obtained by performing a color measurement with respect to an image corresponding to input image data $D_{IN}$ in which the R and G grayscale values are set to the allowed maximum value for all the pixels and the B grayscale value is set to zero for all the pixels.

FIG. 15A is a table illustrating one example of the measurement result of the panel characteristics obtained at step S21. In the present embodiment, the measured chromaticity coordinates of the white point (WP), the R, G, B, C, M and Y vertices are represented by the chromaticity coordinates (u', v') defined in a CIE 1976 UCS chromaticity diagram.

Step S22:

A transformation matrix for obtaining R, G and B grayscale values corresponding to a chromaticity coordinates (X, Y, Z) with respect to the liquid crystal display panel 2, which may be referred to as "panel characteristics transformation matrix", hereinafter, is calculated from the measurement result of the panel characteristics obtained at step S21. The panel characteristics transformation matrix is calculated from the measured chromaticity coordinates (u', v') of the white point (WP) and the R, G and B vertices.

First, the chromaticity coordinates (x, y) of the white point (WP) and the R, G and B vertices are calculated by performing a transformation from the chromaticity coordinates (u', v') to (x, y). FIG. 15B is a table illustrating the result of the transformation from the chromaticity coordinates (u', v') to (x, y) for the measured chromaticity coordinates of the white point (WP), the R, G, B, C, M and Y vertices illustrated in FIG. 15A.

As known in the art, the matrix describing the chromaticity coordinates (X, Y, Z) of the color displayed on a display device for a given set of R, G and B grayscale values is given as follows:

$$\begin{pmatrix} X \\ Y \\ Z \end{pmatrix} = \begin{pmatrix} rRx/Ry & gGx/Gy & bBx/By \\ r & g & b \\ rRz/Ry & gGz/Gy & bBz/By \end{pmatrix} \begin{pmatrix} R \\ G \\ B \end{pmatrix} \tag{24}$$

where (Rx, Ry, Rz) are the chromaticity coordinates (x, y, z) of the R vertex of the display device, (Gx, Gy, Gz) are the chromaticity coordinates (x, y, z) of the G vertex and (Bx, By, Bz) are the chromaticity coordinates (x, y, z) of the B vertex. It should be noted that the following holds:

$$Rz=1-Rx-Ry,$$

$$Gz=1-Gx-Gy, \text{ and}$$

$$Bz=1-Bx-By,$$

from the definition of the chromaticity coordinates (x, y, z).

The coefficients r, g and b are obtained as the solutions of the following simultaneous equations:

$$\begin{pmatrix} Rx/Ry & Gx/Gy & Bx/By \\ 1 & 1 & 1 \\ Rz/Ry & Gz/Gy & Bz/By \end{pmatrix} \begin{pmatrix} r \\ g \\ b \end{pmatrix} = \begin{pmatrix} Wx/Wy \\ 1 \\ Wz/Wy \end{pmatrix} \tag{25}$$

where (Wx, Wy, Wz) is the chromaticity coordinates (x, y, z) of the white point.

It should be noted that it holds:

$$Wz=1-Wx-Wy.$$

The panel characteristics transformation matrix is obtained with the inverse matrix of the matrix described on the right side of expression (24) as follows:

$$\begin{pmatrix} R \\ G \\ B \end{pmatrix} = \begin{pmatrix} rRx/Ry & gGx/Gy & bBx/By \\ r & g & b \\ rRz/Ry & gGz/Gy & bBz/By \end{pmatrix}^{-1} \begin{pmatrix} X \\ Y \\ Z \end{pmatrix} \tag{26}$$

By calculating the specific values of the respective elements of expression (25) for the chromaticity coordinates of the white point (WP), and the R, G and B vertices illustrated in FIG. 15B, the following is obtained:

$$\begin{pmatrix} 1.899 & 0.535 & 2.908 \\ 1 & 1 & 1 \\ 0.069 & 0.128 & 14.208 \end{pmatrix} \begin{pmatrix} r \\ g \\ b \end{pmatrix} = \begin{pmatrix} 0.960 \\ 1 \\ 1.044 \end{pmatrix} \tag{27}$$

The coefficients r, g and b are obtained from the simultaneous equations (27) as follows:

$$r=0.197,$$

$$g=0.737, \text{ and}$$

$$b=0.066.$$

With respect to the panel characteristics illustrated in FIGS. 15A and 15B, the panel characteristics transformation matrix is finally obtained from the obtained coefficients r, g and b and expression (26) as follows:

$$\begin{pmatrix} R \\ G \\ B \end{pmatrix} = \begin{pmatrix} 3.700 & -1.900 & -0.623 \\ -0.992 & 1.879 & 0.071 \\ 0.046 & -0.161 & 1.070 \end{pmatrix} \begin{pmatrix} X \\ Y \\ Z \end{pmatrix} \tag{28}$$

Step S23:

Desired values of the chromaticity coordinates of the white point and the R, G, B, C, M and Y vertices are determined in accordance with a desired color gamut. When the desired color gamut is determined in accordance with the sRGB standard, for example, the desired values of the chromaticity coordinates (u', v') of the white point and the R, G, B, C, M and Y vertices are determined as illustrated in FIG. 16.

It should be noted that the actually achievable color gamut depends on the characteristics of the liquid crystal display panel and therefore the desired values set at step S23 may be unachievable. To address this, in the present embodiment, the correction amounts ΔCP_R, ΔCP_G and ΔCP_B are determined so that the chromaticity coordinates at which the saturations of the respective elementary colors and complementary colors are 50% with respect to the panel characteristics of the liquid crystal display panel 2 (hereinafter, referred to as "500-saturation panel characteristics values") coincide with the desired values determined so that the saturations of the respective elementary colors and complementary colors are 50% (hereinafter, referred to as "50%-saturation desired values"). At steps S24 to S26 described below, the correction amounts ΔCP_R, ΔCP_G and ΔCP_B are calculated so that the 50%-saturation panel characteristics values of the respective elementary colors and complementary colors of the liquid crystal display panel 2 coincide with the 50%-saturation desired values of the respective elementary colors and complementary colors. It should be noted that, with respect to the white point, the correction amounts ΔCP_R, ΔCP_G and ΔCP_B are calculated so that the chromaticity coordinates of the white point for the panel characteristics of the liquid crystal display panel 2 coincide with the desired values of the chromaticity coordinates of the white point.

Step S24:

The 50%-saturation panel characteristics values of the respective elementary colors and complementary colors of the liquid crystal display panel 2 and the 50%-saturation desired values of the respective elementary colors and complementary colors are calculated.

The 50%-saturation panel characteristics values of the respective elementary colors and complementary colors of the liquid crystal display panel 2 are calculated as the average values of the measured chromaticity coordinates (u', v') of the respective elementary colors and complementary colors and the measured chromaticity coordinates (u', v') of the white point. More specifically, the 50%-saturation panel characteristics values of the elementary color R is calculated as the average value of the measured chromaticity coordinates (u', v') of the R vertex and the measured chromaticity coordinates (u', v') of the white point. With respect to the measurement result of the panel characteristics illustrated in FIG. 15A, for example, the measured chromaticity coordinates (u', v') of the R vertex are (0.444, 0.526) and the measured chromaticity coordinates (u', v') of the white point are (0.201, 0.471). Accordingly, as illustrated in FIG. 17A, the 50%-saturation panel characteristics values of the elementary color R are calculated as (0.322, 0.499).

Correspondingly, the 50%-saturation panel characteristics values of the elementary color G is calculated as the average value of the measured chromaticity coordinates (u', v') of the G vertex and the measured chromaticity coordinates (u', v') of the white point, and the 50%-saturation panel characteristics values of the elementary color B is calculated as the average value of the measured chromaticity coordinates (u', v') of the B vertex and the measured chromaticity coordinates (u', v') of the white point.

Furthermore, the 50%-saturation panel characteristics values of the complementary color C is calculated as the average value of the measured chromaticity coordinates (u', v') of the C vertex and the measured chromaticity coordinates (u', v') of the white point. Correspondingly, the 50%-saturation panel characteristics values of the complementary color M is calculated as the average value of the measured chromaticity coordinates (u', v') of the M vertex and the measured chromaticity coordinates (u', v') of the white point, and the 50%-saturation panel characteristics values of the complementary color Y is calculated as the average value of the measured chromaticity coordinates (u', v') of the Y vertex and the measured chromaticity coordinates (u', v') of the white point.

FIG. 17A illustrates the 50%-saturation panel characteristics values of the respective elementary colors and complementary colors calculated for the measurement result of the panel characteristics illustrated in FIG. 15A. It should be noted that, for the white point, the measurement result obtained at step S21 are illustrated again in FIG. 17A.

The 50%-saturation desired values of the respective elementary colors and respective complementary colors are calculated as the average values of the desired values of the chromaticity coordinates (u', v') of the respective elementary colors and complementary colors and the desired values of the chromaticity coordinates (u', v') of the white point. More specifically, the 50%-saturation desired values of the elementary color R are calculated as the average values of the desired values of the chromaticity coordinates (u', v') of the R vertex and the desired values of the chromaticity coordinates (u', v') of the white point. With respect to the desired values illustrated in FIG. 16, for example, the desired values of the chromaticity coordinates (u', v') of the R vertex are (0.452, 0.523) and the desired values of the chromaticity coordinates (u', v') of the white point are (0.198, 0.468). Accordingly, as illustrated in FIG. 17B, 50%-saturation desired values of the elementary color R are calculated as (0.324, 0.496).

Correspondingly, the 50%-saturation desired values of the elementary color G are calculated as the average values of the desired values of the chromaticity coordinates (u', v') of the G vertex and the desired values of the chromaticity coordinates (u', v') of the white point, and the 50%-saturation desired values of the elementary color B are calculated as the average values of the desired values of the chromaticity coordinates (u', v') of the B vertex and the desired values of the chromaticity coordinates (u', v') of the white point.

Furthermore, the 50%-saturation desired values of the complementary color C are calculated as the average values of the desired values of the chromaticity coordinates (u', v') of the C vertex and the desired values of the chromaticity coordinates (u', v') of the white point. Correspondingly, the 50%-saturation desired values of the complementary color M are calculated as the average values of the desired values of the chromaticity coordinates (u', v') of the M vertex and the desired values of the chromaticity coordinates (u', v') of the white point, and the 50%-saturation desired values of the complementary color Y are calculated as the average values of the desired values of the chromaticity coordinates (u', v') of the Y vertex and the desired values of the chromaticity coordinates (u', v') of the white point.

FIG. 17B illustrates the 50%-saturation desired values of the respective elementary colors and complementary colors calculated in the case when the desired values of the respective elementary colors and complementary colors are set as illustrated in FIG. 16. It should be noted that, for the white point, the desired values are illustrated again in FIG. 17B.

Step S25:

Correction amounts of the R, G and B grayscale values are calculated for the 50% saturation. More strictly, calculated at step S25 are correction amounts determined for correcting R, G and B grayscale values of input image data corresponding to the 50% saturations of the respective elementary colors and complementary colors so that the colors corresponding to the 50%-saturation desired values of the respective elementary colors and complementary colors are actually displayed on the liquid crystal display panel 2. It should be noted that, for the white point, correction amounts are determined for correcting R, G and B grayscale values of input image data corresponding to the white point so that the color corresponding to the desired values of the white point are actually displayed on the liquid crystal display panel 2.

The correction amounts for 50% saturation are calculated as follows: First, transformation from chromaticity coordinates (u', v') to chromaticity coordinates (X, Y, Z) are performed on the 50%-saturation panel characteristics values of the respective elementary colors and complementary colors of the liquid crystal display panel 2 and the measured chromaticity coordinates of the white point. The transformation from chromaticity coordinates (u', v') to chromaticity coordinates (X, Y, Z) can be achieved by performing transformation from chromaticity coordinates (u', v') to (x, y) and further performing transformation from chromaticity coordinates (x, y) to (X, Y, Z).

FIG. 18A illustrates the result of transformation from chromaticity coordinates (u', v') to (x, y) for the 50%-saturation panel characteristics values of the respective elementary colors and complementary colors and the measured chromaticity coordinates of the white point illustrated in FIG. 17A, and FIG. 18C illustrates the result of further transformation to chromaticity coordinates (X, Y, Z).

Similarly, transformations from chromaticity coordinates (u', v') to (x, y) and from (x, y) to (X, Y, Z) are performed on the 50%-saturation desired values of the respective elementary colors and complementary colors and the desired values of the chromaticity coordinates of the white point.

FIG. 18B illustrates the result of transformation from chromaticity coordinates (u', v') to (x, y) for the 50%-saturation desired values of the respective elementary colors and complementary colors and the desired values of the chromaticity coordinates of the white point illustrated in FIG. 17B, and FIG. 18D illustrates the result of further transformation to chromaticity coordinates (X, Y, Z).

by applying the transformation matrix given by expression (26) to the 50%-saturation panel characteristics values of the respective elementary colors and complementary colors of the liquid crystal display panel 2 represented in the form of chromaticity coordinates (X, Y, Z), it is possible to obtain the ratio among the R, G and B grayscale values corresponding to the 50%-saturation panel characteristics values of the respective elementary colors and complementary colors of the liquid crystal display panel 2. In the case when the values of the respective elements of the transformation matrix are given by expression (28) and the 50%-saturation panel characteristics values of the respective elementary colors and complementary colors of the liquid crystal display panel 2 and the measured chromaticity coordinates (X, Y, Z) of the white point are given as illustrated in FIG. 18C, the ratio among the R, G and B grayscale values corresponding to the 50%-saturation panel characteristics values of the respective elementary colors and complementary colors are calculated as illustrated in FIG. 19A.

Furthermore, by applying the transformation matrix given by expression (26) to the 50%-saturation desired values of the respective elementary colors and complementary colors and the desired values of the chromaticity coordinates of the white point represented in the form of chromaticity coordinates (X, Y, Z), it is possible to obtain the ratio among the R, G and B grayscale values of the 50%-saturation desired values of the respective elementary colors and complementary colors and the desired values of the white point. In the case when the values of the respective elements of the transformation matrix are given by expression (28) and the 50%-saturation desired values of the respective elementary colors and complementary colors and the desired values of the chromaticity coordinates (X, Y, Z) of the white point are given as illustrated in FIG. 18D, the ratio among the R, G and B grayscale values corresponding to the 50%-saturation desired values of the respective elementary colors and complementary colors and the desired values of the chromaticity coordinates of the white point are calculated as illustrated in FIG. 19B.

The R, G and B grayscale values corresponding to the 50%-saturation panel characteristics values of the respective elementary colors and complementary colors of the liquid crystal display panel 2 are calculated by normalizing the thus-calculated ratio among the R, G and B grayscale values corresponding to the 50%-saturation panel characteristics values of the respective elementary colors and complementary colors of the liquid crystal display panel 2 with a specific value (for example, the allowed maximum value $D_{IN}^{MAX}$ of the R, G and B grayscale values). FIG. 19C illustrates the R, G and B grayscale values normalized with the allowed maximum values $D_{IN}^{MAX}$ (=255) for the case when the ratio among the R, G and B grayscale values corresponding to the 50%-saturation panel characteristics values of the respective elementary colors and complementary colors and the white point of the liquid crystal display panel 2 are given as illustrated in FIG. 19A.

Correspondingly, the R, G and B grayscale values corresponding to the 50%-saturation desired values of the respective elementary colors and complementary colors and the desired values of the chromaticity coordinates of the white point of are calculated by normalizing the thus-calculated ratio among the R, G and B grayscale values corresponding to the 50%-saturation desired values of the respective elementary colors and complementary colors and the desired values of the chromaticity coordinates of the white point with a specific value (for example, the allowed maximum value $D_{IN}^{MAX}$ of the R, G and B grayscale values). FIG. 19D illustrates the R, G and B grayscale values normalized with the allowed maximum values $D_{IN}^{MAX}$ (=255) for the case when the ratio among the R, G and B grayscale values corresponding to the 50%-saturation desired values of the respective elementary colors and complementary colors and the desired values of the chromaticity coordinates of the white point are given as illustrated in FIG. 19B.

The correction amounts of the R, G and B grayscale values for 50% saturation are respectively calculated as the differences between the R, G and B grayscale values corresponding to the 50%-saturation panel characteristics values of the respective elementary colors and complementary colors of the liquid crystal display panel 2 and those corresponding to the 50%-saturation desired values of the respective elementary colors and complementary colors.

Also, the correction amounts of the R, G and B grayscale values for the white point are respectively calculated as the differences between the R, G and B grayscale values of the white point of the liquid crystal display panel 2 and the R, G and B grayscale values corresponding to the desired values of the chromaticity coordinates of the white point. The correction amounts of the R, G and B grayscale values for the white point thus obtained are used as the white point correction amounts $\Delta CP_R^W$, $\Delta CP_G^W$ and $\Delta CP_B^W$. The obtained white point correction amounts $\Delta CP_R^W$, $\Delta CP_G^W$ and $\Delta CP_B^W$ are stored in advance in the white point correction amount register 51.

FIG. 20A illustrates the correction amounts of R, G and B grayscale values for 50% saturation and the correction amounts of the white point in the case when the R, G and B grayscale values corresponding to the 50%-saturation panel characteristics values of the respective elementary colors and complementary colors of the liquid crystal display panel 2 are given as illustrated in FIG. 19C and the R, G and B grayscale values corresponding to the 50%-saturation desired values of the respective elementary colors and complementary colors and the desired values of the chromaticity coordinates of the white point are given as illustrated in FIG. 19D.

Step S26:

The correction amounts ΔCP_R, ΔCP_G and ΔCP_B for the vertices corresponding to the respective elementary colors and complementary colors (that is, the points at which the saturations of the respective elementary colors and complementary colors are 100%) are calculated. The correction amounts ΔCP_R, ΔCP_G and ΔCP_B for the vertices corresponding to the respective elementary colors and complementary colors are calculated through linear extrapolation of the correction amounts of the R, G and B grayscale values for the white point (that is, the point at which the saturations of all the elementary colors and complementary colors are 0%) and the correction amounts of the R, G and B grayscale values for 50% saturations of the respective elementary colors and complementary colors.

It should be noted that the control point data CP0 and CP5, which indicate the positions of the end points of the input-output curves of R, G and B grayscale values, are data specifying the positions of the vertices corresponding to the elementary colors and complementary colors with R, G and B grayscale values, while the correction amounts ΔCP_R, ΔCP_G and ΔCP_B are added to the control point data CP0_sel and CP5_sel determined on the gamma value γ_VALUE. Accordingly, the correction amounts ΔCP_R, ΔCP_G and ΔCP_B for the respective vertices are to be determined as such correction amounts of R, G and B grayscale values that the 50%-saturation panel characteristics values coincide with the 50%-saturation desired values.

For example, the R vertex correction amounts $\Delta CP_R^R$, $\Delta CP_G^R$ and $\Delta CP_B^R$ are calculated in accordance with the following expression (29a):

$$\Delta CP_R^R = \frac{D_{IN}^{MAX} \cdot (\Delta R_{R50} - \Delta CP_R^W)}{\min(R_{R50}, G_{R50}, B_{R50})} + \Delta CP_R^W \tag{29a}$$

$$\Delta CP_G^R = \frac{D_{IN}^{MAX} \cdot (\Delta G_{R50} - \Delta CP_G^W)}{\min(R_{R50}, G_{R50}, B_{R50})} + \Delta CP_G^W$$

$$\Delta CP_B^R = \frac{D_{IN}^{MAX} \cdot (\Delta B_{R50} - \Delta CP_B^W)}{\min(R_{R50}, G_{R50}, B_{R50})} + \Delta CP_B^W$$

where $\Delta R_{R50}$ is the correction amount of the R grayscale value for the elementary color R which is calculated for 50% saturation at step S25, $\Delta G_{R50}$ is the correction amount of the G grayscale value for the elementary color R which is calculated for 50% saturation at step S25, and $\Delta B_{R50}$ is the correction amount of the B grayscale value for the elementary color R which is calculated for 50% saturation at step S25. $R_{R50}$ is the R grayscale value of the 50%-saturation panel characteristics values of the elementary color R calculated at step S25, $G_{R50}$ is the G grayscale value of the 50%-saturation panel characteristics values of the elementary color R and $B_{R50}$ is the B grayscale value of the 50%-saturation panel characteristics values of the elementary color R. min (a, b, c) is the minimum value of a, b and c.

The R vertex correction values $\Delta CP_R^R$, $\Delta CP_G^R$ and $\Delta CP_B^R$ thus obtained are stored in advance in the R vertex correction amount register 43R.

Also, the G vertex correction amounts $\Delta CP_R^G$, $\Delta CP_G^G$ and $\Delta CP_B^G$ are calculated in accordance with the following expression (29b):

$$\Delta CP_R^G = \frac{D_{IN}^{MAX} \cdot (\Delta R_{G50} - \Delta CP_R^W)}{\min(R_{G50}, G_{G50}, B_{G50})} + \Delta CP_R^W \tag{29b}$$

$$\Delta CP_G^G = \frac{D_{IN}^{MAX} \cdot (\Delta G_{G50} - \Delta CP_G^W)}{\min(R_{G50}, G_{G50}, B_{G50})} + \Delta CP_G^W$$

$$\Delta CP_B^G = \frac{D_{IN}^{MAX} \cdot (\Delta B_{G50} - \Delta CP_B^W)}{\min(R_{G50}, G_{G50}, B_{G50})} + \Delta CP_B^W$$

where $\Delta R_{G50}$ is the correction amount of the R grayscale value for the elementary color G which is calculated for 50% saturation at step S25, $AG_{G50}$ is the correction amount of the G grayscale value for the elementary color G which is calculated for 50% saturation at step S25, and $AB_{G50}$ is the correction amount of the B grayscale value for the elementary color G which is calculated for 50% saturation at step S25. $R_{R50}$ is the R grayscale value of the 50%-saturation panel characteristics values of the elementary color G calculated at step S25, $G_{G50}$ is the G grayscale value of the 50%-saturation panel characteristics values of the elementary color G, and $B_{G50}$ is the B grayscale value of the 50%-saturation panel characteristics values of the elementary color G.

The G vertex correction values $\Delta CP_R^G$, $\Delta CP_G^G$ and $\Delta CP_B^G$ thus obtained are stored in advance in the G vertex correction amount register 43G.

Also, the B vertex correction amounts $\Delta CP_R^B$, $\Delta CP_G^B$ and $\Delta CP_B^B$ are calculated in accordance with the following expression (29c):

$$\Delta CP_R^B = \frac{D_{IN}^{MAX} \cdot (\Delta R_{B50} - \Delta CP_R^W)}{\min(R_{B50}, G_{B50}, B_{B50})} + \Delta CP_R^W \tag{29c}$$

$$\Delta CP_G^B = \frac{D_{IN}^{MAX} \cdot (\Delta G_{B50} - \Delta CP_G^W)}{\min(R_{B50}, G_{B50}, B_{B50})} + \Delta CP_G^W$$

$$\Delta CP_B^B = \frac{D_{IN}^{MAX} \cdot (\Delta B_{B50} - \Delta CP_B^W)}{\min(R_{B50}, G_{B50}, B_{B50})} + \Delta CP_B^W$$

where $\Delta R_{B50}$ is the correction amount of the R grayscale value for the elementary color B which is calculated for 50% saturation at step S25, $AG_{B50}$ is the correction amount of the G grayscale value for the elementary color B which is calculated for 50% saturation at step S25, and $AB_{B50}$ is the correction amount of the B grayscale value for the elementary color B which is calculated for 50% saturation at step S25. $R_{B50}$ is the R grayscale value of the 50%-saturation panel characteristics values of the elementary color B calculated at step S25, $G_{B50}$ is the G grayscale value of the 50%-saturation panel characteristics values of the elementary color B, and $B_{B50}$ is the B grayscale value of the 50%-saturation panel characteristics values of the elementary color B.

The B vertex correction values $\Delta CP_R^B$, $\Delta CP_G^B$ and $\Delta CP_B^B$ thus obtained are stored in advance in the B vertex correction amount register 43B.

Furthermore, the C vertex correction amounts $\Delta CP_R^C$, $\Delta CP_G^C$ and $\Delta CP_B^C$ are calculated in accordance with the following expression (29d):

$$\Delta CP_R^C = \frac{D_{IN}^{MAX} \cdot (\Delta R_{C50} - \Delta CP_R^W)}{\min(R_{C50}, G_{C50}, B_{C50})} + \Delta CP_R^W \tag{29d}$$

$$\Delta CP_G^C = \frac{D_{IN}^{MAX} \cdot (\Delta G_{C50} - \Delta CP_G^W)}{\min(R_{C50}, G_{C50}, B_{C50})} + \Delta CP_G^W$$

$$\Delta CP_B^C = \frac{D_{IN}^{MAX} \cdot (\Delta B_{C50} - \Delta CP_B^W)}{\min(R_{C50}, G_{C50}, B_{C50})} + \Delta CP_B^W$$

where $\Delta R_{C50}$ is the correction amount of the R grayscale value for the complementary color C which is calculated for 50% saturation at step S25, $\Delta G_{C50}$ is the correction amount of the G grayscale value for the complementary color C which is calculated for 50% saturation at step S25, $AB_{C50}$ is the correction amount of the B grayscale value for the complementary color C which is calculated for 50% saturation at step S25. $R_{C50}$ is the R grayscale value of the 50%-saturation panel characteristics values of the complementary color C calculated at step S25, $G_{C50}$ is the G grayscale value of the 50%-saturation panel characteristics values of the complementary color C, and $B_{C50}$ is the B grayscale value of the 50%-saturation panel characteristics values of the complementary color C.

The C vertex correction values $\Delta CP_R^C$, $\Delta CP_G^C$ and $\Delta CP_B^C$ thus obtained are stored in advance in the C vertex correction amount register 47C.

Furthermore, the M vertex correction amounts $\Delta CP_R^M$, $\Delta CP_G^M$ and $\Delta CP_B^M$ are calculated in accordance with the following expression (29e):

$$\Delta CP_R^M = \frac{D_{IN}^{MAX} \cdot (\Delta R_{M50} - \Delta CP_R^W)}{\min(R_{M50}, G_{M50}, B_{M50})} + \Delta CP_R^W \quad (29e)$$

$$\Delta CP_G^M = \frac{D_{IN}^{MAX} \cdot (\Delta G_{M50} - \Delta CP_G^W)}{\min(R_{M50}, G_{M50}, B_{M50})} + \Delta CP_G^W$$

$$\Delta CP_B^M = \frac{D_{IN}^{MAX} \cdot (\Delta B_{M50} - \Delta CP_B^W)}{\min(R_{M50}, G_{M50}, B_{M50})} + \Delta CP_B^W$$

where $\Delta R_{M50}$ is the correction amount of the R grayscale value for the complementary color M which is calculated for 50% saturation at step S25, $\Delta G_{M50}$ is the correction amount of the G grayscale value for the complementary color M which is calculated for 50% saturation at step S25, and $\Delta B_{M50}$ is the correction amount of the B grayscale value for the complementary color M which is calculated for 50% saturation at step S25. $R_{M50}$ is the R grayscale value of the 50%-saturation panel characteristics values of the complementary color M calculated at step S25, $G_{M50}$ is the G grayscale value of the 50%-saturation panel characteristics values of the complementary color M, and $B_{M50}$ is the B grayscale value of the 50%-saturation panel characteristics values of the complementary color M.

The M vertex correction values $\Delta CP_R^M$, $\Delta CP_G^M$ and $\Delta CP_B^M$ thus obtained are stored in advance in the M vertex correction amount register 47M.

Furthermore, the Y vertex correction amounts $\Delta CP_R^Y$, $\Delta CP_G^Y$ and $\Delta CP_B^Y$ are calculated in accordance with the following expression (29f):

$$\Delta CP_R^Y = \frac{D_{IN}^{MAX} \cdot (\Delta R_{Y50} - \Delta CP_R^W)}{\min(R_{Y50}, G_{Y50}, B_{Y50})} + \Delta CP_R^W \quad (29f)$$

$$\Delta CP_G^Y = \frac{D_{IN}^{MAX} \cdot (\Delta G_{Y50} - \Delta CP_G^W)}{\min(R_{Y50}, G_{Y50}, B_{Y50})} + \Delta CP_G^W$$

$$\Delta CP_B^Y = \frac{D_{IN}^{MAX} \cdot (\Delta B_{Y50} - \Delta CP_B^W)}{\min(R_{Y50}, G_{Y50}, B_{Y50})} + \Delta CP_B^W$$

where $\Delta R_{Y50}$ is the correction amount of the R grayscale value for the complementary color Y which is calculated for 50% saturation at step S25, $\Delta G_{Y50}$ is the correction amount of the G grayscale value for the complementary color Y which is calculated for 50% saturation at step S25, and $AB_{Y50}$ is the correction amount of the B grayscale value for the complementary color Y which is calculated for 50% saturation at step S25. $R_{Y50}$ is the R grayscale value of the 50%-saturation panel characteristics values of the complementary color Y calculated at step S25, $G_{Y50}$ is the G grayscale value of the 50%-saturation panel characteristics values of the complementary color Y, and $B_{Y50}$ is the B grayscale value of the 50%-saturation panel characteristics values of the complementary color Y.

The Y vertex correction values $\Delta CP_R^Y$, $\Delta CP_G^Y$ and $\Delta CP_B^Y$ thus obtained are stored in advance in the Y vertex correction amount register 47Y.

Second Embodiment

In a second embodiment, a technique for individually performing color adjustment and brightness adjustment is provided. The technology disclosed in the first embodiment, in which the gamma correction is performed on the basis of the control point data CP0_sel to CP5_sel determined in accordance with the gamma value γ_VALUE, undesirably causes changes in the input-output characteristics, that is, the gamma characteristics of the respective elementary colors and complementary colors of the liquid crystal display device 1 as a whole from the intrinsic gamma characteristics of the liquid crystal display panel 2. Presented in the second embodiment is a technology that achieves brightness adjustment through gamma correction while reducing a change in the gamma characteristics of the respective elementary colors and complementary colors from the intrinsic gamma characteristics of the liquid crystal display panel 2.

Figure 21:
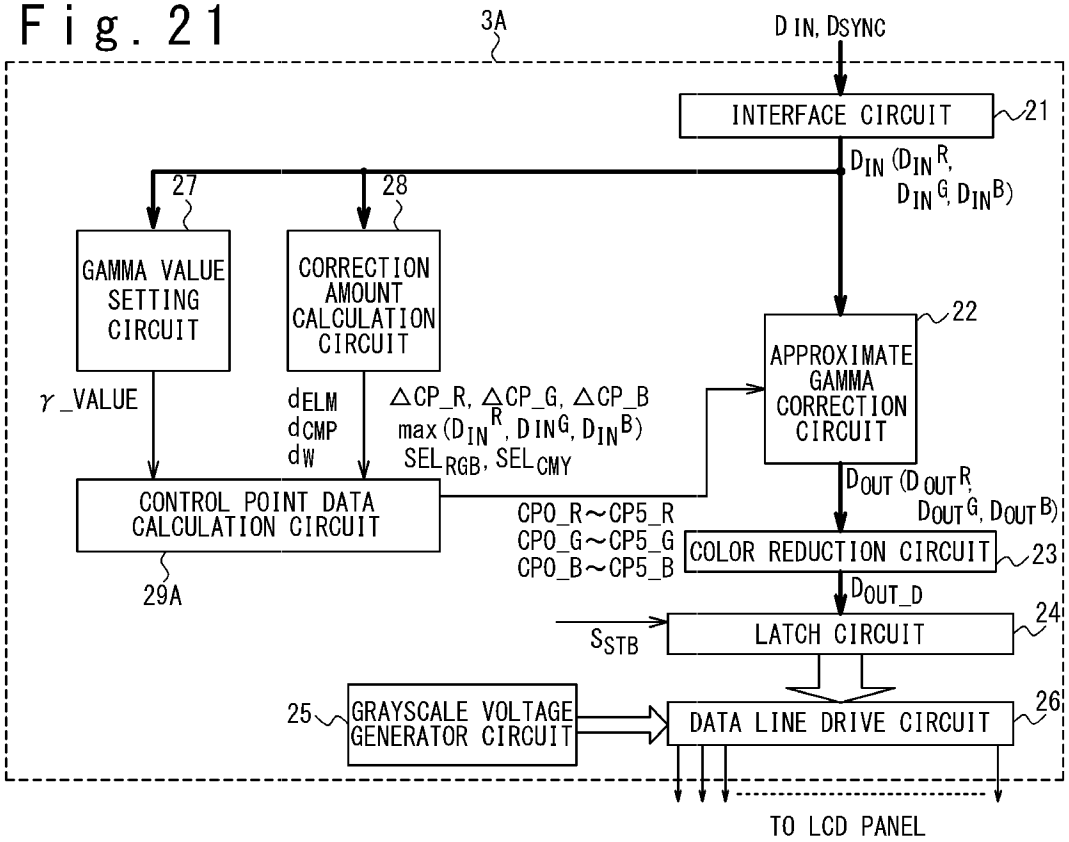
FIG. 21 is a block diagram illustrating an exemplary configuration of a driver IC in a second embodiment.

FIG. 21 is a block diagram illustrating an exemplary configuration of a driver IC 3A in the second embodiment. The configuration of the driver IC 3A in the second embodiment is similar to that of the driver IC 3 in the first embodiment. It should be noted that, the calculation method of the control point data CP0_R to CP5_R, CP0_G to CP5_G and CP0_B to CP5_B are modified in the second embodiment. In connection with this, in the second embodiment, the driver IC 3A includes a control point data calculation circuit 29A, the configuration and operation of which are different from those of the control point data calculation circuit 29 used in the first embodiment.

The configuration of the correction amount calculation circuit 28 in the second embodiment is similar to that in the first embodiment. It should be noted however that, in the second embodiment, the correction amount calculation circuit 28 is configured to feed, in addition to the correction amounts ΔCP_R, ΔCP_G and ΔCP_B, the distances $d_{ELM}$, $d_{CMP}$, $d_W$, $\max(D_{IN}^R, D_{IN}^G, D_{IN}^B)$ (which is the maximum value of the R, G and B grayscale values of the input image data $D_{IN}$), and the selection signals $SEL_{RGB}$ and $SEL_{CMY}$, which are calculated in the calculation procedure of the correction amounts ΔCP_R, ΔCP_G and ΔCP_B, to the control point data calculation circuit 29A. As described above, the distance $d_{ELM}$ is the distance between the corresponding point of the input image data $D_{IN}$ and the vertex corresponding to the elementary color with which the belonging area of the corresponding point of the input image data $D_{IN}$ is defined, and the distance $d_{CMP}$ is the distance between the corresponding point of the input image data $D_{IN}$ and the vertex corresponding to the complementary color with which the belonging area of the corresponding point of the input image data $D_{IN}$ is defined. The distance $d_W$ is the distance between the white point and the corresponding point of the input image data $D_{IN}$. The selection signal $SEL_{RGB}$ indicates the selected elementary color vertex, that is, which of the R, G and B vertices defines the belonging area, and the selection signal $SEL_{CMY}$ indicates the selected complementary color vertex, that is, which of the C, M and Y vertices defines the belonging area.

The control point data calculation circuit 29A calculates the control point data CP0_R to CP5_R, CP0_G to CP5_G and CP0_B to CP5_B on the basis of the gamma value γ_VALUE received from the gamma value setting circuit 27, and the correction amounts ΔCP_R, ΔCP_G and ΔCP_B, the distances $d_{ELM}$, $d_{CMP}$, $d_W$, the maximum value $\max(D_{IN}^R, D_{IN}^G, D_{IN}^B)$ of the R, G and B grayscale values $D_{IN}^R$, $D_{IN}^G$ and $D_{IN}^B$ of the input image data $D_{IN}$ and the selection signals $SEL_{RGB}$ and $SEL_{CMY}$, which are received from the correction amount calculation circuit 28. In the present embodiment, the gamma value γ_VALUE indicates the gamma value of gamma correction to be performed on the brightness of each pixel.

Figure 22:
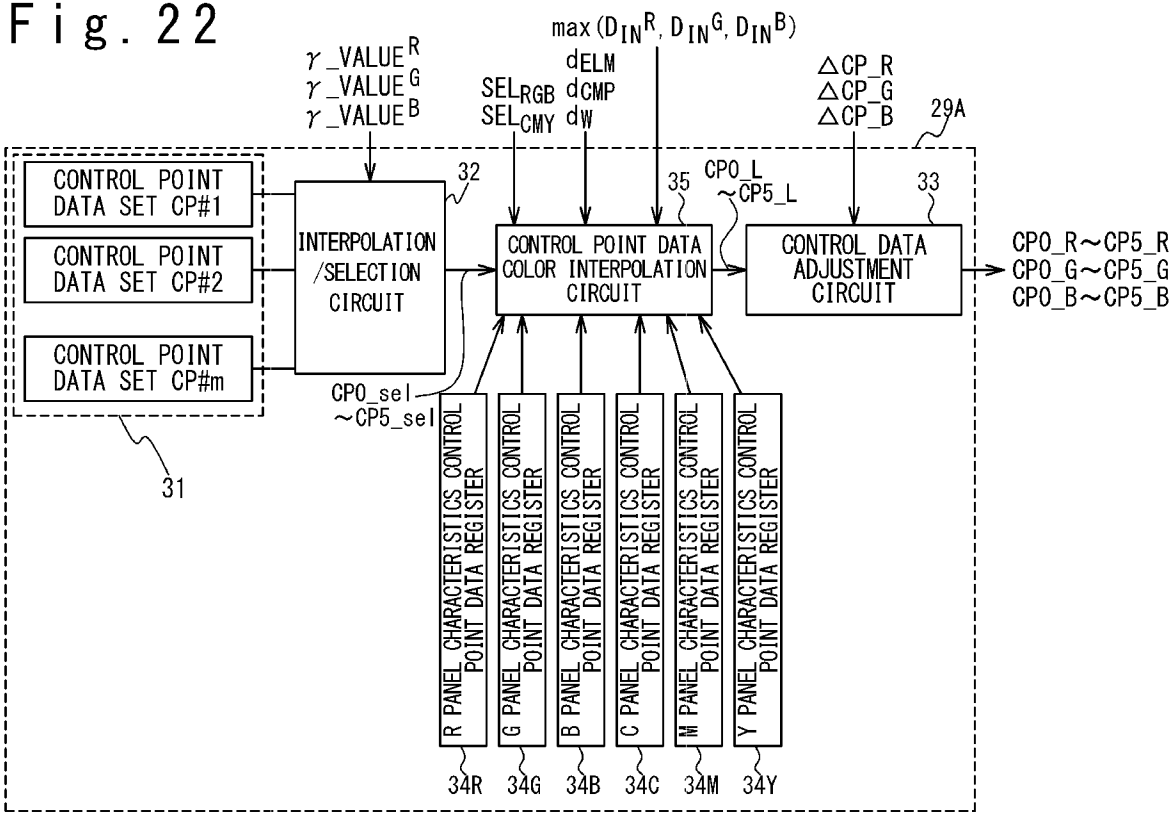
FIG. 22 is a block diagram illustrating an exemplary configuration of a control point data calculation circuit in the second embodiment.

FIG. 22 is a block diagram illustrating an exemplary configuration of the control point data calculation circuit 29A in the second embodiment. The configuration of the control point data calculation circuit 29A in the second embodiment is similar to that of the control point data calculation circuit 29 illustrated in FIG. 9. It should be noted however that the control point data calculation circuit 29A additionally includes R, G, B, C, M and Y panel characteristics control point data registers 34R, 34G, 34B, 34C, 34M and 34Y and a control point data color interpolation circuit 35 in the second embodiment. In the following, the R, G, B, C, M and Y panel characteristics control point data registers 34R, 34G, 34B, 34C, 34M and 34Y may be collectively referred to as "panel characteristics control point data registers 34", if they are not distinguished from one another.

The R panel characteristics control point data register 34R stores therein control point data CP0_$P^R$ to CP5_$P^R$ corresponding to the intrinsic gamma characteristics of the elementary color R of the liquid crystal display panel 2. When the gamma value of the intrinsic gamma characteristics of the elementary color R of the liquid crystal display panel 2 is 2.1, for example, the control point data CP0_$P^R$ to CP5_$P^R$ are determined to specify the gamma curve with a gamma value of 2.1. The values of the control point data CP0_$P^R$ to CP5_$P^R$ can be calculated with the same expressions as those used for calculating CP0#*j* to CP5#*j* of the control point data set CP#j. Namely, the expressions for calculating the control point data CP0_$P^R$ to CP5_$P^R$ can be obtained by replacing CP0#*j* to CP5#*j* with CP0_$P^R$ to CP5_$P^R$, respectively, in expressions (2a) and (2b). In this case, the gamma value of the gamma characteristics of the liquid crystal display panel 2 is used as the gamma value γ in expression (4).

Correspondingly, the G panel characteristics control point data register 34G stores therein control point data CP0_$P^G$ to CP5_$P^G$ corresponding to the intrinsic gamma characteristics of the elementary color G of the liquid crystal display panel 2, and the B panel characteristics control point data register 34B stores therein control point data CP0_$P^B$ to CP5_$P^B$ corresponding to the intrinsic gamma characteristics of the elementary color G of the liquid crystal display panel 2.

Furthermore, the C panel characteristics control point data register 34C stores therein control point data CP0_$P^C$ to CP5_$P^C$ corresponding to the intrinsic gamma characteristics of the complementary color C of the liquid crystal display panel 2, and the M panel characteristics control point data register 34M stores therein control point data CP0_$P^M$ to CP5_$P^M$ corresponding to the intrinsic gamma characteristics of the complementary color M of the liquid crystal display panel 2. Finally, the Y panel characteristics control point data register 34Y stores therein control point data CP0_$P^Y$ to CP5_$P^Y$ corresponding to the intrinsic gamma characteristics of the complementary color Y of the liquid crystal display panel 2.

Although FIG. 22 illustrates the configuration in which the panel characteristics control point data registers 34 are respectively provided for the respective elementary colors and complementary colors, a common panel characteristics control point data register 34 storing common control point data may be provided for elementary and/or complementary colors with which the gamma values of the intrinsic gamma characteristics of the liquid crystal display panel 2 are the same.

The control point data color interpolation circuit 35 calculates control point data CP0_L to CP5_L through interpolation of the control point data CP0_sel to CP5_sel determined by the interpolation/selection circuit 32, the control point data CP0_$P^{ELM}$ to CP5_$P^{ELM}$ corresponding to the selected elementary color (the elementary color specified by the selection signal $SEL_{RGB}$) and the control point data CP0_$P^{CMP}$ to CP5_$P^{CMP}$ corresponding to the selected complementary color (the complementary color specified by the selection signal $SEL_{CMP}$). The control point data CP0_$P^{ELM}$ to CP5_$P^{ELM}$ corresponding to the selected elementary color correspond to the intrinsic gamma characteristics of the selected elementary color of the liquid crystal display panel 2, and are selected from the control point data stored in the R, G and B panel characteristics control point data registers 34R, 34G and 34B in response to the selection signal $SEL_{RGB}$. On the other hand, the control point data CP0_$P^{CMP}$ to CP5_$P^{CMP}$ corresponding to the selected complementary color correspond to the intrinsic gamma characteristics of the selected complementary color of the liquid crystal display panel 2, and are selected from the control point data stored in the C, M and Y panel characteristics control point data registers 34C, 34M and 34Y in response to the selection signal $SEL_{CMY}$. The distances $d_{ELM}$, $d_{CMP}$, $d_W$ and the maximum value $\max(D_{IN}^R, D_{IN}^G, D_{IN}^B)$ are used in the interpolation for the calculation of the control point data CP0_L to CP5_L.

The control point data CP0_L to CP5_L calculated by the control point data color interpolation circuit 35 are transmitted to the control point data adjustment circuit 33. In the present embodiment, the control point data adjustment circuit 33 calculates the control point data CP0_R to CP5_R, CP0_G to CP5_G and CP0_B to CP5_B, which are to be transmitted to the approximate gamma correction circuit 22, through modifying the control data CP0_L to CP5_L received from the control point data color interpolation circuit 35 in response to the correction amounts ΔCP_R, ΔCP_G and ΔCP_B received from the correction amount calculation circuit 28.

Figure 23:
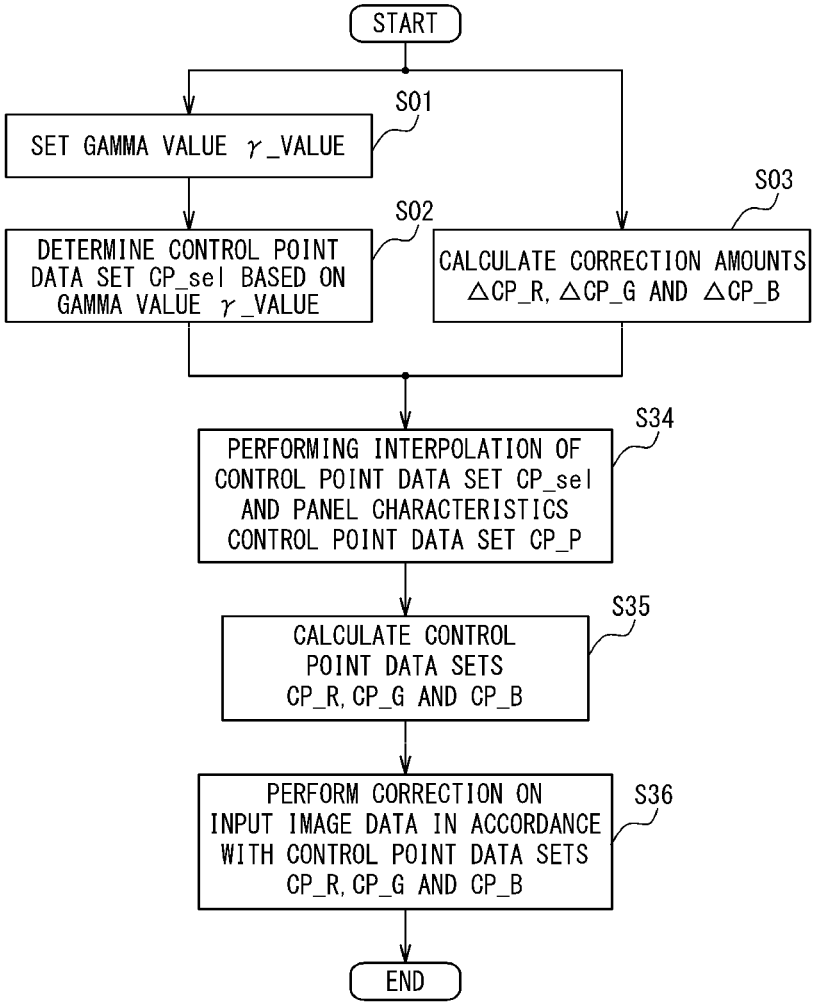
FIG. 23 is a flowchart illustrating digital arithmetic processing performed on input image data $D_{IN}$ in the second embodiment.

Next, a description is given of the digital arithmetic processing performed for color adjustment and gamma correction in the second embodiment. FIG. 23 is a flowchart illustrating the digital arithmetic processing performed on the input image data $D_{IN}$ in the second embodiment.

Steps S01 to S03:

The setting of the gamma value γ_VALUE (step S01), the determination of the control point data set CP_sel (control point data CP0_sel to CP5_sel) based on the gamma value e γ_VALUE (step S02) and the calculation of the correction amounts ΔCP_R, ΔCP_G and ΔCP_B (step S03) are performed in the same way as the first embodiment. It should be noted that the gamma value γ_VALUE are determined to indicate the gamma value of gamma correction to be performed on the brightness of each pixel in the present embodiment. It should be also noted that the distances $d_{ELM}$, $d_{CMP}$, $d_W$ and the maximum value $\max(D_{IN}^R, D_{IN}^G, D_{IN}^B)$ of the R, G and B grayscale values $D_{IN}^R$, $D_{IN}^G$ and $D_{IN}^B$ of the input image data $D_{IN}$ are calculated in the calculation of the correction amounts ΔCP_R, ΔCP_G and ΔCP_B.

Step S34:

The control point data CP0_L to CP5_L are calculated through interpolation of the control point data CP0_sel to CP5_sel determined by the interpolation/selection circuit 32, the control point data CP0_$P^{ELM}$ to CP5_$P^{ELM}$ corresponding to the selected elementary color (the elementary color with which the belonging area is defined, or the elementary color indicated by the selection signal $SEL_{RGB}$) and the control point data CP0_$P^{CMP}$ to CPS_$P^{CMP}$ corresponding to the selected complementary color (the complementary color with which the belonging area is defined, or the complementary color indicated by the selection signal $SEL_{CMY}$). As described above, the control point data CP0_L to CP5_L are calculated by the control point data color interpolation circuit 35.

The interpolation performed in the control point data color interpolation circuit 35 aims at individually performing color adjustment and brightness adjustment. In the present embodiment, gamma correction is performed on the brightness of each pixel, keeping the gamma characteristics of the respective colors of the liquid crystal display panel 2 unchanged. In other words, the gamma correction is performed on the basis of the control point data CP0_sel to CP5_sel determined on the basis of the gamma value γ_VALUE when the input image data $D_{IN}$ correspond to the white point in the color space. When the input image data $D_{IN}$ correspond to the selected elementary color in the color space, on the other hand, the gamma correction is performed on the basis of the control point data corresponding to the intrinsic gamma characteristics of the selected elementary color of the liquid crystal display panel 2, that is, the control point data CP0_$P^{ELM}$ to CP5_$P^{ELM}$. When the selected elementary color is the elementary color R, for example, the control point data CP0_$P^{R}$ to CP5_$P^{R}$ are selected as the control point data CP0_$P^{ELM}$ to CP5_$P^{ELM}$ and the gamma correction is performed on the control point data CP0_$P^{R}$ to CP5_$P^{R}$. Similarly, when the input image data $D_{IN}$ correspond to the selected complementary color in the color space, the gamma correction is performed on the basis of the control point data corresponding to the intrinsic gamma characteristics of the selected complementary color of the liquid crystal display panel 2, that is, the control point data CP0_$P^{CMP}$ to CP5_$P^{CMP}$ When the input image data $D_{IN}$ correspond to a point distant from any of the white point and the vertices corresponding to the elementary colors and complementary colors, the gamma correction is performed on the basis of the control point data CP0_L to CP5_L, that is, the control point data obtained through interpolation of the control point data CP0_sel to CP5_sel, CP0$P^{ELM}$ to CP5_$P^{ELM}$ and CP0_$P^{CMP}$ to CP5_$P^{CMP}$ depending on the distances $d_{ELM}$, $d_{CMP}$ and $d_W$.

In order to exclude the components of the brightness, the values obtained by normalization of the distances $d_{ELM}$, $d_{CMP}$ and $d_W$ are used in this interpolation. It should be noted that the distances $d_{ELM}$, $d_{CMP}$ and $d_W$ are calculated so that the sum of the distances $d_{ELM}$, $d_{CMP}$ and $d_W$ is equal to the maximum value $\max(D_{IN}^R, D_{IN}^G, D_{IN}^B)$ of the R, G and B grayscale values $D_{IN}^R$, $D_{IN}^G$ and $D_{IN}^B$, as understood from the description of the first embodiment. In this embodiment, the distances $d_{ELM}$, $d_{CMP}$ and $d_W$ are normalized with the maximum value $\max(D_{IN}^R, D_{IN}^G, D_{IN}^B)$.

In one embodiment, the interpolation at step S34 is performed in accordance with the following expressions (30):

$$\text{CP0_}L=\text{CP0_}P^{ELM}\cdot\langle d_{ELM}\rangle+\text{CP0_}P^{CMP}\cdot\langle d_{CMP}\rangle+\text{CP0}_{sel}\cdot\langle d_W\rangle,$$

$$\text{CP1_}L=\text{CP1_}P^{ELM}\cdot\langle d_{ELM}\rangle+\text{CP1_}P^{CMP}\cdot\langle d_{CMP}\rangle+\text{CP0}_{sel}\cdot\langle d_W\rangle,$$

$$\text{CP2_}L=\text{CP2_}P^{ELM}\cdot\langle d_{ELM}\rangle+\text{CP2_}P^{CMP}\cdot\langle d_{CMP}\rangle+\text{CP0}_{sel}\cdot\langle d_W\rangle,$$

$$\text{CP3_}L=\text{CP3_}P^{ELM}\cdot\langle d_{ELM}\rangle+\text{CP3_}P^{CMP}\cdot\langle d_{CMP}\rangle+\text{CP0}_{sel}\cdot\langle d_W\rangle,$$

$$\text{CP4_}L=\text{CP4_}P^{ELM}\cdot\langle d_{ELM}\rangle+\text{CP4_}P^{CMP}\cdot\langle d_{CMP}\rangle+\text{CP0}_{sel}\cdot\langle d_W\rangle, \text{ and}$$

$$\text{CP5_}L=\text{CP5_}P^{ELM}\cdot\langle d_{ELM}\rangle+\text{CP5_}P^{CMP}\cdot\langle d_{CMP}\rangle+\text{CP0}_{sel}\cdot\langle d_W\rangle. \quad (30)$$

Here, $\langle d_{ELM}\rangle$, $\langle d_{CMP}\rangle$ and $\langle d_W\rangle$ are the values obtained by normalizing the distances $d_{ELM}$, $d_{CMP}$ and $d_W$. In the present embodiment, $\langle d_{ELM}\rangle$, $\langle d_{CMP}\rangle$ and $\langle d_W\rangle$ are calculated in accordance with the following expressions:

$$\langle d_{ELM}\rangle=d_{ELM}/\max(D_{IN}^R,D_{IN}^G,D_{IN}^B),$$

$$\langle d_{ELM}\rangle=d_{CMP}/\max(D_{IN}^R,D_{IN}^G,D_{IN}^B), \text{ and}$$

$$\langle d_W\rangle=d_W/\max(D_{IN}^R,D_{IN}^G,D_{IN}^B),$$

The control point data CP0_L to CP5_L thus calculated are transmitted to the control point data adjustment circuit 33.

Step S35:

The control point data set CP_R, CP_G and CP_B, which are to be transmitted to the approximate gamma correction circuit 22, are calculated by the control point data adjustment circuit 33 from the control point data of the control point data set CP_L determined by the control point data color interpolation circuit 35 and the correction amounts ΔCP_R, ΔCP_G and ΔCP_B calculated by the correction amount calculation circuit 28.

More specifically, the control point data CP0_R to CP5_R of the control point data set CP_R are calculated by adding the correction amount ΔCP_R to the control point data CP0_L to CP5_L, respectively.

Namely, $$\text{CP0_}R=\text{CP0_}L+\Delta\text{CP_}R,$$

$$\text{CP1_}R=\text{CP1_}L+\Delta\text{CP_}R,$$

$$\text{CP2_}R=\text{CP2_}L+\Delta\text{CP_}R,$$

$$\text{CP3_}R=\text{CP3_}L+\Delta\text{CP_}R,$$

$$\text{CP4_}R=\text{CP4_}L+\Delta\text{CP_}R, \text{ and}$$

$$\text{CP5_}R=\text{CP5_}L+\Delta\text{CP_}R, \quad (31)$$

Correspondingly, the control point data CP0_G to CP5_G of the control point data set CP_G are calculated by adding the correction amount ΔCP_G to the control point data CP0_L to CP5_L, respectively.

Namely, $$\text{CP0_}G=\text{CP0_}L+\Delta\text{CP_}G,$$

$$\text{CP1_}G=\text{CP1_}L+\Delta\text{CP_}G,$$

$$\text{CP2_}G=\text{CP2_}L+\Delta\text{CP_}G,$$

$$\text{CP3_}G=\text{CP3_}L+\Delta\text{CP_}G,$$

$$\text{CP4_}G=\text{CP4_}L+\Delta\text{CP_}G, \text{ and}$$

$$\text{CP5_}G=\text{CP5_}L+\Delta\text{CP_}G. \quad (32)$$

Furthermore, the control point data CP0_B to CP5_B of the control point data set CP_B are calculated by adding the correction amount ΔCP_B to the control point data CP0_L to CP5_L, respectively.

Namely, $$\text{CP0_}G=\text{CP0_}L+\Delta\text{CP_}B,$$

$$\text{CP1_}G=\text{CP1_}L+\Delta\text{CP_}B,$$

$$\text{CP2_}G=\text{CP2_}L+\Delta\text{CP_}B,$$

$$\text{CP3_}G=\text{CP3_}L+\Delta\text{CP_}B,$$

$$\text{CP4_}G=\text{CP4_}L+\Delta\text{CP_}B, \text{ and}$$

$$\text{CP5_}G=\text{CP5_}L+\Delta\text{CP_}B. \quad (33)$$

The control point data set CP_R, CP_G and CP_B thus calculated are transmitted to the approximate gamma correction circuit 22.

Step S36:

Digital arithmetic processing is performed on the R, G and B grayscale values $D_{IN}^R$, $D_{IN}^G$ and $D_{IN}^B$ of the input image data $D_{IN}$ for each pixel 9 by using the control point data sets CP_R, CP_G and CP_B, and thereby the R, G and B grayscale values $D_{OUT}^R$, $D_{OUT}^G$ and $D_{OUT}^B$ of the output image data $D_{OUT}$ for each pixel 9 are calculated. The calculation of the R, G and B grayscale values $D_{OUT}^R$, $D_{OUT}^G$ and $D_{OUT}^B$ of the output image data $D_{OUT}$ in the second embodiment are achieved through the same processing as the first embodiment.

In the following, a description is given of a specific example of calculations of the correction amounts ΔCP_R, ΔCP_G and ΔCP_B and the control point data sets CP_R, CP_G and CP_B. In this example, it is assumed that the R, G and B grayscale values $D_{IN}^R$, $D_{IN}^G$ and $D_{IN}^B$ of the input image data $D_{IN}$ are each 8-bit data and therefore the allowed maximum value $D_{IN}^{MAX}$ is 255. It is also assumed that the R, G and B grayscale values $D_{OUT}^R$, $D_{OUT}^G$ and $D_{OUT}^B$ of the output image data $D_{OUT}$ are 10-bit data. The correction amounts for the white point and the vertices corresponding to the respective elementary colors and complementary colors are preset as illustrated in FIG. 24A. It should be noted that the correction amounts are given as 10-bit data in FIG. 24A.

In the example discussed below, the correction amounts ΔCP_R, ΔCP_G, ΔCP_B and the control point data sets CP_R, CP_G and CP_R are calculated for the case when the R, G and B grayscale values $D_{IN}^R$, $D_{IN}^G$ and $D_{IN}^B$ of the input image data $D_{IN}$ are 100, 40 and 20, respectively. It should be noted that the grayscale value $D_{IN}^R$ is the largest among the R, G and B grayscale values $D_{IN}^R$, $D_{IN}^G$ and $D_{IN}^B$ and the B grayscale value $D_{IN}^B$ is the smallest. Accordingly, the belonging area of the corresponding point of the input image data $D_{IN}$ in the color space is the area A1 which is defined with the white point, the R vertex and the Y vertex (see FIG. 3B). The selected elementary color vertex is the R vertex and the selected complementary color vertex is the Y vertex.

The differences between the R, G and B grayscale values of the selected elementary color vertex (that is, the R vertex) and the R, G and B grayscale values $D_{IN}^R$, $D_{IN}^G$ and $D_{IN}^B$ of the input image data $D_{IN}$ are calculated in accordance with expressions (8a) to (8c) as follows:

$$RGB\text{dist}_R=255-100=155,$$

$$RGB\text{dist}_G=0-40=-40, \text{ and}$$

$$RGB\text{dist}_B=0-20=-20.$$

The differences between the R, G and B grayscale values of the selected complementary color vertex (that is, the Y vertex) and the R, G and B grayscale values $D_{IN}^R$, $D_{IN}^G$ and $D_{IN}^B$ of the input image data $D_{IN}$ are calculated in accordance with expressions (9a) to (9c) as follows:

$$CMY\text{dist}_R=255-100=155,$$

$$CMY\text{dist}_G=255-40=215, \text{ and}$$

$$CMY\text{dist}_B=0-20=-20.$$

The distance $d_{ELM}$ between the selected elementary color vertex and the corresponding point of the input image data $D_{IN}$ is calculated in accordance with expression (10) as follows:

$$d_{ELM}=255-\{155-(-40)\}=60.$$

The distance $d_{CMP}$ between the selected complementary color vertex and the corresponding point of the input image data $D_{IN}$ is calculated in accordance with expression (11) as follows:

$$d_{CMP}=255-\{155-(-20)\}=20.$$

The distance $d_W$ between the white point and the corresponding point of the input image data $D_{IN}$ is calculated in accordance with expression (12) as follows:

$$d_m=20.$$

It should be noted that the sum of the distances $d_{ELM}$, $d_{CMP}$ and $d_W$ thus obtained is equal to the R grayscale value $D_{IN}^R$ (=100) of the input image data $D_{IN}$, which is the largest among the R, G and B grayscale values $D_{IN}^R$, $D_{IN}^G$ and $D_{IN}^B$ of the input image data $D_{IN}$.

The elementary-color-distance dependent correction amounts $\Delta CP_R^{ELM-d}$, $\Delta CP_G^{ELM-d}$ and $\Delta CP_B^{ELM-d}$ are calculated in accordance with expressions (13a) to (13c) as follows:

$$\begin{aligned}\Delta CP_R^{ELM-d} &= \Delta CP_R^R \times d_{ELM} / D_{IN}^{MAX},\\ &= 69\times 60/255,\\ \Delta CP_G^{ELM-d} &= \Delta CP_G^R \times d_{ELM} / D_{IN}^{MAX},\\ &= 0\times 60/255, \text{ and}\\ \Delta CP_B^{ELM-d} &= \Delta CP_B^R \times d_{ELM} / D_{IN}^{MAX},\\ &= 28\times 60/255.\end{aligned}$$

The complementary-color-distance dependent correction amounts $\Delta CP_R^{CMP-d}$, $\Delta CP_G^{CMP-d}$ and $\Delta CP_B^{CMP-d}$ are calculated in accordance with expressions (14a) to (14c) as follows:

$$\begin{aligned}\Delta CP_R^{CMP-d} &= \Delta CP_R^{CMP} \times d_{CMP} / D_{IN}^{MAX},\\ &= 20\times 20/255\\ \Delta CP_G^{CMP-d} &= \Delta CP_G^{CMP} \times d_{CMP} / D_{IN}^{MAX},\\ &= 7\times 20/255, \text{ and}\\ \Delta CP_B^{CMP-d} &= \Delta CP_B^{CMP} \times d_{CMP} / D_{IN}^{MAX},\\ &= 44\times 20/255.\end{aligned}$$

The white-point-distance dependent correction amounts $\Delta CP_R^{W-d}$, $\Delta CP_G^{W-d}$ and $\Delta CP_B^{W-d}$ are calculated in accordance with expressions (15a) to (15c) as follows:

$$\begin{aligned}\Delta CP_R^{W-d} &= \Delta CP_R^W \times d_W / D_{IN}^{MAX},\\ &= -50\times 20/255,\\ \Delta CP_G^{W-d} &= \Delta CP_G^W \times d_W / D_{IN}^{MAX},\\ &= -16\times 20/255, \text{ and}\\ \Delta CP_B^{W-d} &= \Delta CP_B^W \times d_W / D_{IN}^{MAX},\\ &= 0\times 20/255.\end{aligned}$$

The correction amounts ΔCP_R, ΔCP_G and ΔCP_B are calculated in accordance with expressions (16a) to (16c) as follows:

$$\begin{aligned}\Delta CP_R &= \Delta CP_R^{ELM-d} + \Delta CP_R^{CMP-d} + \Delta CP_R^{W-d},\\ &= \{69\times 60 + 20\times 20 + (-50)\times 20\}/255\\ &= 13\end{aligned}$$

$$\begin{aligned}\Delta CP_G &= \Delta CP_G^{ELM-d} + \Delta CP_G^{CMP-d} + \Delta CP_G^{W-d},\\ &= \{0\times 60 + 7\times 20 + (-16)\times 20\}/255,\\ &= -1, \text{ and}\end{aligned}$$

$$\begin{aligned}\Delta CP_B &= \Delta CP_B^{ELM-d} + \Delta CP_B^{CMP-d} + \Delta CP_B^{W-d},\\ &= (28\times 60 + 44\times 20 + 0\times 20)/255,\\ &= 10.\end{aligned}$$

It should be noted that the correction amounts ΔCP_R, ΔCP_G and ΔCP_B are 10-bit data obtained by rounding to integers.

Discussed below is the case when the gamma value γ_VALUE of the gamma correction for brightness adjustment is set to 2.2 by the gamma value setting circuit 27. FIG. 24B is illustrates the relation among the grayscale values of the input image data $D_{IN}$, the intrinsic panel characteristics of the liquid crystal display panel 2 (panel brightness characteristics) and the desired values of the brightness adjustment (that is, the brightness characteristics to be achieved by the gamma correction). In FIG. 24B, "W0" indicates that all of the R, G and B grayscale values are zero, and "W64" indicates that all of the R, G and B grayscale values are 64. The similar applies to "W127", "W128", "W192" and "W255".

It is further assumed that the gamma values of the intrinsic gamma characteristics of the liquid crystal display panel 2 for the elementary color R and the complementary color Y are both 2.1. When the gamma value of the intrinsic gamma characteristics of the liquid crystal display panel 2 for the elementary color R is 2.1, the control point data CP0_$P^R$ to CP5_$P^R$ to be stored in the R panel characteristics control point data register 34R are obtained from expressions (2b) and (3) by substituting 2.1 for γ into expression (4). Correspondingly, the gamma value of the intrinsic gamma characteristics of the liquid crystal display panel 2 for the complementary color Y is 2.1, the control point data CP0_$P^Y$ to CP5_$P^Y$ to be stored in the Y panel characteristics control point data register 34Y are obtained from expressions (2b) and (3) by substituting 2.1 for γ into expression (4). In this example, the values of the control point data CP0_$P^Y$ to CP5_$P^Y$ are equal to the values of the control point data CP0_$P^R$ to CP5_$P^R$, respectively, since the gamma values of the gamma characteristics for the elementary color R and the complementary color Y are the same. FIG. 25A is a table illustrating the values of the control point data CP0_$P^R$ to CP5_$P^R$ and the control point data CP0_$P^Y$ to CP5_$P^Y$ thus obtained.

The values of the control point data CP0_sel to CP5_sel, which are determined on the basis of the gamma value γ_VALUE, are obtained from expressions (2b) and (3) by substituting 2.2 for γ into expression (4). FIG. 25B is a table illustrating the values of the control point data CP0_sel to CP5_sel thus obtained.

The control point data CP0_L to CP5_L are calculated through interpolation of the control point data CP0_$P^R$ to CP5_$P^R$ stored in the R panel characteristics control point data register 34R, the control point data CP0_$P^Y$ to CP5_$P^Y$ stored in the Y panel characteristics control point data register 34Y, and the control point data CP0_sel to CP5_sel determined on the basis of the gamma value γ_VALUE. The control point data CP0_L to CP5_L are calculated in accordance with expression (30) as follows:

$$\begin{aligned}CP0_L &= (0\times 60 + 0\times 20 + 0\times 20)/100,\\ &= 0,\\ CP1_L &= (0\times 60 + 0\times 20 + (-16)\times 20)/100,\\ &= -3,\\ CP2_L &= (508\times 60 + 508\times 20 + 491\times 20)/100,\\ &= 505,\\ CP3_L &= (512\times 60 + 512\times 20 + 496\times 20)/100,\\ &= 508\\ CP4_L &= (508\times 60 + 508\times 20 + 486\times 20)/100,\\ &= 504, \text{ and}\\ CP5_L &= (1020\times 60 + 1020\times 20 + 1020\times 20)/100,\\ &= 1020.\end{aligned}$$

It should be noted that the control point data CP0_L to CP5_L are calculated as 10-bit data rounded to integers.

The control point data CP0_R to CP5_R, CP0_G to CP5_G and CP0_B to CP5_B, which are finally used for the digital arithmetic processing performed on the input image data $D_{IN}$, are calculated from the control point data CP0_L to CP5_L and correction amounts ΔCP_R, ΔCP_G and ΔCP_B thus obtained. FIG. 26 illustrates the finally-obtained values of the control point data CP0_R to CP5_R, CP0_G to CP5_G and CP0_B to CP5_B.

Although specific embodiments of the present invention are described above, it would be apparent to a person skilled in the art that the present invention is not limited to the above-described embodiment; the present invention may be implemented with various modifications. Although embodiments of the liquid crystal display device 1 including the liquid crystal display panel 2 are described above, the digital arithmetic processing performed in the above-described embodiments can be implemented in an image processing device. It should be also noted that the present invention is applicable to panel display devices including different display panels (such as display devices including OLED (organic light emitting diode) display panels).

What is claimed is:

1. A display device, comprising:

a display panel; and a display panel driver configured to drive the display panel, wherein the display panel driver includes:

a processing circuit configured to perform digital arithmetic processing on R, G and B grayscale values of input image data to calculate R, G and B grayscale values of output image data, respectively;

a driver circuit configured to drive the display panel in response to the output image data; and a control point data generation circuit configured to:

generate first control point data indicating a shape of a gamma curve of a desired gamma value;

calculate R control point data indicating an input-output curve of digital arithmetic processing performed on the R grayscale value of the input image data by correcting the first control point data in response to a position of a corresponding point corresponding to the input image data in a color space;

calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space, and wherein the processing circuit is configured to: calculate the R grayscale value of the output image data in response to the R control point data, calculate the G grayscale value of the output image data in response to the G control point data, and calculate the B grayscale value of the output image data in response to the B control point data;

wherein the control point data generation circuit is configured to:

select a belonging area to which the corresponding point corresponding to the input image data in the color space belongs from among a plurality of areas each defined by a white point, a vertex corresponding to an elementary color and a vertex corresponding to a complementary color in the color space, calculate a first distance between a selected elementary color vertex and the corresponding point corresponding to the input image data in the color space, a second distance between a selected complementary color vertex and the corresponding point corresponding to the input image data in the color space, and a third distance between the white point and the corresponding point corresponding to the input image data; and calculate the R, G and B control point data by correcting the first control point data based on the first, second and third distances, the selected elementary color vertex being the vertex corresponding to an elementary color defining the belonging area, and the selected complementary color vertex being the vertex corresponding to a complementary color defining the belonging area.

2. The display device according to claim 1, wherein the control point data generation circuit includes a storage circuit configured to store an R correction amount for calculating the R control point data from the first control point data, a G correction amount for calculating the G control point data from the first control point data, and a B correction amount for calculating the B control point data from the first control point data for each of the white point, the vertices corresponding the respective elementary colors and the vertices corresponding the respective complementary colors, wherein the R, G and B correction amounts corresponding to respective one of the white point, the vertices corresponding the respective elementary colors and the vertices corresponding the respective complementary colors are calculated so that the R, G and B correction amounts corresponding to the respective one are determined as values to be set for a case when the corresponding point corresponding to the input image data coincide with the respective one, and wherein the control point data generation circuit is configured to calculate the R control point data based on the R correction amounts corresponding to the white point, the selected elementary color vertex and the selected complementary color vertex stored in the storage circuit, to calculate the G control point data based on the G correction amounts corresponding to x and the white point, the selected elementary color vertex and the selected complementary color vertex stored in the storage circuit, and to calculate the B control point data based on the B correction amounts corresponding to the white point, the selected elementary color vertex and the selected complementary color vertex stored in the storage circuit.

3. The display device according to claim 2, wherein the R, G and B correction amounts corresponding to the white point are determined so that chromaticity coordinates of the white point of measured panel characteristics of the display panel coincide with chromaticity coordinates of the white point defined in a specific standard, and wherein the R, G and B correction amounts corresponding to the vertex corresponding to respective one of the respective elementary colors and the respective complementary colors are determined so that chromaticity coordinates for 50% saturation of the respective one of the respective elementary colors and complementary colors with respect to the measured panel characteristics of the display panel coincide with chromaticity coordinates for 50% saturation of the respective one of the respective elementary colors and complementary colors for 50% saturation of the respective one of the respective elementary colors and complementary colors defined in the specific standard.

4. The display device according to claim 3, wherein the control point data generation circuit is configured to generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances, and to calculate the R, G and B control point data by correcting the fourth control point data based on the first, second and third distances.

5. The display device according to claim 2, wherein the control point data generation circuit is configured to generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances, and to calculate the R, G and B control point data by correcting the fourth control point data based on the first, second and third distances.

6. The display device according to claim 1, wherein the control point data generation circuit is configured to: to generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances; and calculate the R, G and B control point data by correcting the fourth control point data based on the first, second and third distances.

7. A display panel driver for driving a display panel, comprising:

a processing circuit configured to perform digital arithmetic processing on R, G and B grayscale values of input image data to calculate R, G and B grayscale values of output image data, respectively;

a driver circuit configured to drive the display panel in response to the output image data; and a control point data generation circuit configured to:

generate first control point data indicating a shape of a gamma curve of a desired gamma value;

calculate R control point data indicating an input-output curve of digital arithmetic processing performed on the R grayscale value of the input image data by correcting the first control point data in response to a position of a corresponding point corresponding to the input image data in a color space;

calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space, wherein the processing circuit is configured to: calculate the R grayscale value of the output image data in response to the R control point data, calculate the G grayscale value of the output image data in response to the G control point data, and calculate the B grayscale value of the output image data in response to the B control point data;

wherein the control point data generation circuit is configured to:

select a belonging area to which the corresponding point corresponding to the input image data in the color space belongs from among a plurality of areas each defined by a white point, a vertex corresponding to an elementary color and a vertex corresponding to a complementary color in the color space, calculate a first distance between a selected elementary color vertex and the corresponding point corresponding to the input image data in the color space, a second distance between a selected complementary color vertex and the corresponding point corresponding to the input image data in the color space, and a third distance between the white point and the corresponding point corresponding to the input image data; and calculate the R, G and B control point data by correcting the first control point data based on the first, second and third distances, the selected elementary color vertex being the vertex corresponding to an elementary color defining the belonging area and the selected complementary color vertex being the vertex corresponding to a complementary color defining the belonging area.

8. The display panel driver according to claim 7, wherein the control point data generation circuit includes a storage circuit configured to store an R correction amount for calculating the R control point data from the first control point data, a G correction amount for calculating the G control point data from the first control point data, and a B correction amount for calculating the B control point data from the first control point data for each of the white point, the vertices corresponding the respective elementary colors and the vertices corresponding the respective complementary colors, wherein the R, G and B correction amounts corresponding to respective one of the white point, the vertices corresponding the respective elementary colors and the vertices corresponding the respective complementary colors are calculated so that the R, G and B correction amounts corresponding to the respective one are determined as values to be set for a case when the corresponding point corresponding to the input image data coincide with the respective one, and wherein the control point data generation circuit is configured to calculate the R control point data based on the R correction amounts corresponding to the white point, the selected elementary color vertex and the selected complementary color vertex stored in the storage circuit, to calculate the G control point data based on the G correction amounts corresponding to the white point, the selected elementary color vertex and the selected complementary color vertex stored in the storage circuit, and to calculate the B control point data based on the B correction amounts corresponding to the white point, the selected elementary color vertex and the selected complementary color vertex and stored in the storage circuit.

9. The display panel driver according to claim 8, wherein the R, G and B correction amounts corresponding to the white point are determined so that chromaticity coordinates of the white point of measured panel characteristics of the display panel coincide with chromaticity coordinates of the white point defined in a specific standard, and wherein the R, G and B correction amounts corresponding to the vertex corresponding to respective one of the respective elementary colors and the respective complementary colors are determined so that chromaticity coordinates for 50% saturation of the respective one of the respective elementary colors and complementary colors with respect to the measured panel characteristics of the display panel coincide with chromaticity coordinates for 50% saturation of the respective one of the respective elementary colors and complementary colors for 50% saturation of the respective one of the respective elementary colors and complementary colors defined in the specific standard.

10. The display panel driver according to claim 9, wherein the control point data generation circuit is configured to generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances, and to calculate the R, G and B control point data by correcting the fourth control point data based on the first, second and third distances.

11. The display panel driver according to claim 7, wherein the control point data generation circuit is configured to:

generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances; and calculate the R, G and B control point data by correcting the fourth control point data based on the first, second and third distances.

12. The display panel driver according to claim 8, wherein the control point data generation circuit is configured to generate fourth control point data through performing interpolation of the first control point data, second control point data indicating a shape of a gamma curve of intrinsic gamma characteristics of the display panel of the elementary color defining the belonging area, and third control point data indicating a shape of a gamma curve of intrinsic gamma characteristics of the display panel of the complementary color defining the belonging area, in response to the first, second and third distances, and to calculate the R, G and B control point data by correcting the fourth control point data based on the first, second and third distances.

13. An image processing device, comprising:

a processing circuit configured to perform digital arithmetic processing on R, G and B grayscale values of input image data to calculate R, G and B grayscale values of output image data, respectively;

a control point data generation circuit configured to:

generate first control point data indicating a shape of a gamma curve of a desired gamma value;

calculate R control point data indicating an input-output curve of digital arithmetic processing performed on the R grayscale value of the input image data by correcting the first control point data in response to a position of a corresponding point corresponding to the input image data in a color space;

calculate G control point data indicating an input-output curve of digital arithmetic processing performed on the G grayscale value of the input image data by correcting the first control point data in response to the position of the corresponding point in the color space; and calculate B control point data indicating an input-output curve of digital arithmetic processing performed on the B grayscale value of the input image data by correcting the first control point data in response to the position of the corresponding point in the color space, wherein the processing circuit is configured to: calculate the R grayscale value of the output image data in response to the R control point data, calculate the G grayscale value of the output image data in response to the G control point data, and calculate the B grayscale value of the output image data in response to the B control point data;

wherein the control point data generation circuit is configured to:

select a belonging area to which the corresponding point corresponding to the input image data in the color space belongs from among a plurality of areas each defined by a white point, a vertex corresponding to an elementary color and a vertex corresponding to a complementary color in the color space, calculate a first distance between a selected elementary color vertex and the corresponding point corresponding to the input image data in the color space, a second distance between a selected complementary color vertex and the corresponding point corresponding to the input image data in the color space, and a third distance between the white point and the corresponding point corresponding to the input image data; and calculate the R, G and B control point data by correcting the first control point data based on the first, second and third distances, the selected elementary color vertex being the vertex corresponding to an elementary color defining the belonging area, and the selected complementary color vertex being the vertex corresponding to a complementary color defining the belonging area.

14. A method of driving a display panel, comprising:

calculating R, G and B grayscale values of output image data by performing digital arithmetic processing on R, G and B grayscale values of input image data, respectively; and driving the display panel in response to the output image data, wherein the calculating the R, G and B grayscale values of the output image data includes:

generating first control point data indicating a shape of a gamma curve of a desired gamma value;

selecting a belonging area to which a corresponding point corresponding to the input image data in a color space belongs from among a plurality of areas each defined by a white point, a vertex corresponding to an elementary color and a vertex corresponding to a complementary color in the color space, the selected elementary color vertex being the vertex corresponding to an elementary color defining the belonging area, and the selected complementary color vertex being the vertex corresponding to a complementary color defining the belonging area;

calculating a first distance between the selected elementary color vertex and the corresponding point corresponding to the input image data in the color space, a second distance between the selected complementary color vertex and the corresponding point corresponding to the input image data in the color space, and a third distance between the white point and the corresponding point corresponding to the input image data;

calculating R control point data indicating an input-output curve of digital arithmetic processing performed on the R grayscale value of the input image data by correcting the first control point data in response to the first to third distances;

calculating G control point data indicating an input-output curve of digital arithmetic processing performed on the G grayscale value of the input image data by correcting the first control point data in response to the first to third distances;

calculating B control point data indicating an input-output curve of digital arithmetic processing performed on the B grayscale value of the input image data by correcting the first control point data in response to the first to third distances;

calculating the R grayscale value of the output image data in response to the R control point data;

calculating the G grayscale value of the output image data in response to the G control point data; and calculating the B grayscale value of the output image data in response to the B control point data.

* * * * *